US006612100B1

(12) United States Patent
Morimoto et al.

(10) Patent No.: US 6,612,100 B1
(45) Date of Patent: Sep. 2, 2003

(54) SHEET PACKAGE PRODUCTION SYSTEM

(75) Inventors: Hideyuki Morimoto, Minamiashigara (JP); Hirokazu Kawai, Fujinomiya (JP); Yuji Okabe, Minamiashigara (JP); Yasushi Kikuchi, Fujinomiya (JP); Masao Tsuruta, Fujinomiya (JP); Takao Asakura, Fujinomiya (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/643,739

(22) Filed: Aug. 23, 2000

(30) Foreign Application Priority Data

Aug. 23, 1999 (JP) ..... 11-236199

(51) Int. Cl.[7] ..... B65B 35/50

(52) U.S. Cl. ..... 53/540; 53/154; 53/171; 53/230; 53/389.1; 53/564

(58) Field of Search ..... 53/136.4, 250, 53/251, 284.5, 562, 563, 540, 171, 173, 154, 564, 382.1, 382.2, 383.1, 386.1, 387.1, 389.1, 449, 230, 450, 228, 466, 157, 243; 198/341.08, 341.09

(56) References Cited

U.S. PATENT DOCUMENTS 3,374,603 A * 3/1968 Miller et al. ..... 53/58
3,411,263 A * 11/1968 Smolderen ..... 53/450
3,566,755 A * 3/1971 Smith et al. ..... 53/540
3,685,253 A * 8/1972 Herrell et al. ..... 53/228
3,775,930 A * 12/1973 Mercer et al. ..... 53/387.1
4,115,981 A * 9/1978 Hell et al. ..... 53/136.1
4,120,491 A * 10/1978 Lang ..... 271/64
4,139,978 A * 2/1979 Jensen et al. ..... 53/284.3
4,139,980 A * 2/1979 Larson et al. ..... 53/520
4,219,988 A * 9/1980 Shanklin et al. ..... 53/568
4,449,351 A * 5/1984 Henderson ..... 53/382
4,481,751 A * 11/1984 Ujhelyi ..... 53/466
4,508,210 A * 4/1985 Ramcke et al. ..... 198/627
4,939,888 A * 7/1990 Katz et al. ..... 53/157
5,379,571 A * 1/1995 Gottfreid ..... 53/243
5,502,954 A * 4/1996 Akiyama et al. ..... 53/230
5,664,405 A * 9/1997 Perego ..... 53/382.1
5,878,554 A * 3/1999 Loree et al. ..... 53/540
5,907,946 A * 6/1999 Oishi et al. ..... 53/281

* cited by examiner

*Primary Examiner*—John Sipos
*Assistant Examiner*—Louis Huynh
(74) *Attorney, Agent, or Firm*—Sughrue Mion, PLLC

(57) ABSTRACT

A protective cover that is pre-folded by a protective cover pre-folding apparatus is supplied to a pack producing apparatus. After sheets are stacked on the protective cover, the protective cover is fully folded onto the sheets to produce a pack, which is then inserted into a bag to produce a package. The package is then delivered from a package stacking apparatus.

8 Claims, 78 Drawing Sheets

SHEET PACKAGE PRODUCTION SYSTEM

BACKGROUND OF THE INVENTION

1. Field of the Invention

The present invention relates to a sheet package production system for producing a package containing a stack of sheets.

2. Description of the Related Art

X-ray films or the like are produced by cutting a roll of photosensitive material into sheets of predetermined length, stacking a plurality of sheets, placing a protective cover on the stack of sheets, and inserting the sheets with the protective cover into a light-shielding bag, which is sealed and shipped as a packaged product.

The production of such sheets requires many complex processing steps to be performed. It has been highly difficult to automate all the processing steps for efficient production of the sheets. If the sheets are made of photosensitive material, e.g., if the sheets are photographic films, then since all the processing steps need to be carried out in a light-shielded environment, the processing steps become more complicated.

Specifically, a protective cover to be placed on a stack of sheets is folded so as to surround the sheets. The protective cover is folded by a robot, which is considerably expensive because it needs to make complex motions to fold the protective cover. If the protective cover is supplied in a folded shape, then it tends to cause trouble, e.g., its folded edges are likely to be caught in the sheet package production system upon feeding movement therein, and the folded protective cover is liable to take up a large area in the sheet package production system.

The efficiency with which to produce sheets may be increased by feeding sheets at higher speeds between various processing stations of the sheet package production system. However, sheets may not be fed at higher speeds in certain instances. For example, if a stack of sheets prior to be being inserted into a light-shielding bag is to be fed at a higher speed, the stacked sheets tend to collapse due to an abrupt increase in the speed when the sheets start being fed.

One solution is to start feeding the sheets at a lower speed and then feed the sheets at a progressively higher speed. However, the feed mechanism for feeding the sheets may not be controlled according to such a feed speed pattern. Specifically, processing stations positioned respectively upstream and downstream of the feed mechanism may not necessarily operate in synchronism with each other. For example, while a sheet is being fed at a lower speed in the processing station downstream of the feed mechanism, another sheet may be fed at a higher speed in the processing station upstream of the feed mechanism.

In the sheet package production system, a number of packaged products are stacked in a magazine and fed for efficiently processing the packaged products without taking up an increased space. If the packaged products are inflated by air, the stacked packaged products tend to collapse while they are being fed. Furthermore, unless a suitable amount of air is removed from the packaged products, the sheets in the packages are liable to move and be scratched or otherwise damaged. If, on the other hand, an excessive amount of air is removed from the packaged products when they are sealed, then since the light-shielding bag is held in intimate contact with the sheets, a portion of the sheets may be sealed together with the light-shielding bag at the time a front or rear end of the light-shielding bag is sealed, resulting in defective packaged products.

SUMMARY OF THE INVENTION

It is a general object of the present invention to provide a sheet package production system which is capable of producing packaged sheets efficiently in an automated production process.

A major object of the present invention is to provide a sheet package production system which is capable of reliably and efficiently supplying a protective cover for sheets without causing trouble.

Another major object of the present invention is to provide a sheet package production system which is of a relatively small size and capable of reliably placing a protective cover on sheets, and which is highly versatile in that it can easily handle sheets regardless of modifications of specifications thereof.

Still another major object of the present invention is to provide a sheet package production system which is capable of feeding stacked sheets efficiently without allowing the stacked sheets to collapse, and which is also capable of feeding stacked sheets irrespective of the timing of processing the sheets before and after the sheets are fed.

Yet another major object of the present invention is to provide a sheet package production system which is capable of appropriately drawing air from a package that contains stacked sheets, efficiently feeding the packaged sheets without allowing the sheets to collapse, and preventing defective packaged products from being produced.

Yet still another major object of the present invention is to provide a sheet package production system which is capable of folding a package reliably into a compact shape through a simple arrangement, and preventing defective packaged products from being produced.

A further major object of the present invention is to provide a sheet package production system which is capable of stacking packages reliably and quickly through a simple arrangement, preventing sheets housed in packages from being damaged, and handling packages of various sizes.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
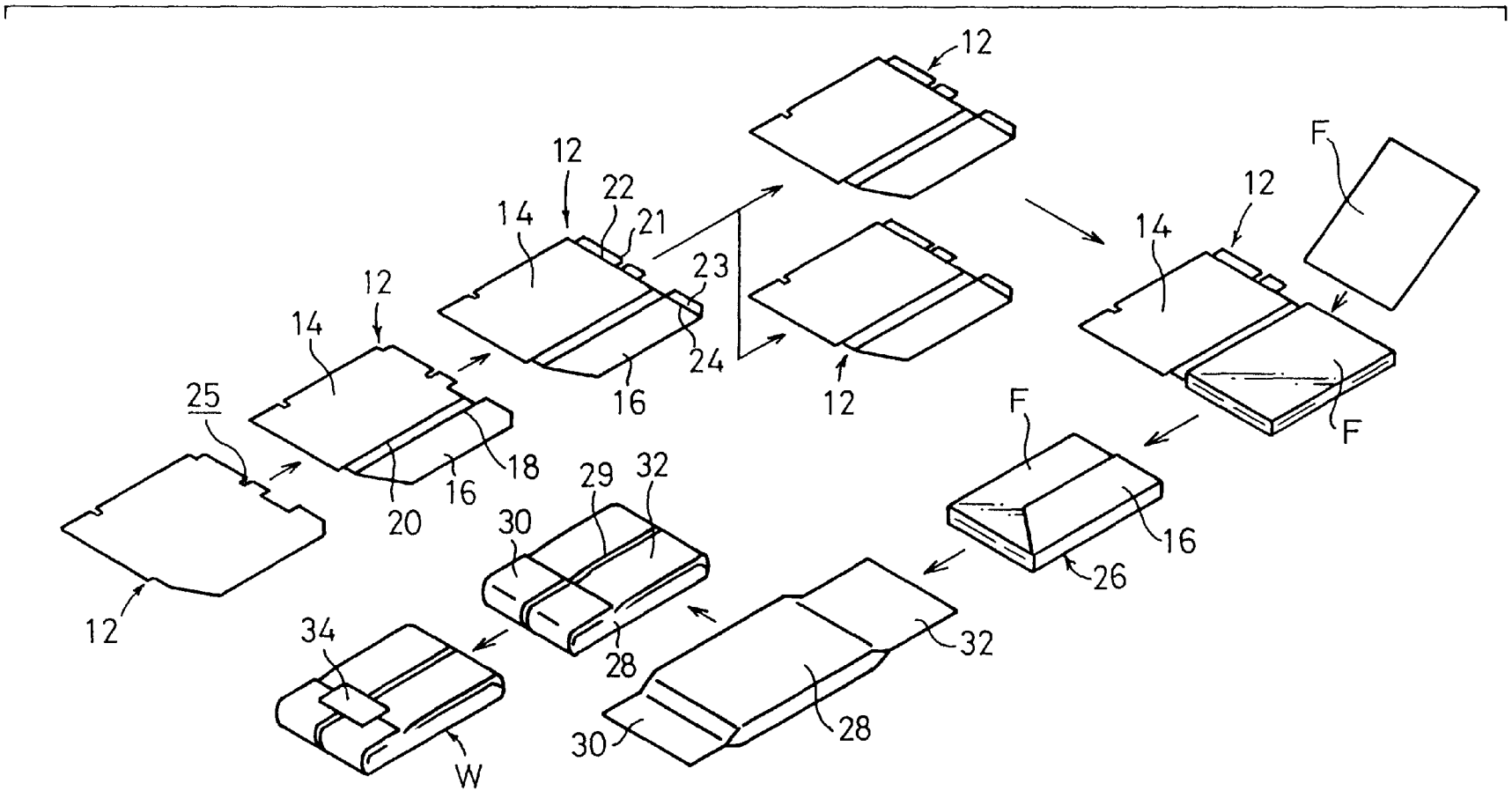
FIG. 1 is a schematic perspective view illustrative of a process of manufacturing a film package.

FIG. 1 illustrates a process of producing a film package W which is carried out by a film package production system 10 (see FIG. 2) according to the present invention. Films F produced in the film package production system 10 include a thermally developed photosensitive medium that produces colors depending on stored image information when heated.

In the film package production system 10, flat protective covers 12 supplied for films F are pre-folded by forming a first fold line 18 and a second fold line 20 between a bottom panel 14 and a top panel 16 of a flat protective cover 12 supplied for films F, and also forming a third fold line 22 in a side panel 21 of the bottom panel 14 and a fourth fold line 24 in a side panel 23 of the top panel 16. The side panel 21 has a slit 25 defined therein for receiving the side panel 23 therein.

The pre-folded protective covers 12 are distributed to two positions. In each of the two positions, films F are stacked on the top panel 16 of the protective cover 12. After the films F are stacked on the top panel 16, the bottom panel 14 of the protective cover 12 is folded over the uppermost film F of the film stack, and the side panels 21, 23 are brought into engagement with each other, producing a pack 26. Therefore, the pack 26 refers to a stack of films F at least partly covered with a protective cover 12. The pack 26 is turned 180° and then inverted, i.e., turned upside down. The top panel 16 on the films F that are partly exposed is positioned on the top of the pack 26. When the films F are subsequently supplied to an image recording apparatus, the films F are successively attracted by a film attracting means which acts on the exposed surfaces of the films F.

The inverted pack 26 is placed into a light-shielding bag 28 having a front flap 30 and a rear flap 32 which project respectively from front and rear ends of the light-shielding bag 28. The front flap 30 and the rear flap 32 are then folded back over one side of the light-shielding bag 28. A label 34 with product information recorded thereon is applied to a superposed region of the folded front and rear flaps 30, 32. The film package W thus produced as a final product is then encased and shipped.

Figure 2:
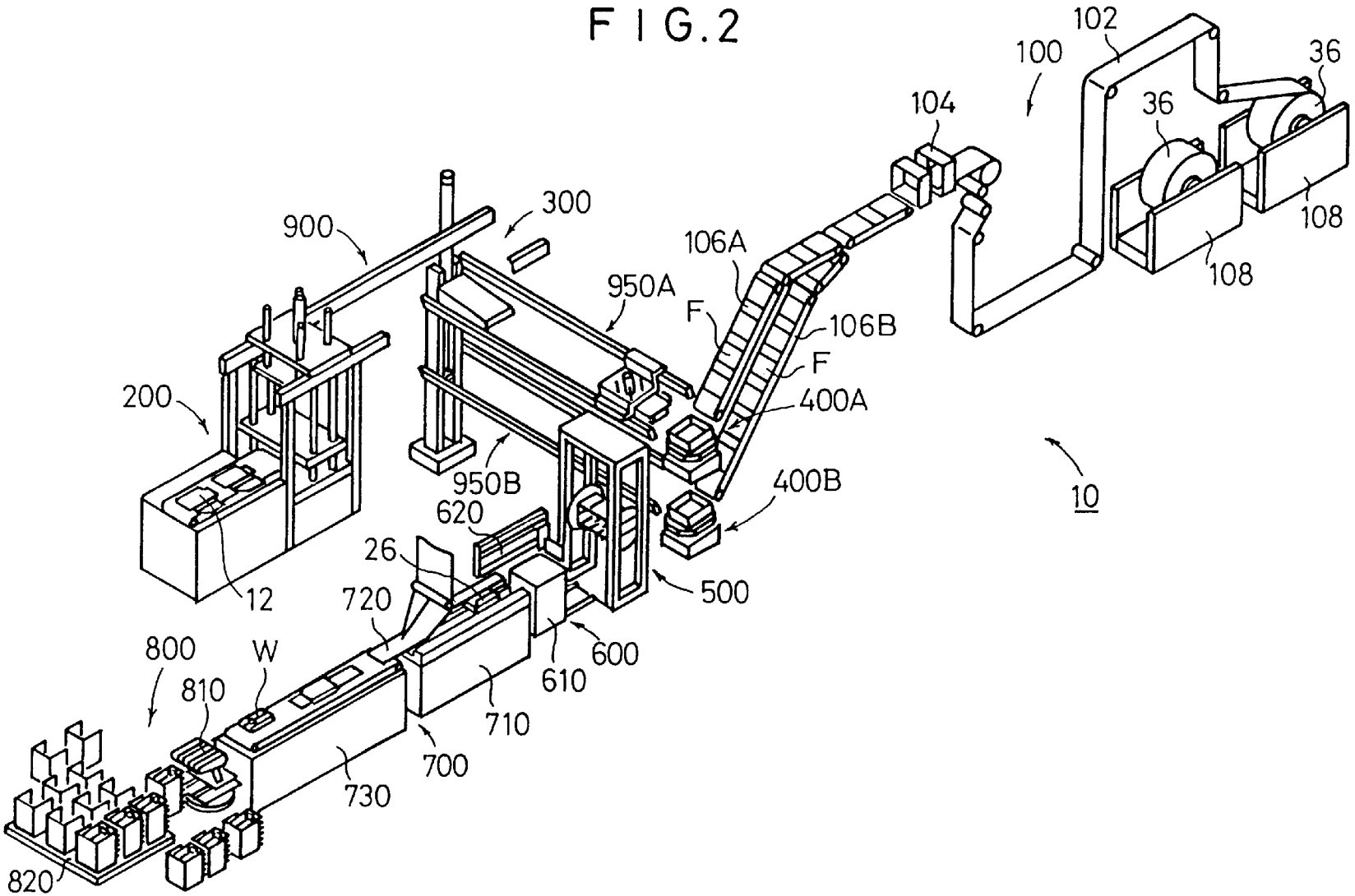
FIG. 2 is a schematic perspective view of a film package production system.

The film package production system 10 will be described below with reference to FIG. 2. The film package production system 10 is capable of alternatively producing the film package W shown in FIG. 1, which is referred to as a small-size film package W, and a large-size film package. The film package production system 10 for producing the small-size film package W will primarily be described below.

The film package production system 10 basically comprises a film supply apparatus 100, a protective cover pre-folding apparatus 200, a protective cover distributing and supplying apparatus 300, pack producing apparatus 400A, 400B, a pack inverting apparatus 500, a pack feeding apparatus 600, a package producing apparatus 700, and a package stacking apparatus 800.

The film supply apparatus 100 cuts a roll film 36 into films F of given length and supplies the films F to the pack producing apparatus 400A, 400B. The protective cover pre-folding apparatus 200 pre-folds a protective cover 12 along the first fold line 18, the second fold line 20, the third fold line 22, and the fourth fold line 24, and supplies the pre-folded protective cover 12 to the protective cover distributing and supplying apparatus 300. Between the protective cover pre-folding apparatus 200 and the protective cover distributing and supplying apparatus 300, there is disposed a protective cover attracting and feeding apparatus 900 for attracting and feeding a protective cover 12 to the protective cover distributing and supplying apparatus 300.

The protective cover distributing and supplying apparatus 300 distributes protective covers 12 to the pack producing apparatus 400A, 400B. Between the pack producing apparatus 400A, 400B, there are disposed an upper protective cover attracting and feeding apparatus 950A and a lower protective cover attracting and feeding apparatus 950B for attracting and feeding protective covers 12 to the pack producing apparatus 400A, 400B.

Each of the pack producing apparatus 400A, 400B stacks a plurality of films F on a protective cover 12, and folds the protective cover 12 over the stack of films F, thereby producing a pack 26. The pack inverting apparatus 500 inverts or turns the pack 26 upside down. The pack feeding apparatus 600 supplies the pack 26 from the pack inverting apparatus 500 to the package producing apparatus 700. The pack feeding apparatus 600 has a pack carriage 610 for removing the pack 26 from the pack inverting apparatus 500 and feeding the removed pack 26, and a pack delivery machine 620 for delivering the pack 26 from the pack carriage 610 to the package producing apparatus 700.

The package producing apparatus 700 places a pack 26 into a light-shielding bag 28 to produce a film package W. The package producing apparatus 700 has a pack feeder 710 for feeding a pack 26 to be packaged, a pack inserter 720 for inserting the pack 26 into a light-shielding bag 28, and a film package producer 730 for folding the front and rear flaps 30, 32 of the light-shielding bag 28 and applying a label 34 to produce a film package W.

The package stacking apparatus 800 has a package delivery machine 810 for delivering a film package W from the package producing apparatus 700, and a package stacker 820 for placing the film package W delivered by the package delivery machine 810 into a magazine 854, and stacking a plurality of magazines 854 on a pallet 855.

The above various apparatus of the film package production system 10 will be described in detail below. Film supply apparatus 100 (see FIG. 2):

The film supply apparatus 100 has a film feed line 102, a film cutter 104 for cutting a roll film 36 fed along the film feed line 102 into films F of given length, and an upper film feed line 106A and a lower film feed line 106B branched from the film feed line 102 for feeding films F to the pack producing apparatus 400A, 400B. The film feed line 102 is continuously supplied with the roll film 36 from one of two carriages 108, which can switch from one to the other for uninterrupted supply of the film roll 36. The film supply apparatus 100 can selectively supply films F to be stacked on small-size protective covers 12 and wider films to be stacked on large-size protective covers 12.

Figure 3:
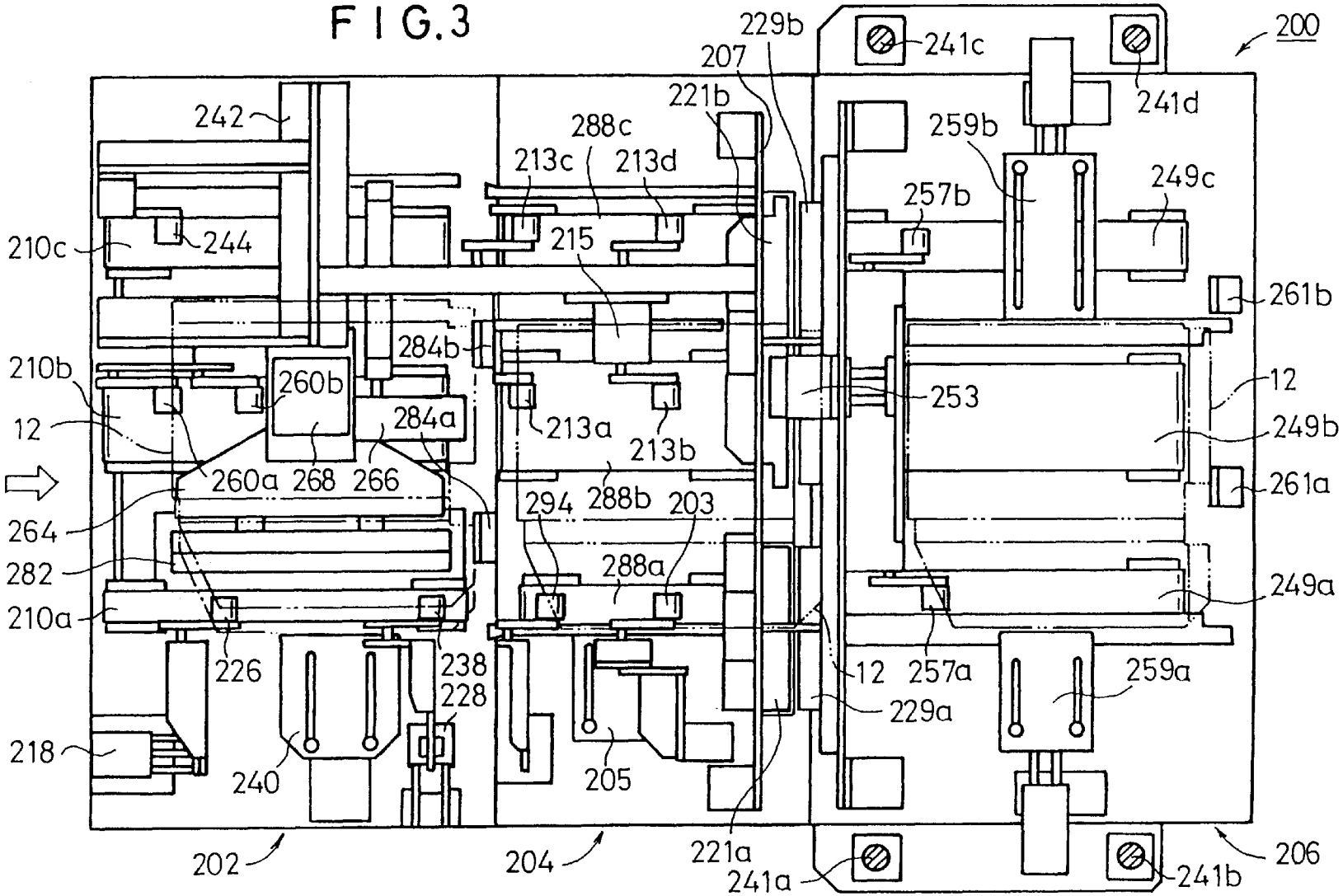
FIG. 3 is a plan view of a protective cover pre-folding apparatus.

Protective Cover Pre-folding Apparatus 200 (See FIGS. 3 Through 9):

As shown in FIG. 3, the protective cover pre-folding apparatus 200 basically comprises a first pre-folding mechanism 202, a second pre-folding mechanism 204, and a lifting and lowering mechanism 206. The first pre-folding mechanism 202 pre-folds a protective cover 12 fed in the direction indicated by the arrow along the first fold line 18 and the second fold line 20. The second pre-folding mechanism 204 pre-folds the protective cover 12 along the third fold line 22 and the fourth fold line 24. The lifting and lowering mechanism 206 feeds the pre-folded protective cover 12 upwardly to the protective cover attracting and feeding apparatus 900.

Figure 4:
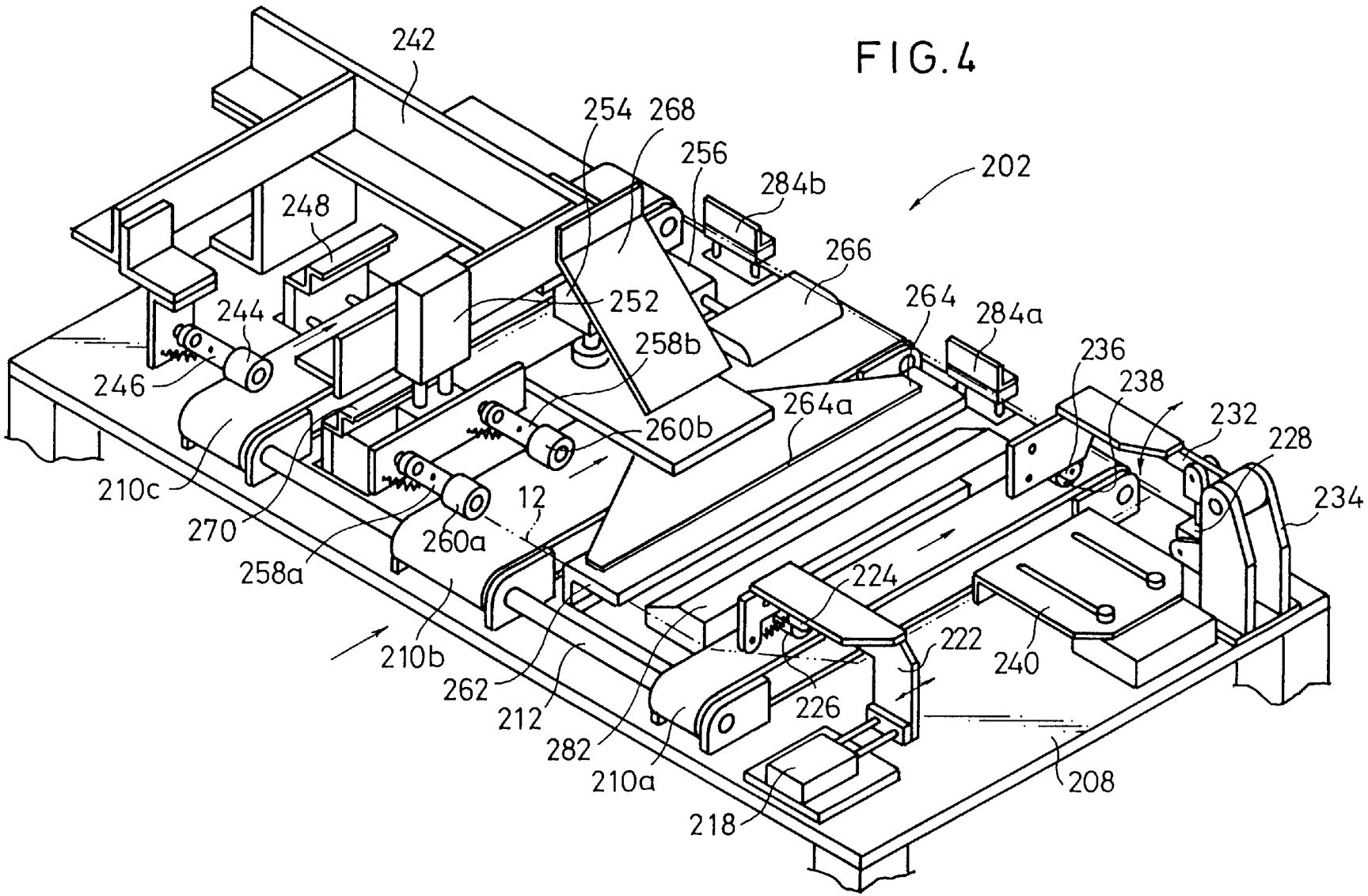
FIG. 4 is a perspective view of a first pre-folding mechanism in the protective cover pre-folding apparatus.
Figure 5:
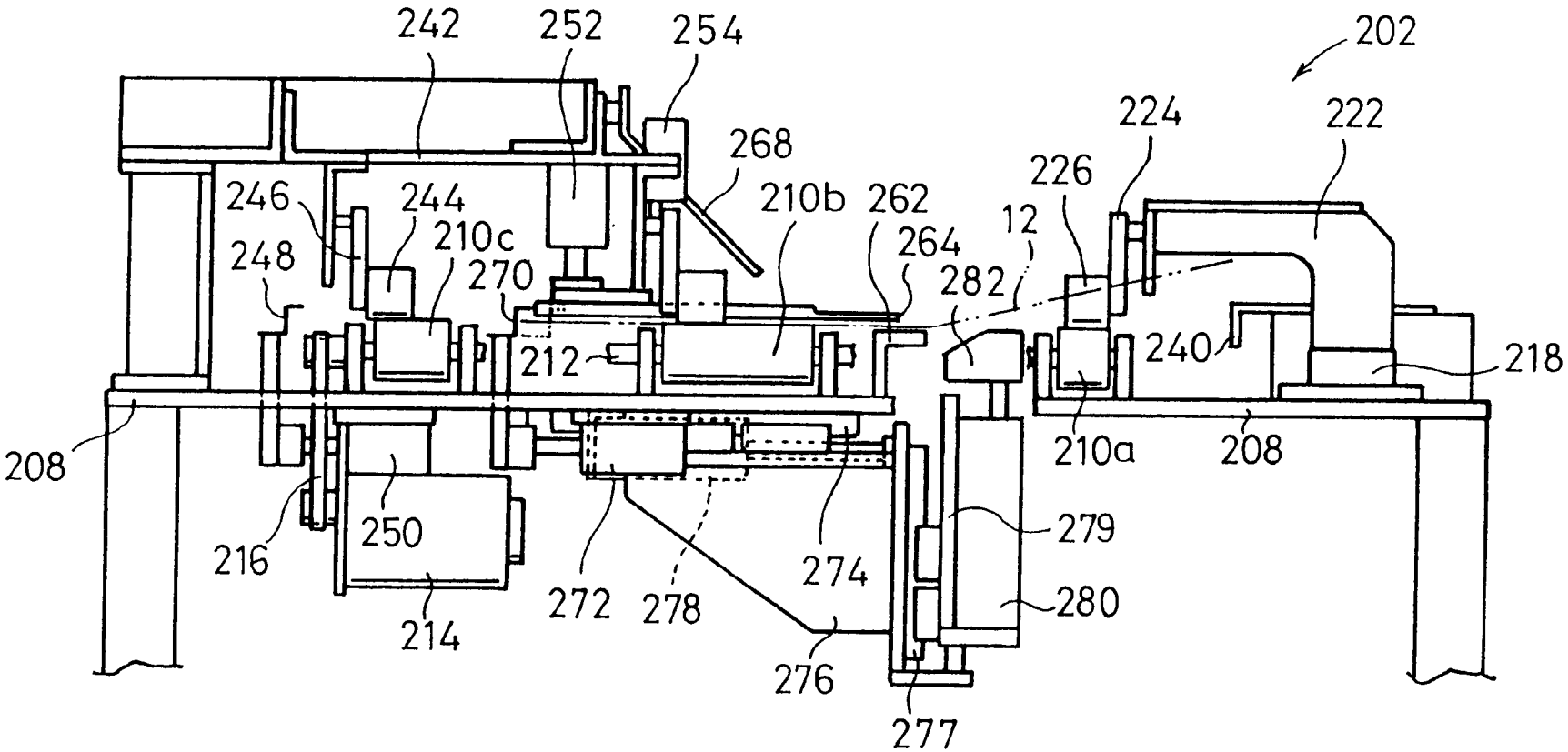
FIG. 5 is a front elevational view of the first pre-folding mechanism in the protective cover pre-folding apparatus.

As shown in FIGS. 4 and 5, the first pre-folding mechanism 202 has three feed belts 210*a*, 210*b*, 210*c* mounted on a base 208. The feed belts 210*a*, 210*b* serve to support and feed small-size protective covers 12, and the feed belts 210*a*, 210*b*, 210*c* serve to support and feed large-size protective covers. The feed belts 210*a*, 210*b*, 210*c* are operatively coupled to each other by a drive shaft 212 which can be rotated about its own axis by a motor 214 disposed on a lower surface of the base 208 through a belt 216.

A roller displacing cylinder 218 is disposed on one side of the feed belt 210*a* and coupled to a bracket 222 to which a roller 226 is coupled by a link 224. The roller 226 can be displaced along the feed belt 210*a* by the roller displacing cylinder 218. The roller 226 and the feed belt 210*a* jointly grip a leading end of the top panel 16 of a protective cover 12.

A roller turning cylinder 228 is also disposed on one side of the feed belt 210*a*. A bracket 232 has an intermediate portion pivotally supported on the roller turning cylinder 228. The bracket 232 has an end pivotally supported on the base 208 by a bracket 234 and an opposite end to which a roller 238 is coupled by a link 236. The roller 238 is movable toward and away from the feed belt 210*a* by the roller turning cylinder 228. The roller 238 and the feed belt 210*a* jointly grip a trailing end of the top panel 16 of a protective cover 12.

A positioning plate 240 for positioning the top panel 16 of a protective cover 12 is disposed between the roller displacing cylinder 218 and the roller turning cylinder 228. The positioning plate 240 is movable in a direction perpendicular to the feed belt 210*a* to a position depending on the size of a protective cover 12 to be pre-folded.

A bracket 242 is fixedly mounted on the base 208 on one side of the feed belt 210*c*. A roller 244 is coupled by a link 246 to the bracket 242. The roller 244 and the feed belt 210*c* jointly grip the bottom panel 14 of a large-size protective cover 12. A presser plate 248 for pressing the bottom panel 14 of a large-size protective cover 12 toward the top panel 16 thereof is disposed on the base 208 on one side of the feed belt 210*c*. The presser plate 248 is displaceable by a presser plate displacing cylinder 250 that is disposed on the lower surface of the base 208.

To the bracket 242, there are fixed a roller displacing cylinder 252, a holder plate displacing cylinder 254, and an extending plate displacing cylinder 256. Rollers 260*a*, 260*b* are coupled to the roller displacing cylinder 252 by links 258*a*, 258*b*, respectively. The rollers 260*a*, 260*b* are movable toward and away from the feed belt 210*b* by the roller displacing cylinder 252. The rollers 260*a*, 260*b* and the feed belt 210*b* jointly grip a leading end of the bottom panel 14 of a protective cover 12. To the holder plate displacing cylinder 254, there is coupled a holder plate 264 for gripping the bottom panel 14 of a protective cover 12 near the first fold line 18 in coaction with a support table 262 fixed to the base 208. The holder plate 264 is movable toward and away from the support table 262 by the holder plate displacing cylinder 254. An extending plate 266 having an arcuate tip end is coupled to the extending plate displacing cylinder 256 for extending the folded top panel 16 of a protective cover 12. The extending plate 266 is displaceable along the protective cover 12 by extending plate displacing cylinder 256.

The bracket 242 also supports a top panel support plate 268 inclined toward the holder plate 264 for supporting the folded top panel 16 of a protective cover 12.

Between the feed belts 210*b*, 210*c*, there is disposed a presser plate 270 for pressing the bottom panel 14 of a small-size protective cover 12 toward the top panel 16 thereof. The presser plate 270 is displaceable by a presser plate displacing cylinder 272 disposed on the lower surface of the base 208.

A guide rail 274 extending perpendicularly to the feed belt 210*b* is disposed on the lower surface of the base 208. A bracket 276 is movably held in engagement with the guide rail 274 and displaceable along the guide rail 274 by a bracket displacing cylinder 278 fixedly mounted on the base 208. A lifting and lowering cylinder 280 is mounted on the bracket 276 by an attachment bracket 279 that is displaceable along a vertical guide rail 277 mounted on the bracket 276. The attachment bracket 279 has an upper end projecting upwardly from the lifting and lowering cylinder 280. A bending member 282 having a slanted upper surface is coupled to the lifting and lowering cylinder 280 and vertically displaceable by the lifting and lowering cylinder 280. The bending member 282 can also be displaced together with the bracket 276 toward the feed belt 210*b* by the bracket displacing cylinder 278.

Two positioning plates 284*a*, 284*b* for positioning a leading side of a protective cover 12 are disposed on the base 208. The positioning plates 284*a*, 284*b* are vertically displaceable by a lifting and lowering cylinder, not shown, mounted on the base 208.

Figure 6:
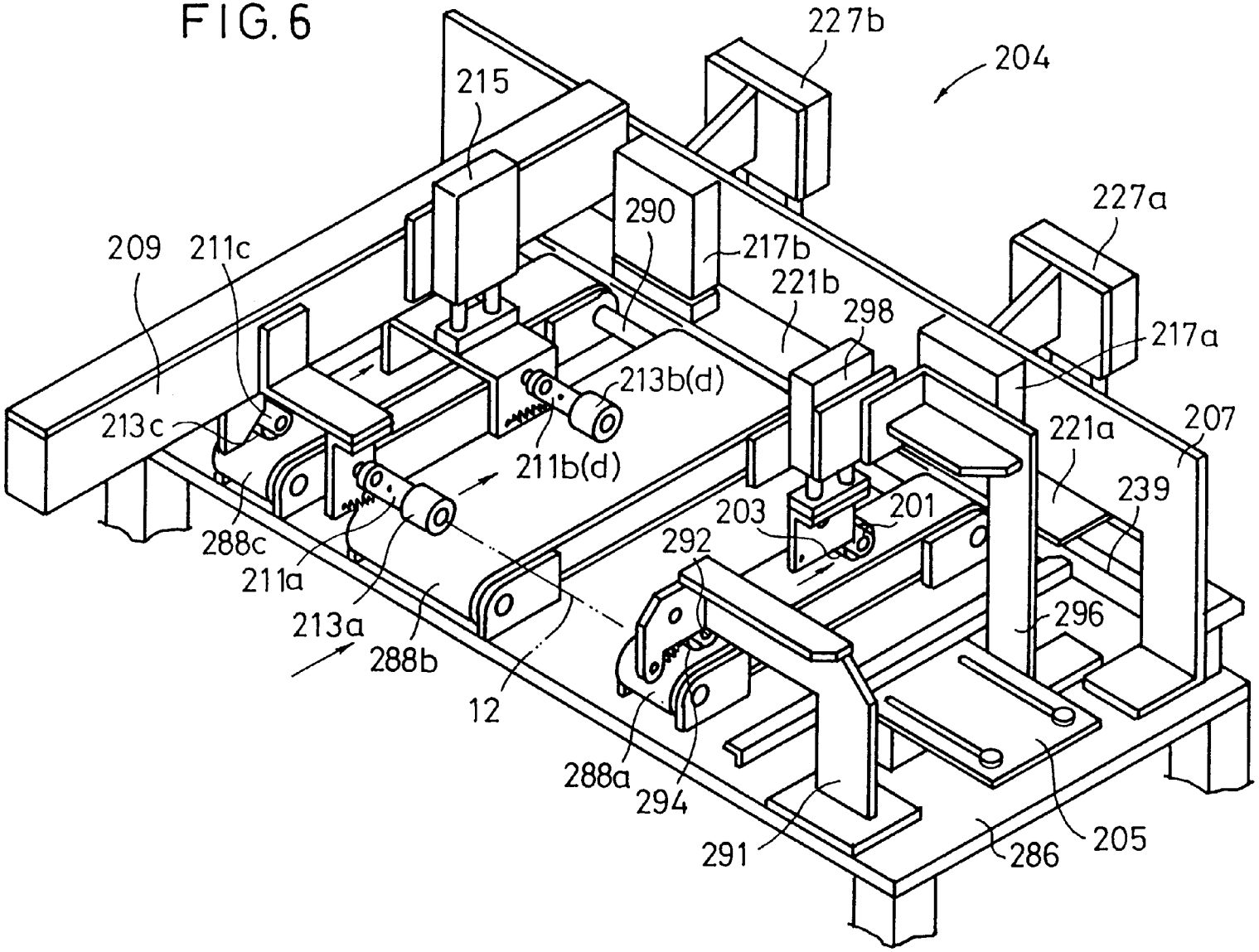
FIG. 6 is a perspective view of a second pre-folding mechanism in the protective cover pre-folding apparatus.
Figure 7:
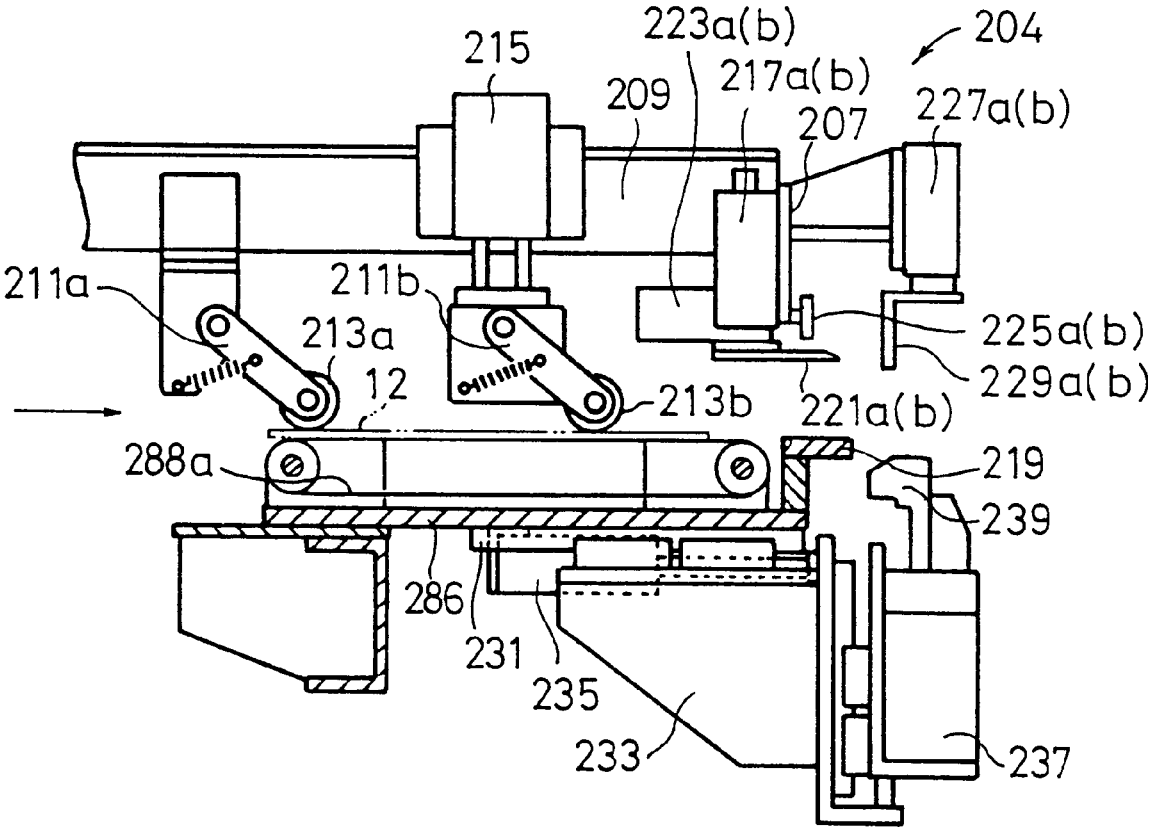
FIG. 7 is a side elevational view of the second pre-folding mechanism in the protective cover pre-folding apparatus.

As shown in FIGS. 6 and 7, the second pre-folding mechanism 204 has three feed belts 288*a*, 288*b*, 288*c* mounted on a base 286. The feed belts 288*a*, 288*b* serve to support and feed small-size protective covers 12, and the feed belts 288*a*, 288*b*, 288*c* serve to support and feed large-size protective covers. The feed belts 288*a*, 288*b*, 288*c* are operatively coupled to each other by a drive shaft 290 which can be rotated about its own axis by a motor, not shown, disposed on a lower surface of the base 286.

A bracket 291 is disposed on one side of the feed belt 288*a*. A roller 294 is coupled to the bracket 291 by a link 292. The roller 294 and the feed belt 288*a* jointly grip a leading end of the top panel 16 of a protective cover 12.

Another bracket 296 is also disposed on one side of the feed belt 288*a*. A roller 203 is coupled to the bracket 296 by a roller displacing cylinder 298 and a link 201. The roller 203 is movable toward and away from the feed belt. 288*a* by the roller displacing cylinder 298. The roller 203 and the feed belt 288*a* jointly grip a trailing end of the top panel 16 of a protective cover 12.

A positioning plate 205 for positioning the top panel 16 of a protective cover 12 is disposed between the brackets 291, 296. The positioning plate 205 is movable in a direction perpendicular to the feed belt 288*a* to a position depending on the size of a protective cover 12 to be pre-folded.

A bracket 207 is mounted on the base 286 and extends across and over the feed belts 288*a*, 288*b*, 288*c*. A bracket 209 disposed between the feed belts 288*b*, 288*c* is coupled to the bracket 207. Rollers 213*a*, 213*b*, 213*c*, 213*d* are connected to the bracket 209 by respective links 211*a*, 211*b*, 211*c*, 211*d*. The rollers 213*a*, 213*b* and the feed belt 288*b* jointly grip the bottom panel 14 of a protective cover 12, and the rollers 213*c*, 213*d* and the feed belt 288*c* jointly grip only a large-size protective cover. The rollers 213*b*, 213*d* are movable toward and away from the feed belts 288*b*, 288*c* by a roller displacing cylinder 215.

Holder plate displacing cylinders 217*a*, 217*b* are fixedly mounted on the bracket 207. Holder plates 221*a*, 221*b* are coupled respectively to the holder plate displacing cylinders 217*a*, 217*b*. The holder plates 221*a*, 221*b* and a support base 219 fixed to the base 286 jointly grip a protective cover 12 near the third fold line 22 and the fourth fold line 24 thereof. To the holder plates 221*a*, 221*b*, there are coupled respective extending plate displacing cylinders 223*a*, 223*b* that are coupled to respective extending plates 225*a*, 225*b* for extending respective side panels 21, 23 of a folded protective cover 12.

To the bracket 207, there are also fixed positioning plate displacing cylinders 227*a*, 227*b* that are coupled to respective positioning plates 229*a*, 229*b* for positioning the respective side panels 21, 23 of a protective cover 12.

A guide rail 231 extending perpendicularly to the direction in which a protective cover 12 is fed by the feed belts 288*a*, 288*b*, 288*c*, 288*d* is disposed on a lower surface of the base 286. A bracket 233 is movably held in engagement with the guide rail 231 and displaceable along the guide rail 231 by a bracket displacing cylinder 235 fixedly mounted on the base 286. A lifting and lowering cylinder 237 is mounted on the bracket 233, and a bending member 239 having a slanted upper surface is coupled to the lifting and lowering cylinder 237 and vertically displaceable by the lifting and lowering cylinder 237. The bending member 239 can also be displaced together with the bracket 233 toward the feed belts 288*a*, 288*b*, 288*c*, 288*d* by the bracket displacing cylinder 235.

Figure 8:
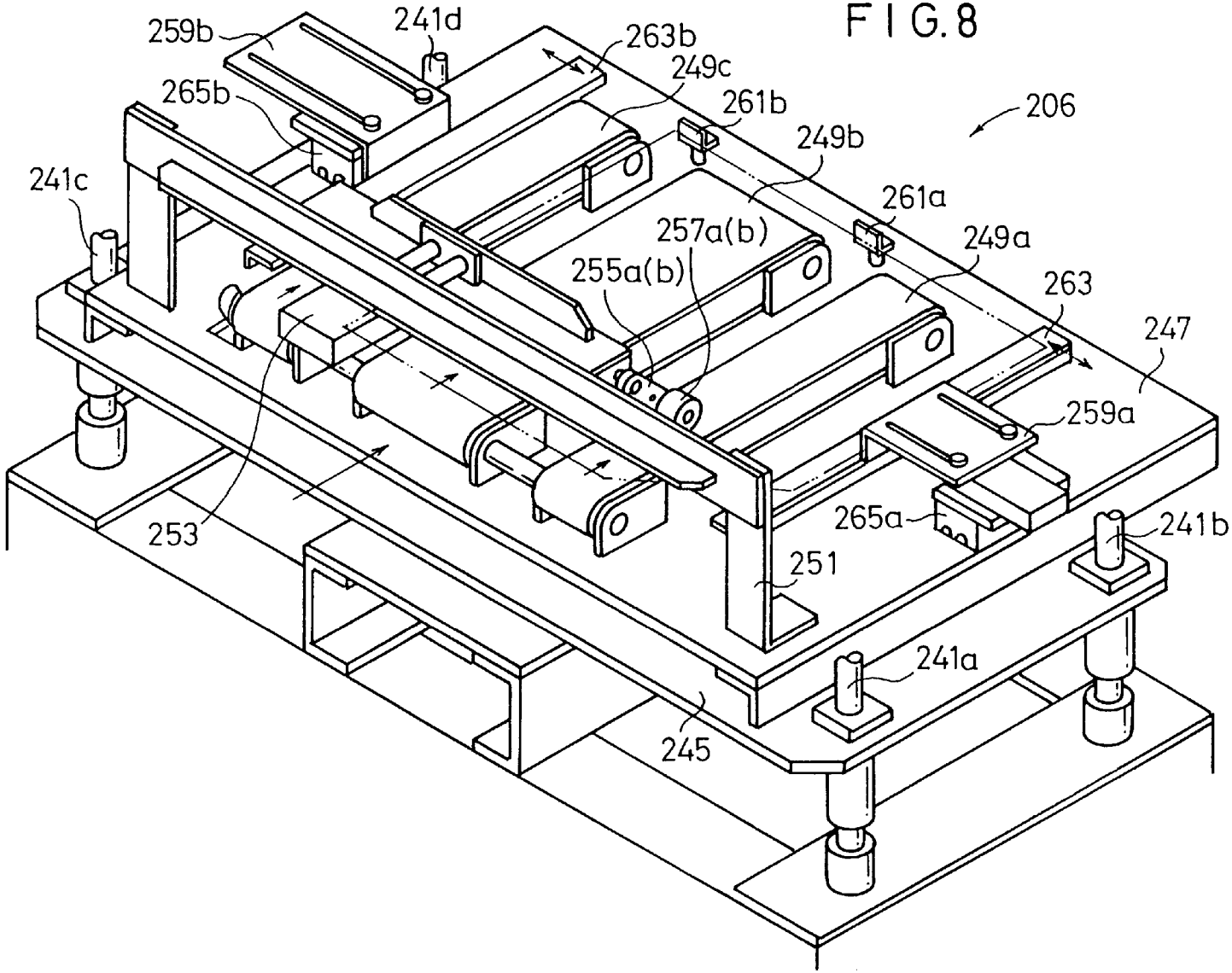
FIG. 8 is a perspective view of a lifting and lowering mechanism in the protective cover pre-folding apparatus.
Figure 9:
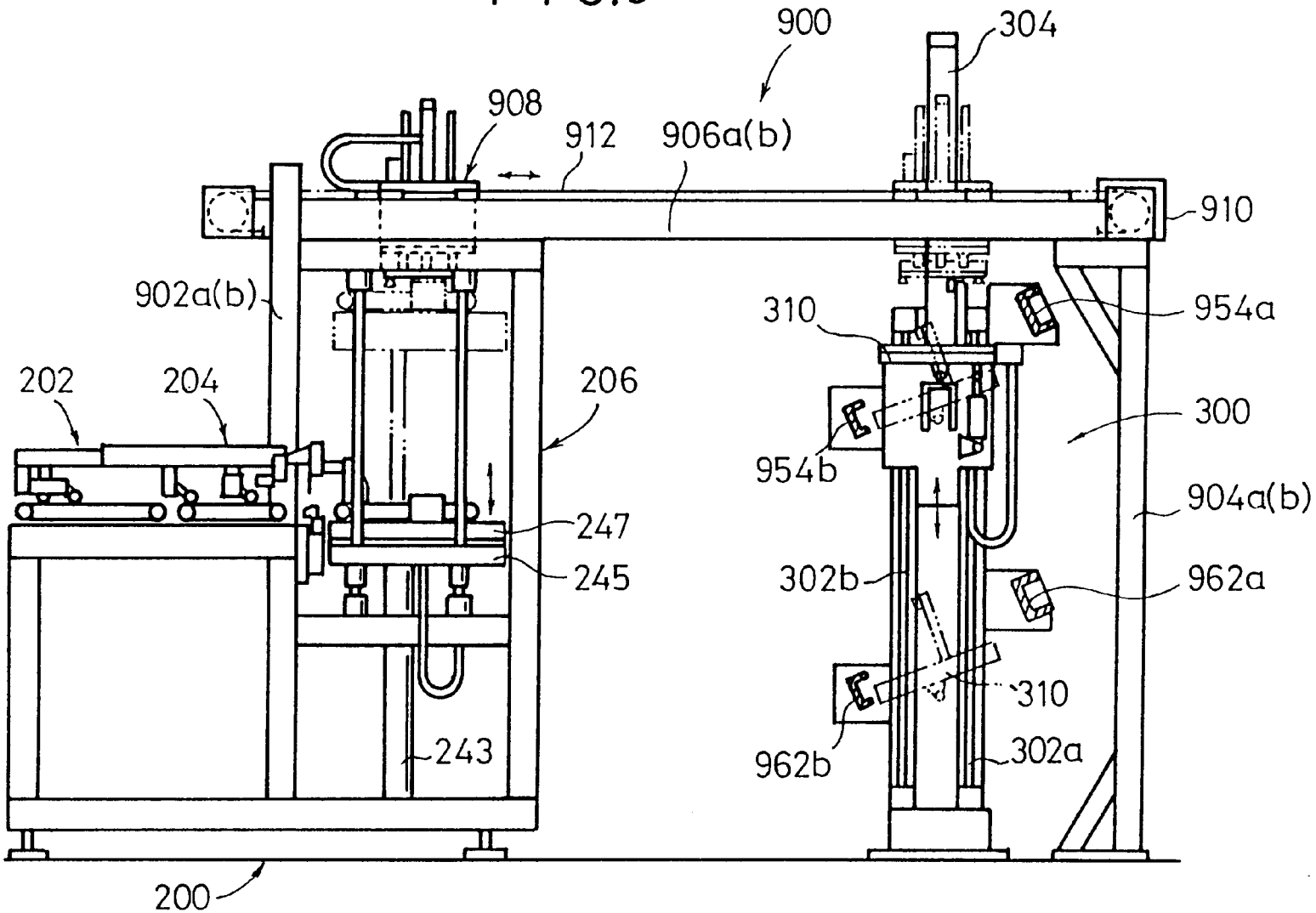
FIG. 9 is a view showing the layout of the protective cover pre-folding apparatus, a protective cover distributing and supplying apparatus, and a protective cover attracting and feeding apparatus which interconnects the protective cover pre-folding apparatus and the protective cover distributing and supplying apparatus.

As shown in FIGS. 8 and 9, the lifting and lowering mechanism 206 has a lifting and lowering table 245 supported by four guide rods 241*a*, 241*b*, 241*c*, 241*d* and vertically movable by a lifting and lowering cylinder 243. The lifting and lowering table 245 supports thereon a base 247 on which three feed belts 249*a*, 249*b*, 249*c* are disposed. The feed belts 249*a*, 249*b* serve to support and feed small-size protective covers 12, and the feed belts 249*a*, 249*b*, 249*c* serve to support and feed large-size protective covers.

A bracket 251 is disposed on the base 247 at an end thereof for receiving a leading side of a protective cover 12. Rollers 257*a*, 257*b* are coupled to the bracket 251 by a roller displacing cylinder 253 and links 255*a*, 255*b*. The rollers 257*a*, 257*b* and the feed belts 249*a*, 249*b*, 249*c* jointly grip a protective cover 12. The rollers 257*a*, 257*b* are displaceable along the feed belts 249*a*, 249*b*, 249*c* by the roller displacing cylinder 253.

Holder mechanisms 259*a*, 259*b* are disposed on the base 247 on sides of the feed belts 249*a*, 249*c*, respectively. Substantially L-shaped holder plates 263*a*, 263*b* for holding a protective cover 12 are mounted on ends of the holder mechanisms 259*a*, 259*b*. The holder mechanisms 259*a*, 259*b* are movable in directions perpendicularly to the feed belts 249*a*, 249*b*, 249*c* by respective cylinders 265*a*, 265*b*. Positioning plates 261*a*, 261*b* for positioning the sides 21, 23 of a protective cover 12 are mounted on the base 247.

Protective Cover Attracting and Feeding Apparatus 900 (See FIGS. 9 and 10):

As shown in FIG. 9, the protective cover attracting and feeding apparatus 900 is disposed between the lifting and lowering mechanism 206 of the protective cover pre-folding apparatus 200 and the protective cover distributing and supplying apparatus 300. The protective cover attracting and feeding apparatus 900 has guide rails 906*a*, 906*b* mounted on and extending between support posts 902*a*, 902*b* and 904*a*, 904*b*. An attracting and feeding mechanism 908 for attracting and feeding a protecting cover 12 is disposed on the guide rails 906*a*, 906*b*. The attracting and feeding mechanism 908 is displaceable along the guide rails 906*a*, 906*b* by a belt 912 that is driven by a motor 910 positioned at ends of the guide rails 906*a*, 906*b*.

Figure 10:
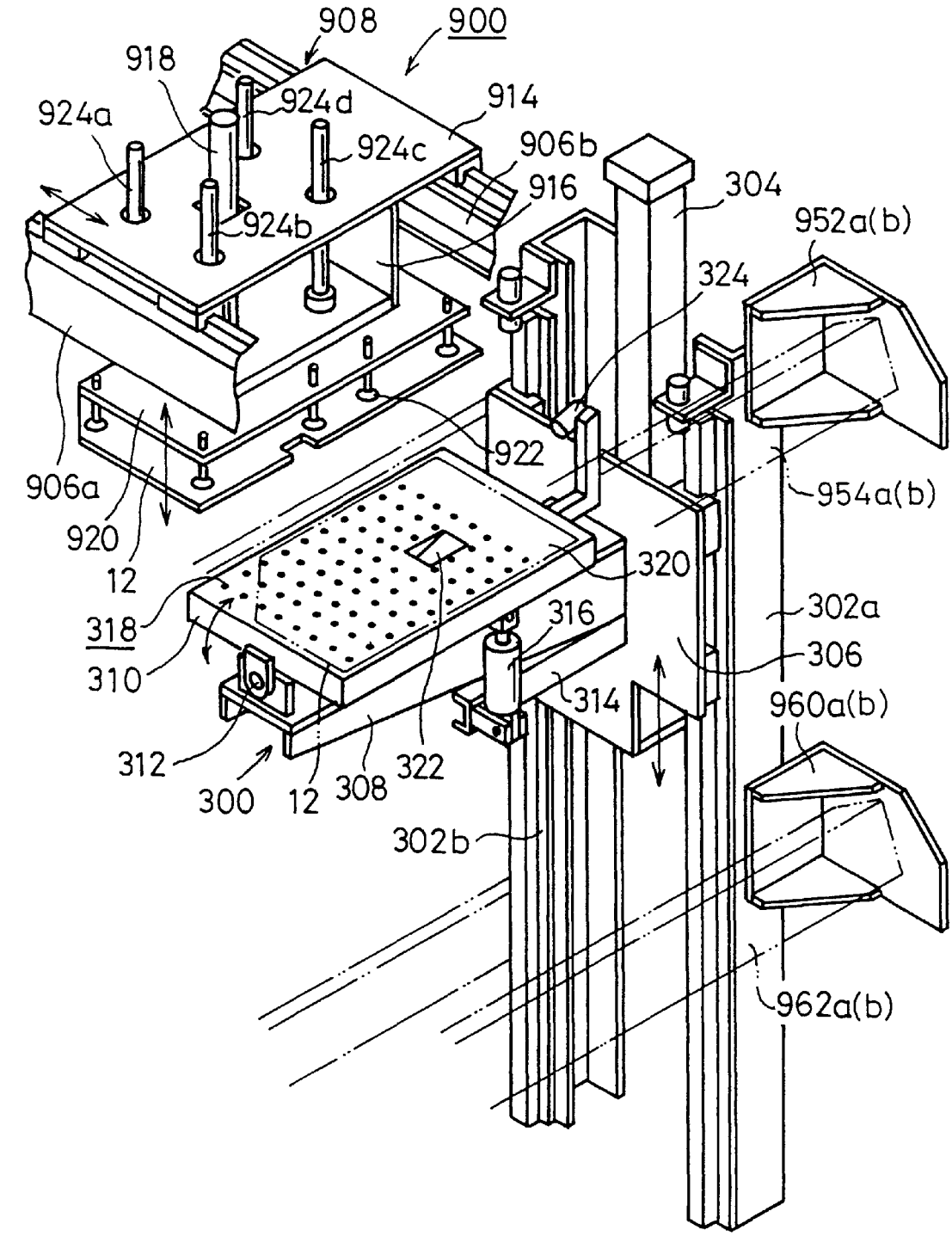
FIG. 10 is a perspective view of the protective cover distributing and supplying apparatus including the protective cover attracting and feeding apparatus.

As shown in FIG. 10, the attracting and feeding mechanism 908 comprises a support plate 914 mounted on and extending between guide rails 906*a*, 906*b*, a bracket 916 coupled to the support plate 914, a lifting and lowering cylinder 918 fixed to the bracket 916, and a lifting and lowering plate 920 coupled to the lifting and lowering cylinder 918. A plurality of suction cups 922 for attracting a protective cover 12 are mounted on the lifting and lowering plate 920. Four guide bars 924*a*, 924*b*, 924*c*, 924*d* extending through the support plate 914 are mounted on the bracket 916.

Protective Cover Distributing and Supplying Apparatus 300 (See FIGS. 9 Through 11):

As shown in FIG. 10, the protective cover distributing and supplying apparatus 300 is disposed near an end of the protective cover attracting and feeding apparatus 900 remote from the protective cover pre-folding apparatus 200. The protective cover distributing and supplying apparatus 300 comprises two upstanding guide rails 302*a*, 302*b*, a lifting and lowering cylinder 304 disposed between the guide rails 302*a*, 302*b*, a lifting and lowering table 306 coupled to the lifting and lowering cylinder 304 for vertical movement while being guided by the guide rails 302*a*, 302*b*, a first bracket 308 fixed to the lifting and lowering table 306, and a protective cover transfer table 310 coupled to the first bracket 308. The protective cover transfer table 310 is pivotally supported on the first bracket 308 by a pivot shaft 312. A second bracket 314 is fixed to the lifting and lowering table 306. The protective cover transfer table 310 is angularly movable by a displacing cylinder 316 that is coupled between the second bracket 314 and the protective cover transfer table 310.

The protective cover transfer table 310 has a number of suction holes 318 defined in a protective cover transfer surface 320 thereof on which a protective cover 12 is to be placed. The protective cover transfer table 310 attracts a protective cover 12 under suction via the suction holes 318. The protective cover transfer surface 320 has a pit 322 defined substantially centrally therein for detecting whether there is a protective cover 12 on the protective cover transfer surface 320 or not. The lifting and lowering table 306 supports thereon a protective cover sensor 324 for applying a light beam toward the pit 322 and detecting whether there is a reflected beam from the pit 322 or not, thereby to detect whether there is a protective cover 12 on the protective cover transfer surface 320 or not.

Figure 11:
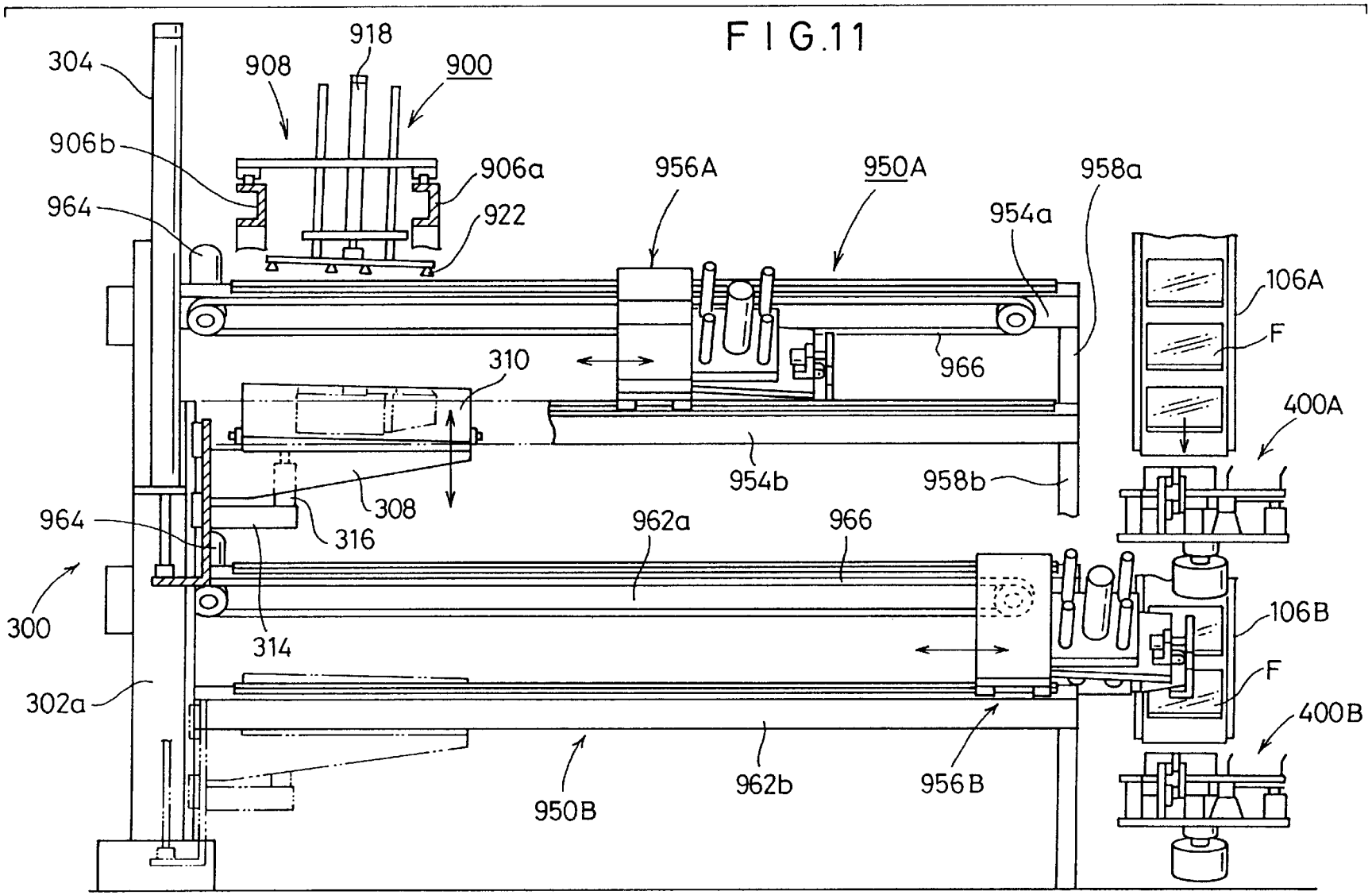
FIG. 11 is a view showing the layout of the protective cover attracting and feeding apparatus, a pack producing apparatus, and upper and lower protective cover attracting and feeding apparatus which interconnect the protective cover attracting and feeding apparatus and the pack producing apparatus.

Upper Protective Cover Attracting and Feeding Apparatus 950A, Lower Protective Cover Attracting and Feeding Apparatus 950B (See FIGS. 11 and 12):

As shown in FIG. 11, the upper protective cover attracting and feeding apparatus 950A and the lower protective cover attracting and feeding apparatus 950B are disposed between the protective cover distributing and supplying apparatus 300 and the pack producing apparatus 400A, 400B.

The upper protective cover attracting and feeding apparatus 950A has a pair of guide rails 954*a*, 954*b* having ends fixed to brackets 952*a*, 952*b* (see FIG. 10) fixed to upper portions of the guide rails 302*a*, 302*b* of the protective cover distributing and supplying apparatus 300, and an attracting and feeding mechanism 956A movable along the guide rails 954*a*, 954*b*. The guide rails 954*a*, 954*b* have other ends fixed to upstanding frames 958*a*, 958*b* near the pack producing apparatus 400A, 400B.

The lower protective cover attracting and feeding apparatus 950B has a pair of guide rails 962*a*, 962*b* having ends fixed to brackets 960*a*, 960*b* (see FIG. 10) fixed to lower portions of the guide rails 302*a*, 302*b* of the protective cover distributing and supplying apparatus 300, and an attracting and feeding mechanism 956B movable along the guide rails 962*a*, 962*b*. The guide rails 962*a*, 962*b* have other ends fixed to upstanding frames 958*a*, 958*b* near the pack producing apparatus 400A, 400B.

The guide rails 954*a*, 962*a* are disposed upwardly of the guide rails 954*b*, 962*b*. The attracting and feeding mechanisms 956A, 956B supported on these guide rails are tilted in the direction in which the protective cover transfer table 310 of the protective cover distributing and supplying apparatus 300 is angularly moved.

Figure 12:
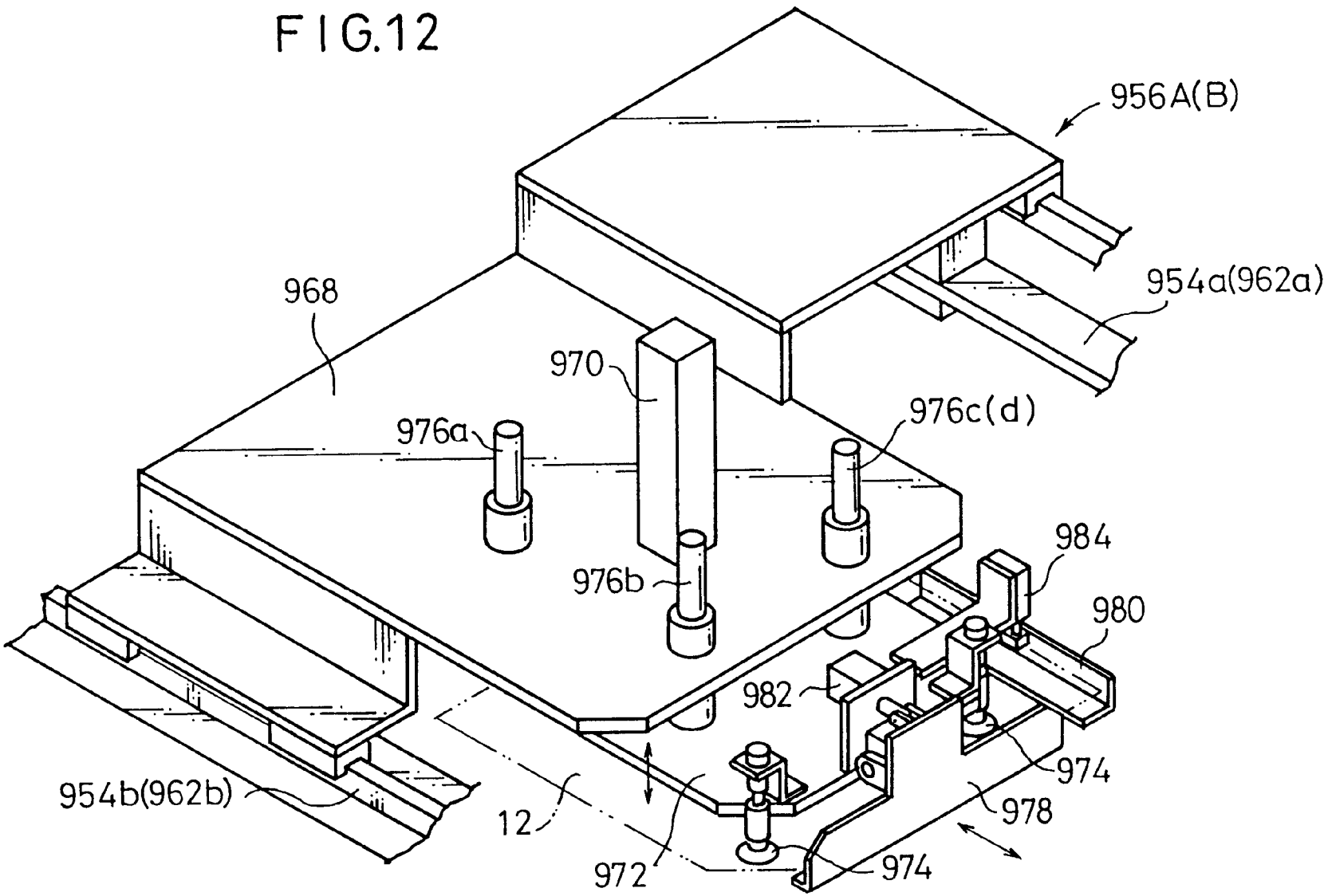
FIG. 12 is a perspective view of an attracting and feeding mechanism of the upper and lower protective cover attracting and feeding apparatus.

The attracting and feeding mechanism 956A is displaceable along the guide rails 954*a*, 954*b* by a belt 966 that is driven by a motor 964 fixed to an end of the guide rail 954*a*. As shown in FIG. 12, the attracting and feeding mechanism 956A comprises a support plate 968 mounted on and extending between the guide rails 954*a*, 954*b*, a lifting and lowering cylinder 970 fixedly mounted on the support plate 968, and a lifting and lowering plate 972 coupled to the lifting and lowering cylinder 970. A plurality of suction cups 974 for attracting a protective cover 12 are mounted on the lifting and lowering plate 972. Four guide bars 976*a*, 976*b*, 976*c*, 976*d* extending through the support plate 968 are mounted on the lifting and lowering plate 972. The lifting and lowering plate 972 is vertically displaceable by the lifting and lowering cylinder 970.

Positioning teeth 978, 980 are mounted respectively on a side of the lifting and lowering plate 972 which corresponds to the top panel 16 of a protective cover 12 and a side of the lifting and lowering plate 972 which corresponds to the side panel 23 of a protective cover 12. The positioning tooth 978 has a central portion pivotally supported on the lifting and lowering plate 972 and an upper portion coupled to a turning cylinder 982 fixedly mounted on the lifting and lowering plate 972. The positioning tooth 980 is coupled to a lifting and lowering cylinder 984 fixedly mounted on the lifting and lowering plate 972.

The attracting and feeding mechanism 956B will not be described in detail below as it is identical in structure to the attracting and feeding mechanism 956A.

Figure 13:
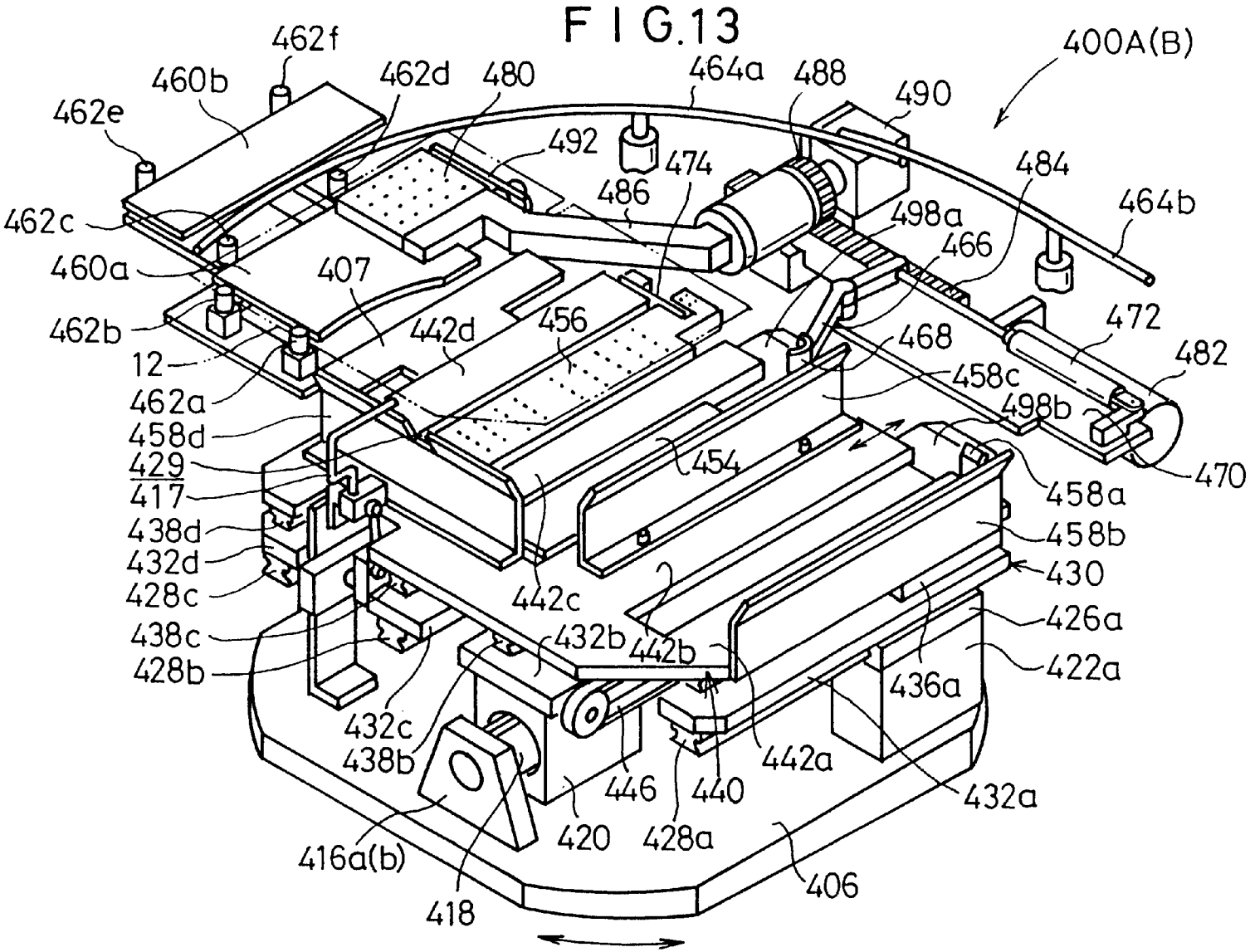
FIG. 13 is a perspective view of the pack producing apparatus.
Figure 14:
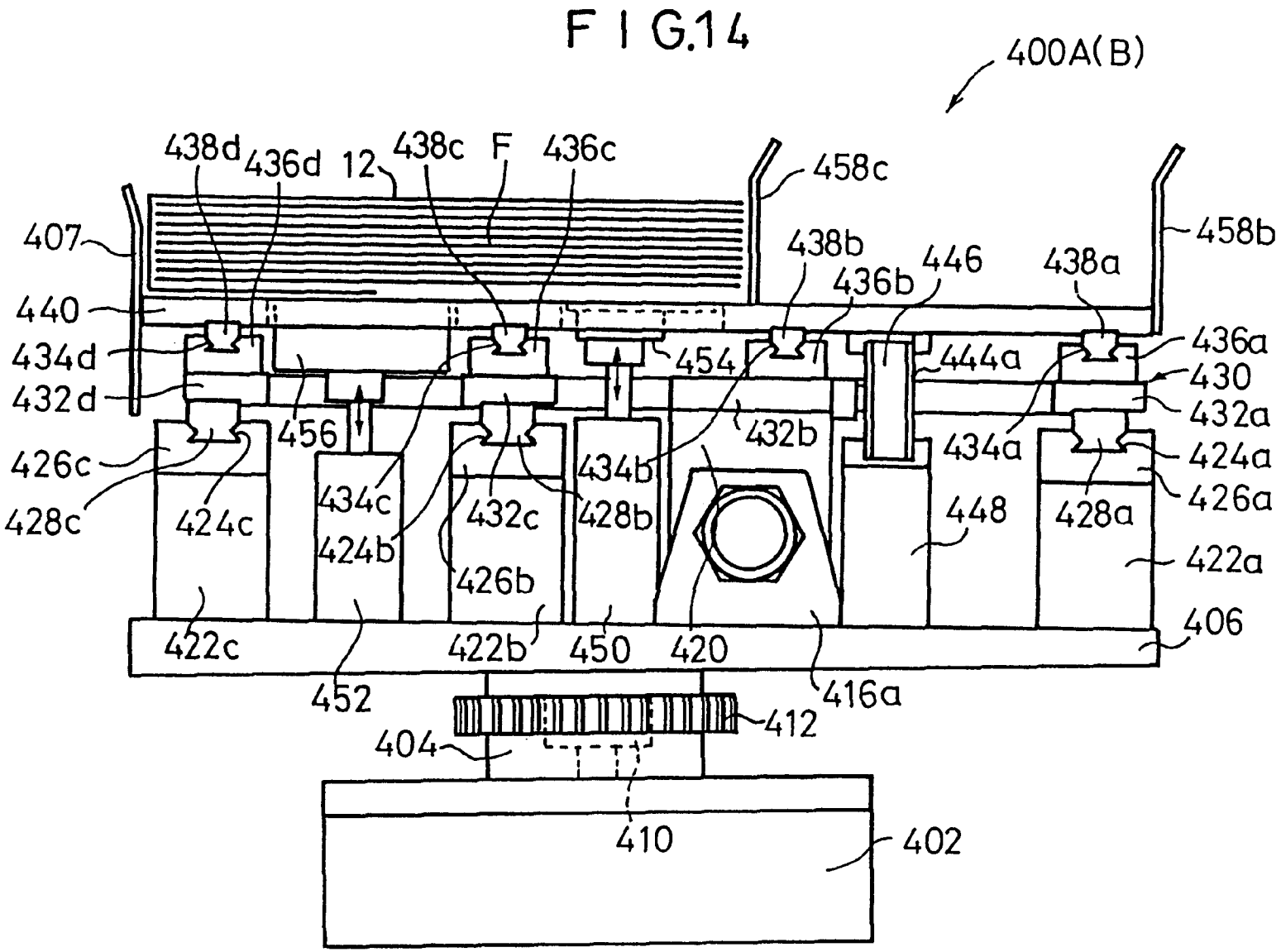
FIG. 14 is a front elevational view, partly omitted from illustration, of the pack producing apparatus.
Figure 15:
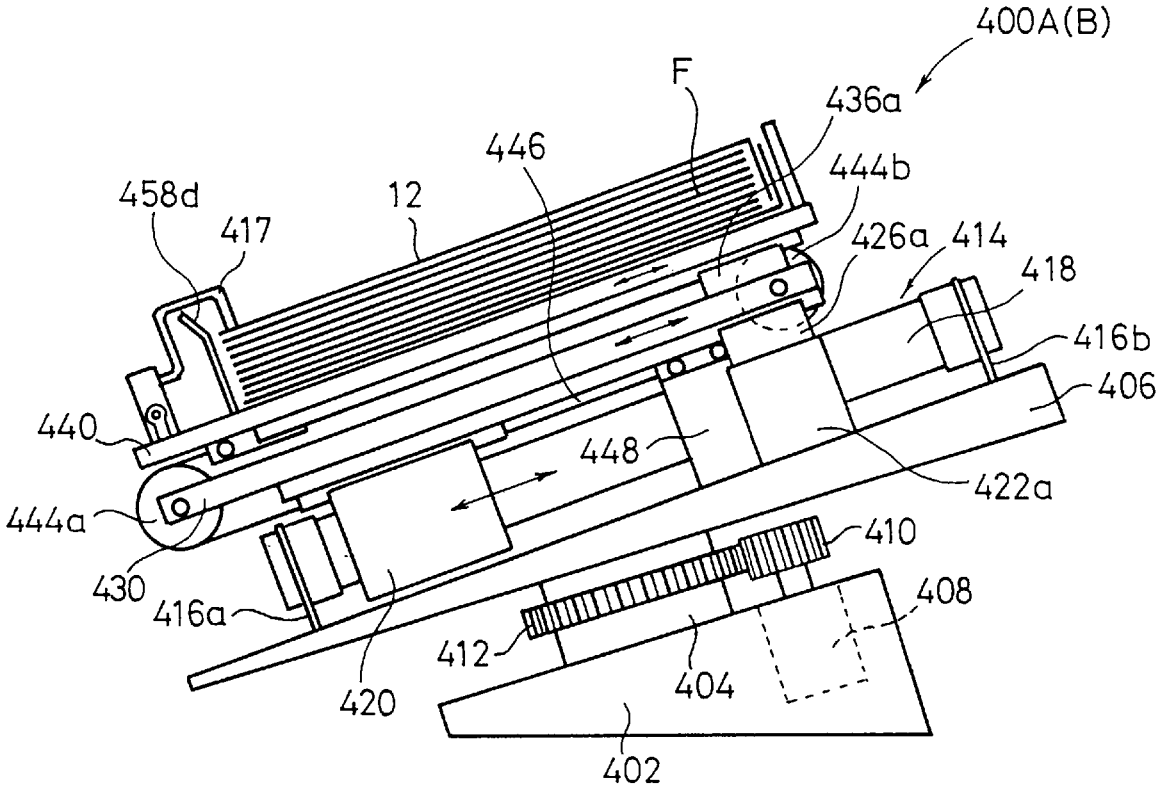
FIG. 15 is a side elevational view, partly omitted from illustration, of the pack producing apparatus.

Pack Producing Apparatus 400A, 400B (See FIGS. 13 Through 22):

As shown in FIGS. 13 and 14, each of the pack producing apparatus 400A, 400B has a turntable 406 rotatably supported on a base 402 by a support shaft 404. The base 402 houses a turntable drive motor 408 therein (see FIG. 15) having a drive shaft with a gear 410 mounted thereon. The gear 410 is held in mesh with a gear 412 disposed around the outer circumferential surface of the support shaft 404. As shown in FIG. 15, the base 402 has an upper surface slanted with respect to the pack inverting apparatus 500 located downstream thereof, for allowing films F to be stacked easily. The turntable 406 has an upper surface slightly slanted such that a side thereof for receiving a leading side of a protective cover 12 is slightly higher than an opposite side thereof.

A rodless cylinder 414 has opposite ends supported on the upper surface of the turntable 406 by respective brackets 416*a*, 416*b*. The rodless cylinder 414 comprises a tube 418 with a piston, not shown, housed therein and a displacement member 420 coupled to the piston and displaceable along the tube 418. Support bases 422*a*, 422*b*, 422*c* are mounted on the turntable 406 on opposite sides of the rodless cylinder 414, and guide members 426*a*, 426*b*, 426*c* having respective guide grooves 424*a*, 424*b*, 424*c* are disposed respectively on the support bases 422*a*, 422*b*, 422*c*. Guide rails 428*a*, 428*b*, 428*c* are slidably held respectively in the guide grooves 424*a*, 424*b*, 424*c*. A first slide table 430 is fixedly mounted on the guide rails 428*a*, 428*b*, 428*c* and the displacement member 420 of the rodless cylinder 414.

Figure 16:
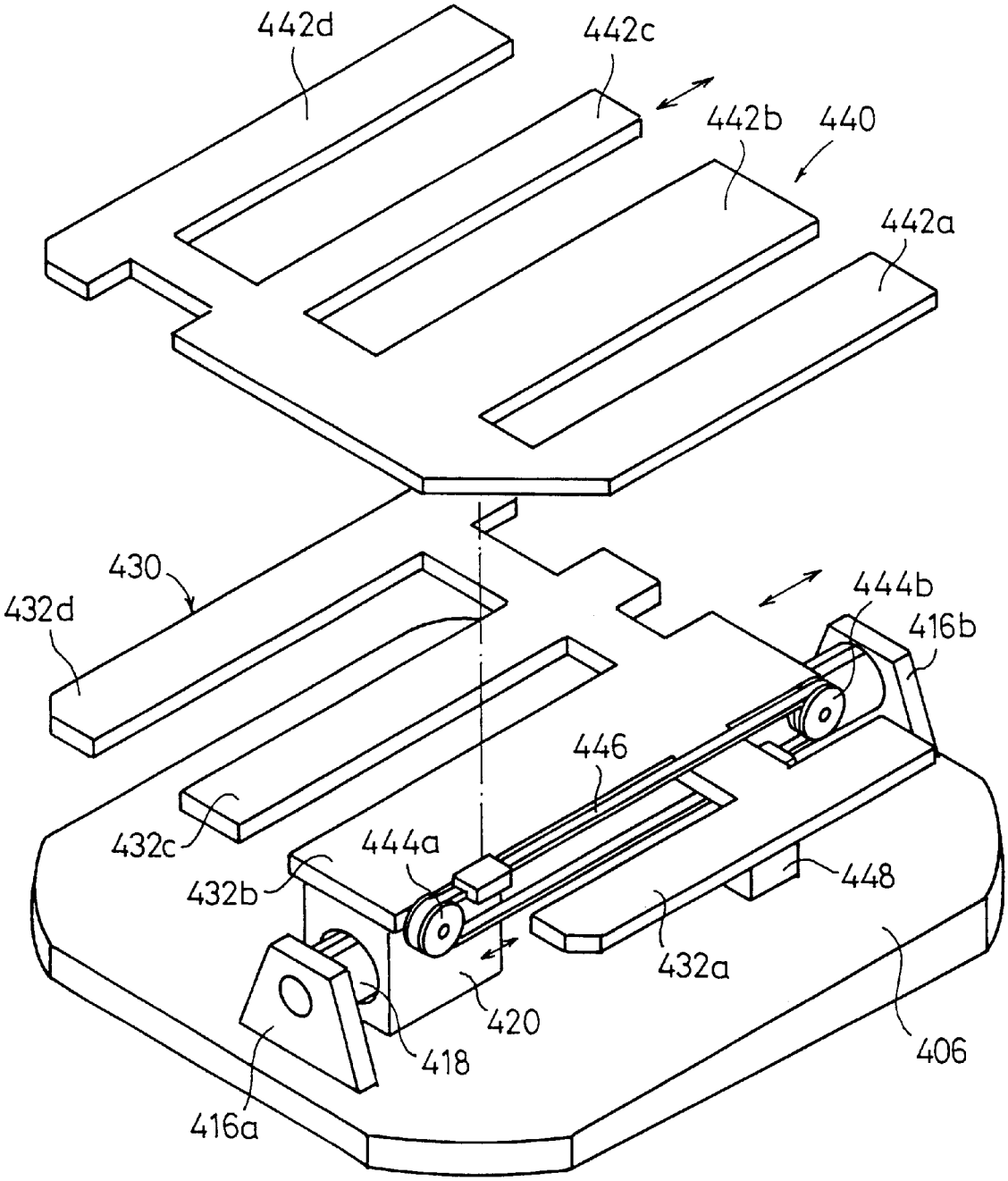
FIG. 16 is an exploded perspective view of first and second slide tables of the pack producing apparatus.

As shown in FIG. 16, the first slide table 430 is of a comb-toothed shape having four arms 432*a*, 432*b*, 432*c*, 432*d* which are fixed to the guide rail 428*a*, the displacement member 420, the guide rail 428*b*, and the guide rail 428*c*, respectively (see FIG. 14).

Guide members 436*a*, 436*b*, 436*c*, 436*d* having respective guide grooves 434*a*, 434*b*, 434*c*, 434*d* are disposed respectively on the arms 432*a*, 432*b*, 432*c*, 432*d* of the first slide table 430. Guide rails 438*a*, 438*b*, 438*c*, 438*d* are slidably held respectively in the guide grooves 434*a*, 434*b*, 434*c*, 434*d*. A second slide table 440 is fixedly mounted on the guide rails 438*a*, 438*b*, 438*c*, 438*d*.

As shown in FIG. 16, the second slide table 440 is of a comb-toothed shape having four arms 442*a*, 442*b*, 442*c*, 442*d* which are fixed to the guide rails 438*a*, 438*b*, 438*c*, 438*d*, respectively.

Figure 17:
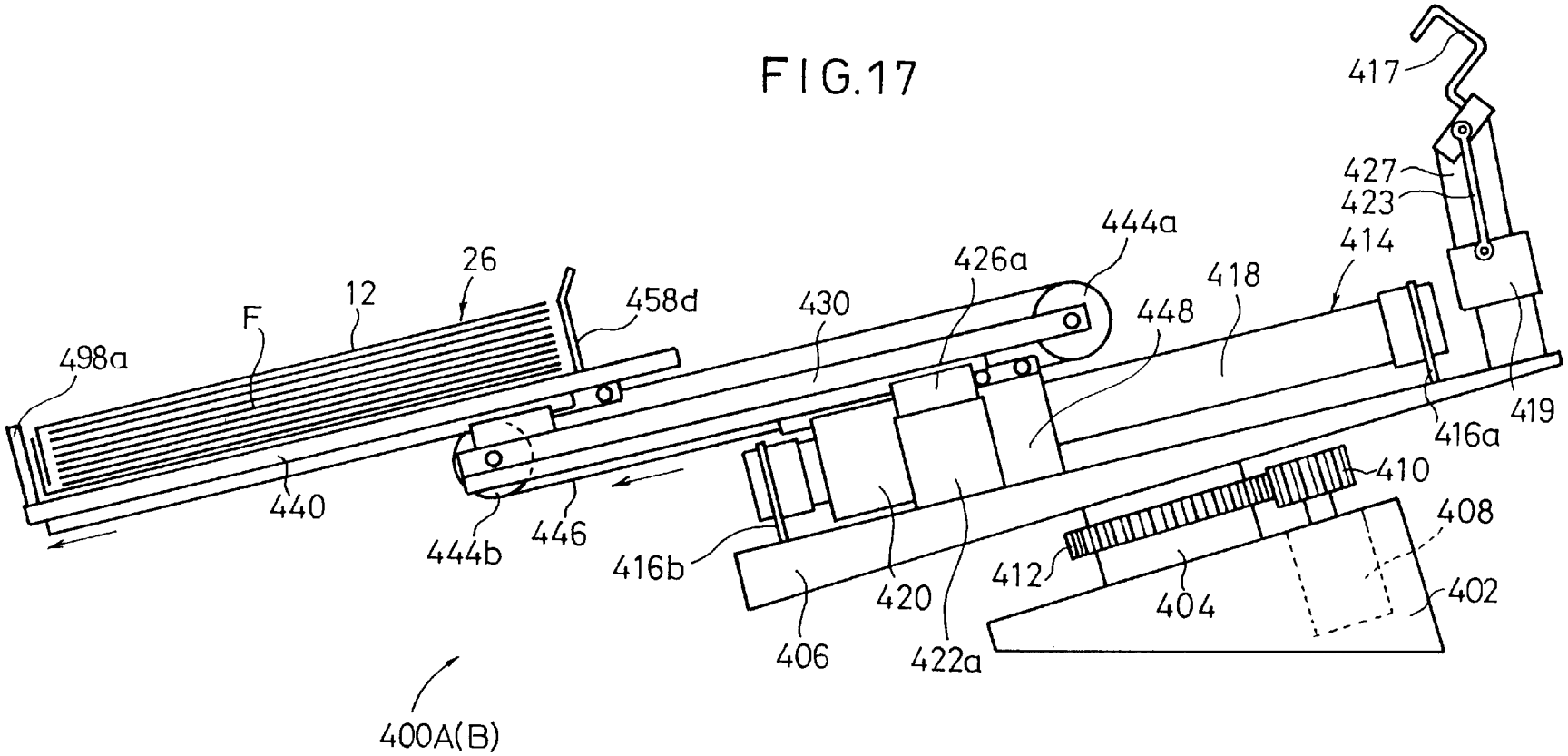
FIG. 17 is a side elevational view, partly omitted from illustration, showing the manner in which the first and second slide tables of the pack producing apparatus are displaced.

Pulleys 444*a*, 444*b* are rotatably supported on a side of the arm 432*b* of the first slide table 430, and a slide table drive belt 446 is trained around the pulleys 444*a*, 444*b*. The slide table drive belt 446 is fixed to a belt fixing base 448 disposed between the support base 422*a* on the turntable 406 and the rodless cylinder 414. The second slide table 440 is also coupled to the slide table drive belt 446. As shown in FIG. 17, the first slide table 430 is slid with respect to the turntable 406 by the rodless cylinder 414, and the second slide table 440 is slid with respect to the first slide table 430 by the slide table drive belt 446 as it is moved by the sliding movement of the first slide table 430.

As shown in FIG. 14, lifting and lowering cylinders 450, 452 are disposed on an upper surface of the turntable 406 between the rodless cylinder 414 and the support base 422*b* and between the support base 422*b* and support base 422*c*. The lifting and lowering cylinder 450 serves to move a fixed table 454 for supporting films F into and out of a gap between the arms 442*b*, 442*c* of the second slide table 440. The lifting and lowering cylinder 452 serves to move an attracting table 456 for attracting and supporting the top and side panels 16, 23 of a protective cover 12 into and out of a gap between the arms 442*c*, 442*d* of the second slide table 440.

Guide plates 458*a*, 458*b* for guiding a large-size film are vertically mounted on the arm 442*a* of the second slide table 440. A guide plate 458*c* for guiding a small-size film F is vertically mounted on the arm 442*c* of the second slide table 440. A guide plate 458*d* for guiding large- and small-size films is vertically mounted on the region of the second slide table 440 which interconnects the arms 442*c*, 442*d*. For stacking large-size films on the second slide table 440, the guide plate 458*c* for guiding a small-size film F is detached from the second slide table 440.

Each of the pack producing apparatus 400A, 400B has two guide plates 460*a*, 460*b* disposed near the arm 442*d* so as to lie flush with the second slide table 440, and positioning pins 462*a*, 462*b*, 462*c*, 462*d*, 462*e*, 462*f* disposed on sides of the guide plates 460*a*, 460*b* and between the guide plates 460*a*, 460*b*. The positioning pins 462*a*, 462*b*, 462*c*, 462*d* serve to position a side of the bottom panel 14 of a small-size protective cover 12. The positioning pins 462*a*, 462*b*, 462*e*, 462*f* serve to position a large-size protective cover. The positioning pins 462*c*, 462*d* are retractable downwardly when a large-size protective cover is to be processed. Between the guide plates 460*a*, 460*b*, there are disposed two arcuate guide rails 464*a*, 464*b* for supporting the lower surface of a large-size protective cover when it is to be processed.

A side panel holder guide 466 for holding an end of the side panel 23 of a protective cover 12 is disposed near the tip end of the arm 442*c* of the second slide table 440. The side panel holder guide 466 has an engaging finger 468 on an end thereof for engaging the side panel 23 and is pivotally supported at its intermediate portion on a support plate 470. The side panel holder guide 466 has an opposite end coupled to a guide drive cylinder 472 mounted on the support plate 470. The side panel holder guide 466 is angularly movable about its intermediate portion by the guide drive cylinder 472 for moving the engaging finger 468 toward and away from the side panel 23.

Figure 18:
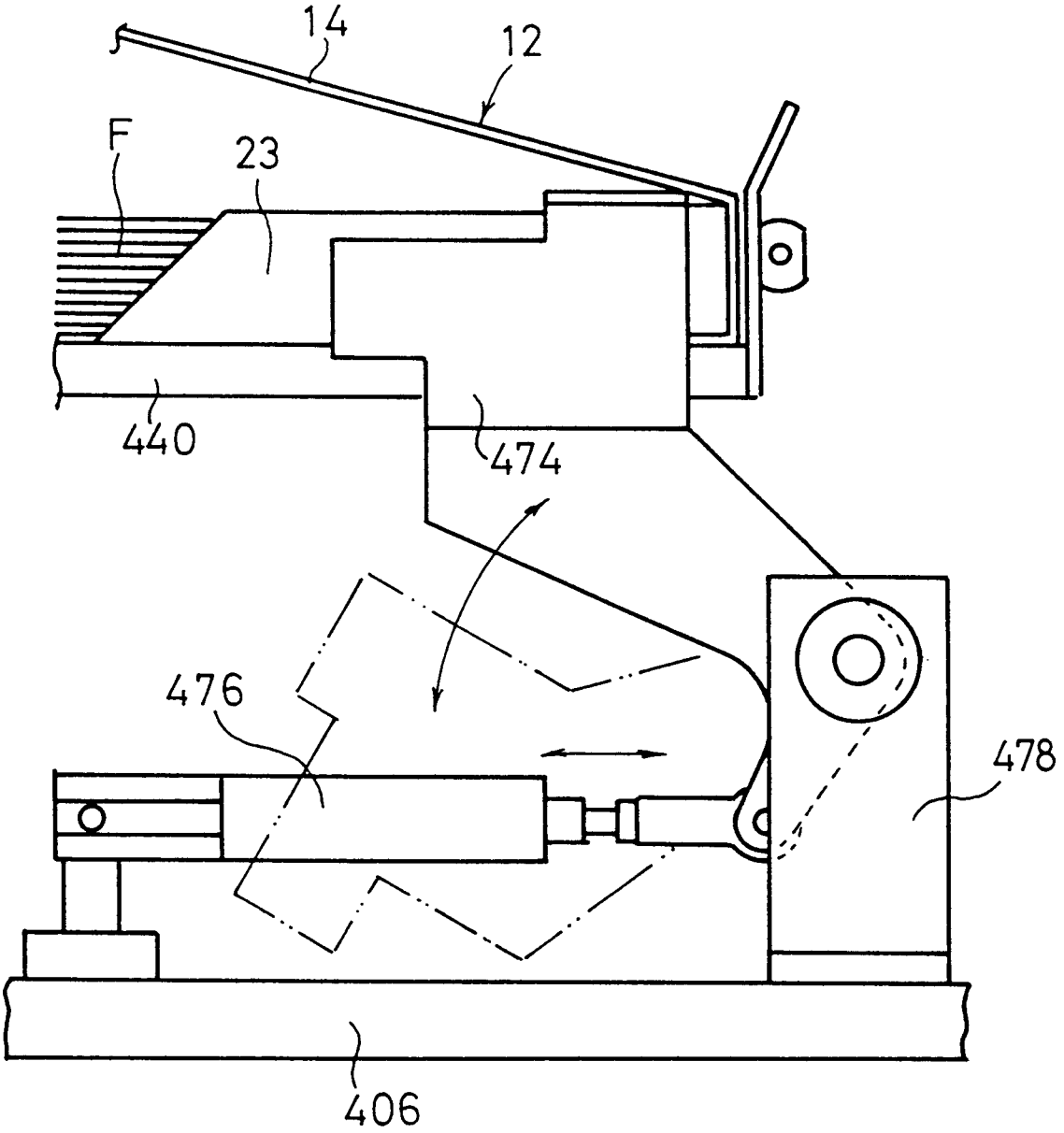
FIG. 18 is an elevational view of a raising guide of the pack producing apparatus.

A raising guide 474 for raising the side panel 23 of a protective cover 12 is disposed near distal ends of the arm 442*d* of the second slide table 440 and the attracting table 456. As shown in FIG. 18, the raising guide 474 has an end coupled to a guide drive cylinder 476 mounted on the turntable 406, a central portion pivotally supported on a bracket 478 on the turntable 406, and an opposite end that can project upwardly from a side of the second side table 440.

An attracting table turning cylinder 482 for turning an attracting table 480 which attracts and holds the bottom panel 14 of a protective cover 12 is disposed on a side of the guide drive cylinder 472 which drives the side panel holder guide 466. To the attracting table turning cylinder 482, there is coupled a rack 484 held in mesh with a pinion 488 mounted on an arm 486. The arm 486 has an end rotatably supported by a bearing 490 mounted on the support plate 470 and an opposite end to which the attracting table 480 is joined. The attracting table 480 is disposed on a side of the guide plate 460*a*. When the attracting table turning cylinder 482 is actuated, the attracting table 480 is turned around the bearing 490 for folding the bottom panel 14 of a protective cover 12.

Figure 19:
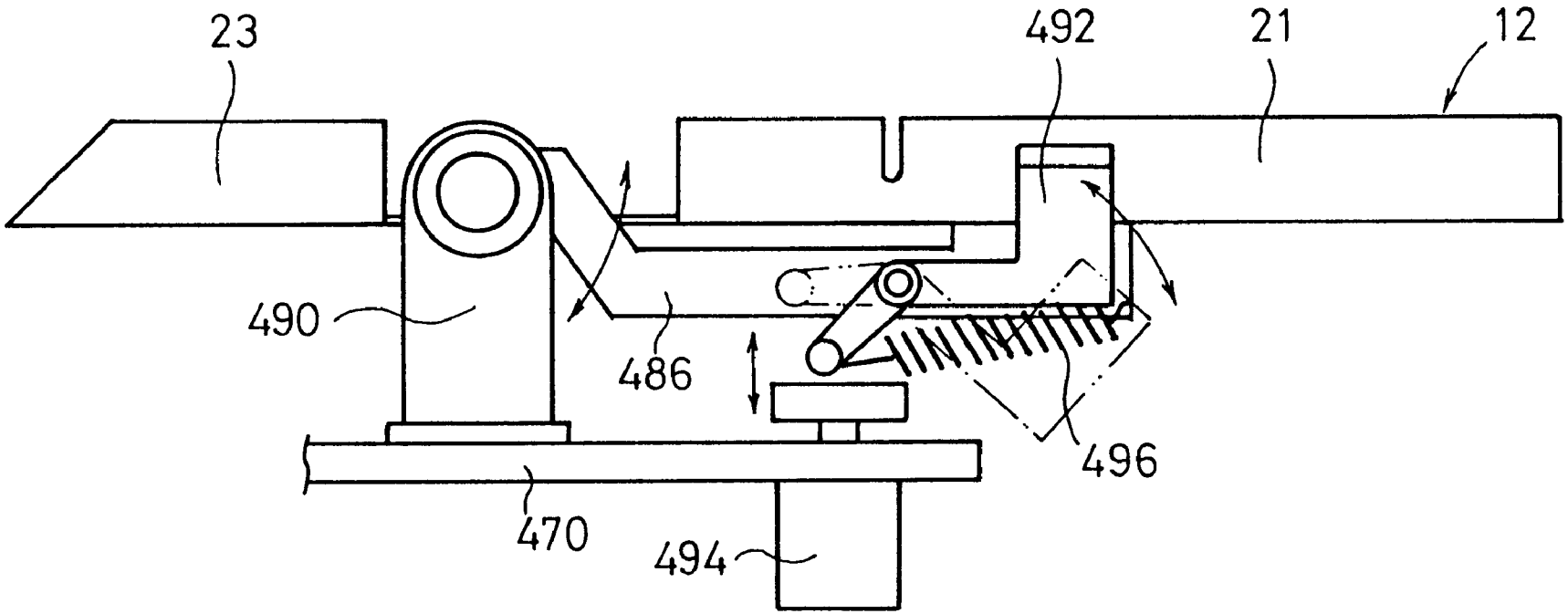
FIG. 19 is an elevational view of another raising guide of the pack producing apparatus.

A raising guide 492 for raising the side panel 21 of a protective cover 12 is disposed on a side of the attracting table 480. As shown in FIG. 19, the raising guide 492 has an end held in abutment against a guide drive cylinder 494 mounted on the support plate 470 and a central portion pivotally supported on the arm 486. A spring 496 for normally biasing the raising guide 492 upwardly is connected between the end of the raising guide 492 and the end of the arm 486. When the guide drive cylinder 494 is displaced upwardly while the attracting table 480 is lying horizontally, the other end of the raising guide 492 is retracted downwardly of the second slide table 440.

Figure 20:
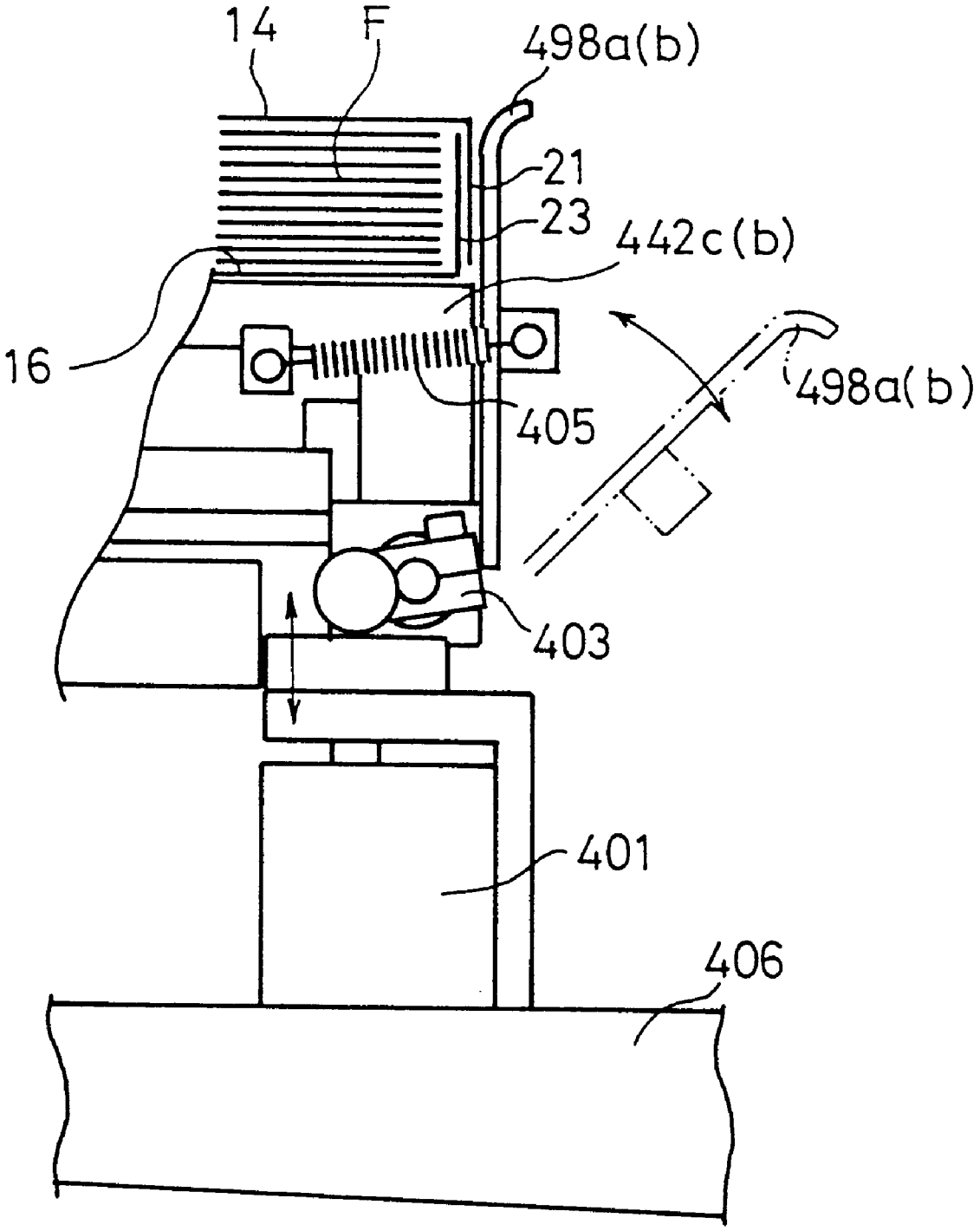
FIG. 20 is an elevational view of pack holders of the pack producing apparatus.

As shown in FIG. 20, pack holders 498*a*, 498*b* for holding the folded side panels 21, 23 of the bottom panel 14 of a pack 26 are disposed near the tip ends of the arms 442*b*, 442*c*, respectively, of the second slide table 440. The pack holder 498*a* serves to hold both large- and small-size packs 26, and the pack holder 498*b* serves to hold a large-size pack 26. The pack holders 498*a*, 498*b* have ends coupled to an end of a link 403 whose other end is displaceable by a holder drive cylinder 401 fixedly mounted on the turntable 406. The link 403 has a central portion pivotally supported on the second slide table 440. The arms 442*b*, 442*c* of the second slide table 440 and the pack holders 498*a*, 498*b* are coupled to each other by springs 405. When the holder drive cylinder 401 is displaced upwardly, the link 403 is angularly moved to turn the pack holders 498*a*, 498*b* downwardly of the second slide table 440 against the bias of the spring 405.

Figure 21:
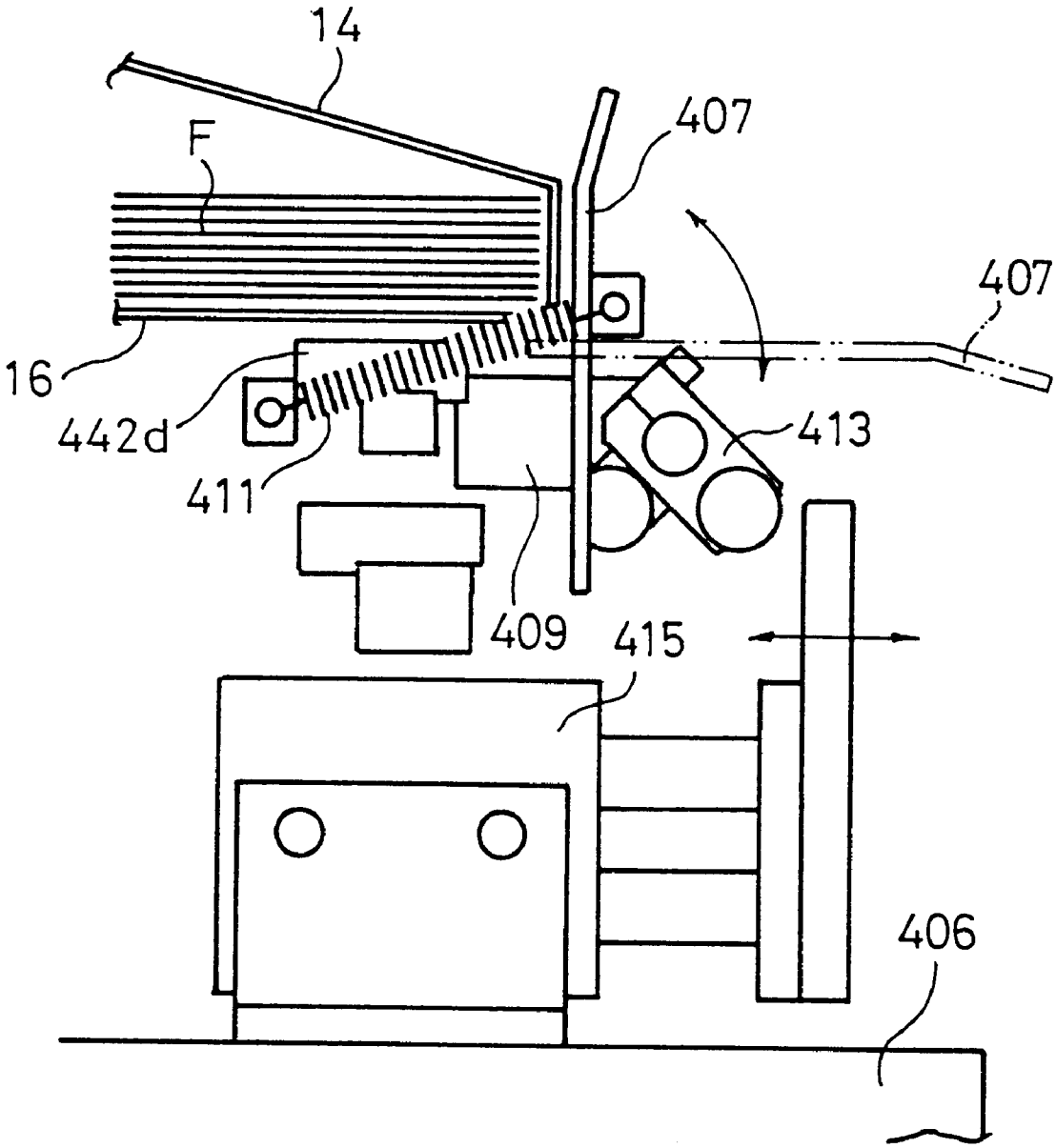
FIG. 21 is an elevational view of a folding guide of the pack producing apparatus.

A folding guide 407 for holding a side of a protective cover 12 folded by the attracting table 480 is disposed on a side of the arm 442*d* of the second slide table 440. As shown in FIG. 21, the folding guide 407 is pivotally supported on the side of the arm 442*d* by a bracket 409 and normally biased to an upright position by a spring 411 connected to the arm 442*d*. A link 413 has an end coupled to the folding guide 407 and an opposite end coupled to a guide drive cylinder 415 that is fixedly mounted on the turntable 406. When the guide drive cylinder 415 is displaced horizontally, it causes the link 413 to turn the folding guide 407.

Figure 22:
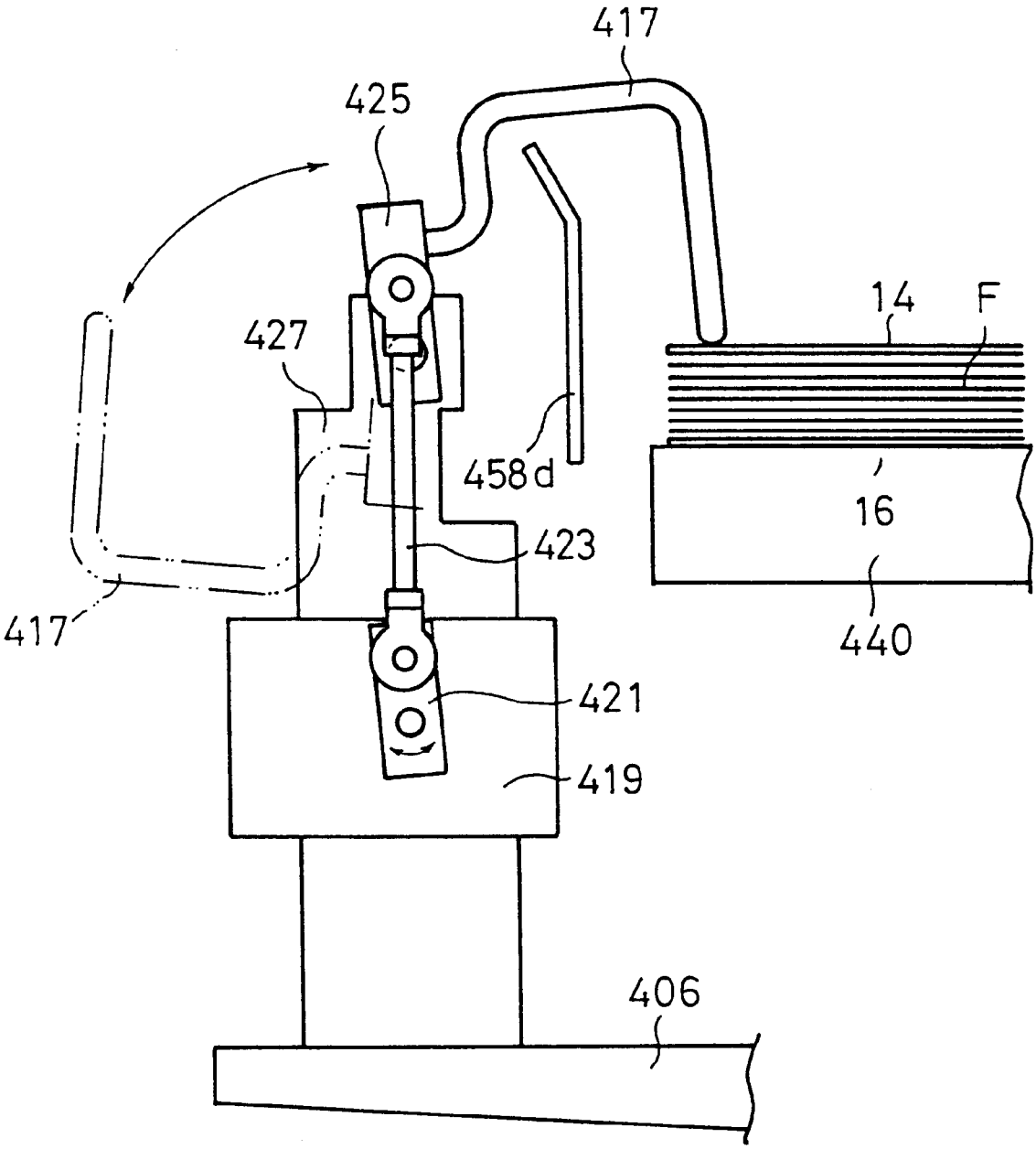
FIG. 22 is an elevational view of a protective cover holder of the pack producing apparatus.

A protective cover holder 417 is disposed across the second slide table 440 from the pack holders 498*a*, 498*b*. As shown in FIG. 22, the protective cover holder 417 is coupled by a link 425 to an end of a connecting rod 423 whose opposite end is coupled by a link 421 to a rotary actuator 419 that is fixedly mounted on the turntable 406. The protective cover holder 417 is of a bent shape for holding the bottom panel 14 of a protective cover 12 through a groove 429 defined centrally in the guide plate 458*d*. When the rotary actuator 419 is actuated, it turns the link 421 to cause the connecting rod 423 and the link 425 to turn the protective cover holder 417 for bringing its distal end into abutment against the bottom panel 14 of a protective cover 12.

Figure 23:
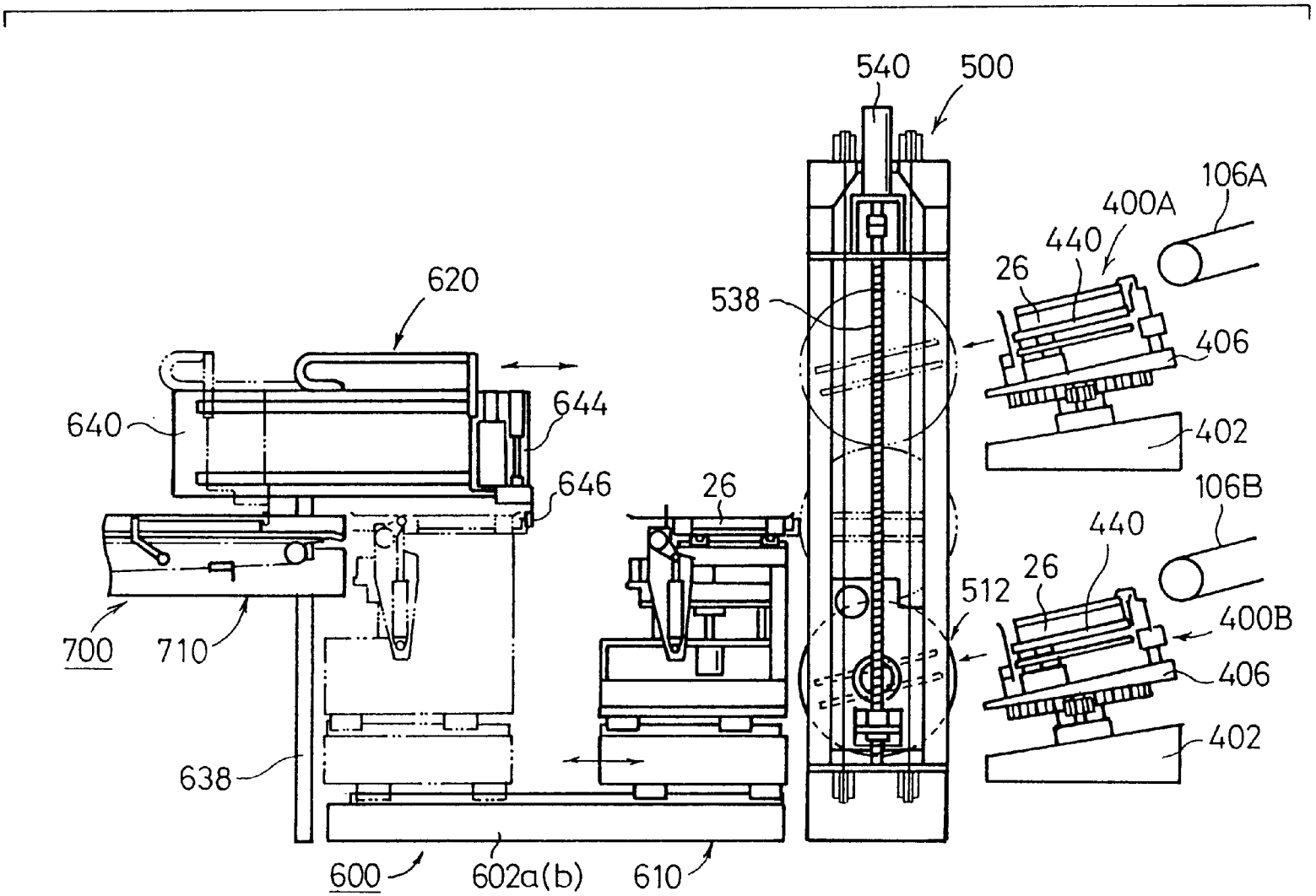
FIG. 23 is a view showing the layout of the pack producing apparatus, a pack inverting apparatus, and a pack feeding apparatus.
Figure 24:
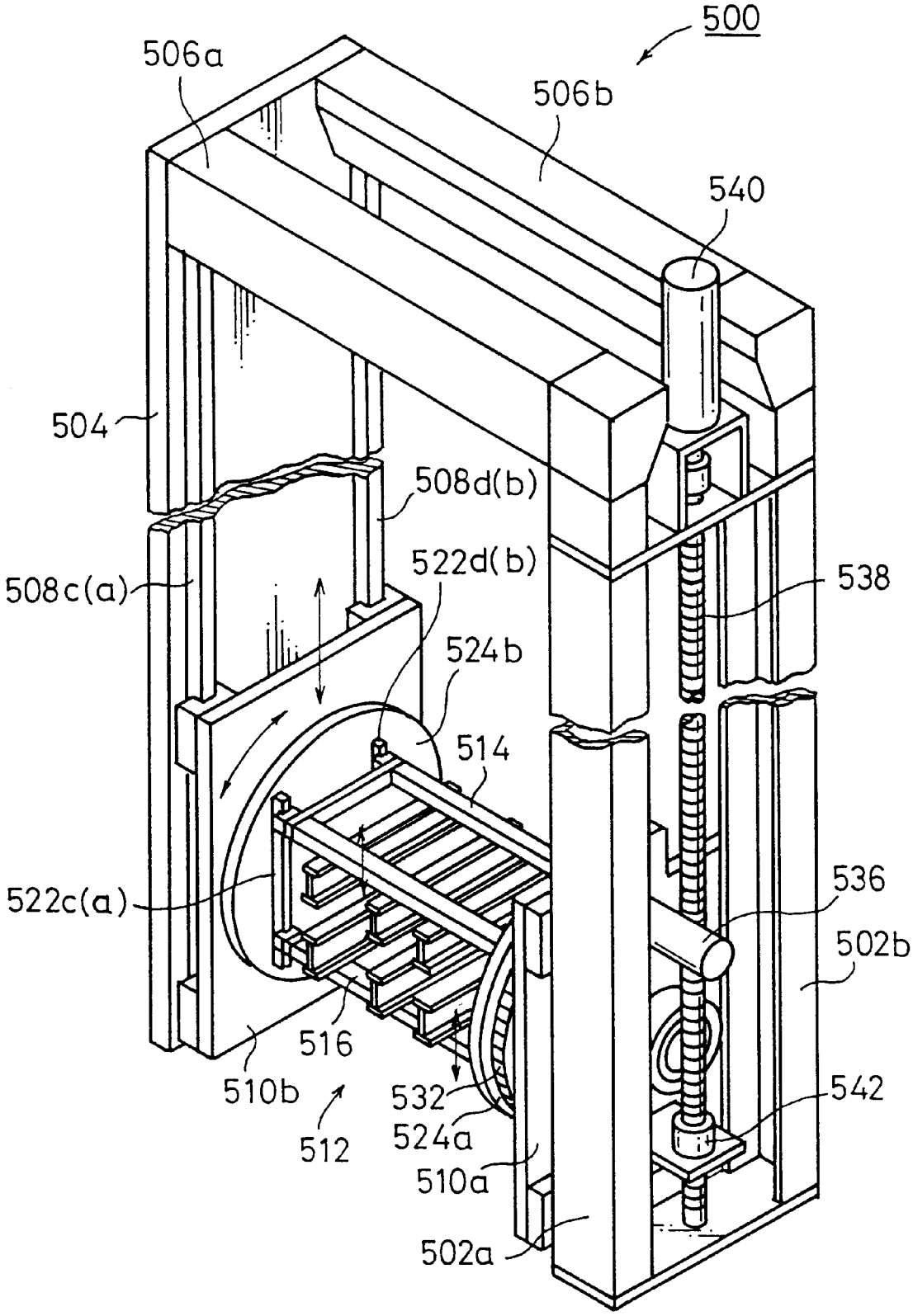
FIG. 24 is a perspective view of the pack inverting apparatus.

Pack Inverting Apparatus 500 (See FIGS. 23 Through 25):

As shown in FIG. 23, the pack inverting apparatus 500 is disposed between the pack producing apparatus 400A, 400B and the pack feeding apparatus 600. As shown in FIG. 24, the pack inverting apparatus 500 comprises a pair of support posts 502*a*, 502*b*, a side plate 504 spaced from and confronting the support posts 502*a*, 502*b*, and a pair of beams 506*a*, 506*b* mounted on and extending between upper ends of the support posts 502*a*, 502*b* and the side plate 504. Vertical guide rails 508*a*, 508*b*, 508*c*, 508*d* are mounted on confronting surfaces of the support posts 502*a*, 502*b* and the side plate 504.

Figure 25:
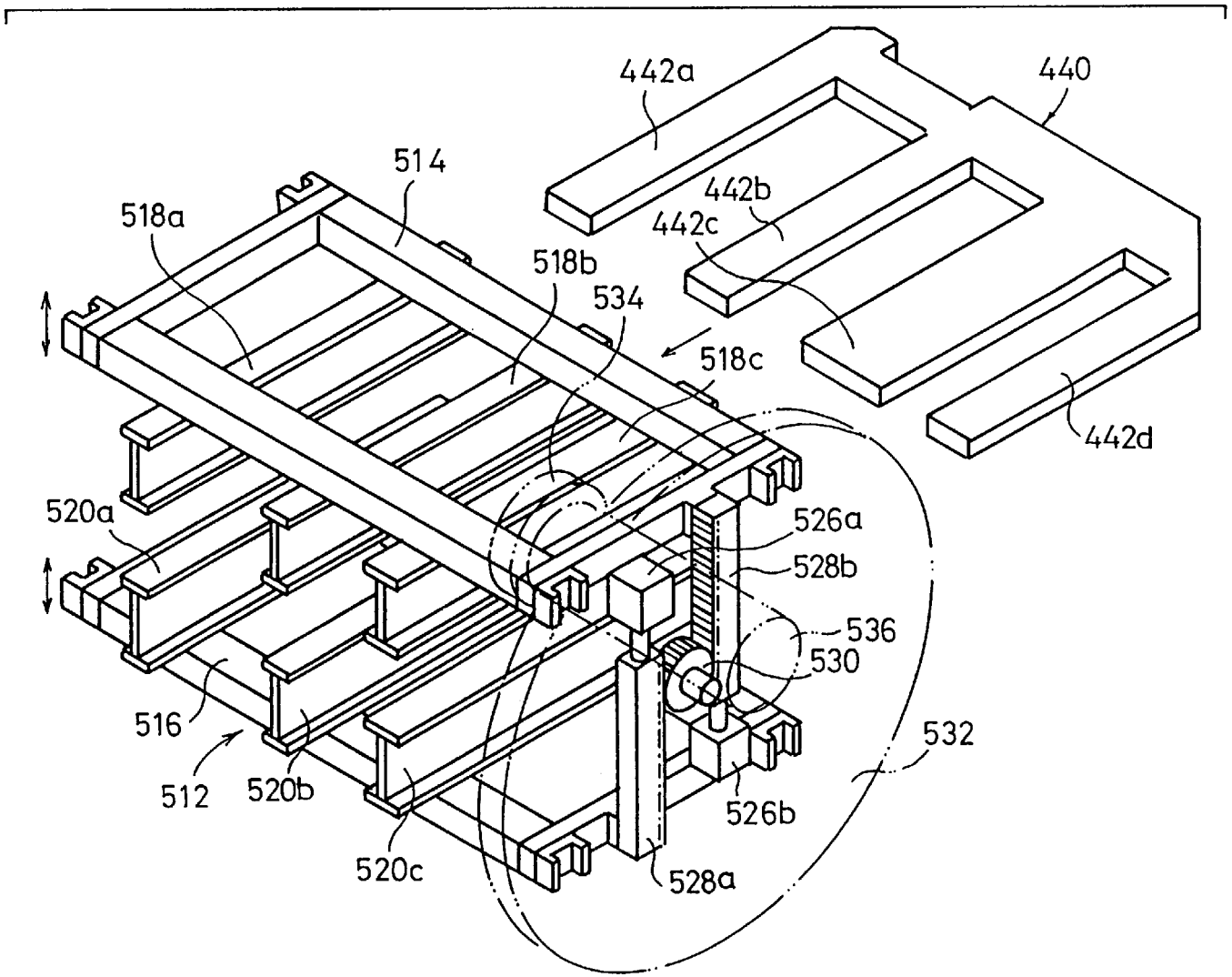
FIG. 25 is a perspective view of an inverting mechanism of the pack inverting apparatus.

Tables 510*a*, 510*b* are vertically displaceably held in engagement with the guide rails 508*a*, 508*b*, 508*c*, 508*d*, and an inverting mechanism 512 is disposed between and supported on the tables 510*a*, 510*b*. As shown in FIG. 25, the inverting mechanism 512 has an upper frame 514 and a lower frame 516 and support bars 518*a*, 518*b*, 518*c* and 520*a*, 520*b*, 520*c* mounted on the upper and lower frames 514, 516 for sandwiching a pack 26. The support bars 518*a*, 518*b*, 518*c* and 520*a*, 520*b*, 520*c* are spaced at intervals corresponding to the gaps between the arms 442*a*, 442*b*, 442*c*, 442*d* of the second slide table 440 of each of the pack producing apparatus 400A, 400B. When a pack 26 is transferred, the arms 442*a*, 442*b*, 442*c*, 442*d* of the second slide table 440 are inverted between the support bars 518*a*, 518*b*, 518*c* and 520*a*, 520*b*, 520*c*.

The upper and lower frames 514, 516 have opposite sides vertically displaceably held in engagement with guide rails 522*a*, 522*b*, 522*c*, 522*d* mounted on disks 524*a*, 524*b*. The upper and lower frames 514, 516 are interconnected by two parallel racks 528*a*, 528*b* whose ends are connected to respective frame opening and closing cylinders 526*a*, 526*b*. The upper and lower frames 514, 516 can be moved toward and away from each other by the frame opening and closing cylinders 526*a*, 526*b*. A synchronizing gear 530 is held in mesh with the racks 528*a*, 528*b* for synchronizing the displacement of the upper and lower frames 514, 516.

The disks 524*a*, 524*b* are rotatably supported on the respective tables 510*a*, 510*b*. A larger gear 532 is disposed between the disk 524*a* and the table 510*a*, and a smaller gear 534 is held in mesh with the larger gear 532. The smaller gear 534 is coupled to a frame inverting motor 536 mounted on the table 510*a*. When the frame inverting motor 536 is energized, the smaller gear 534 and the larger gear 532 are rotated to rotate the upper and lower frames 514, 516.

A ball screw 538 extends vertically between the support posts 502*a*, 502*b*, and has an upper end connected to an inverting mechanism displacing motor 540. A nut 542 is threaded over the ball screw 538 and fixed to the table 510*a*. When the inverting mechanism displacing motor 540 is energized, the ball screw 538 is rotated about its own axis to cause the nut 542 to displace the inverting mechanism 512 vertically.

Figure 26:
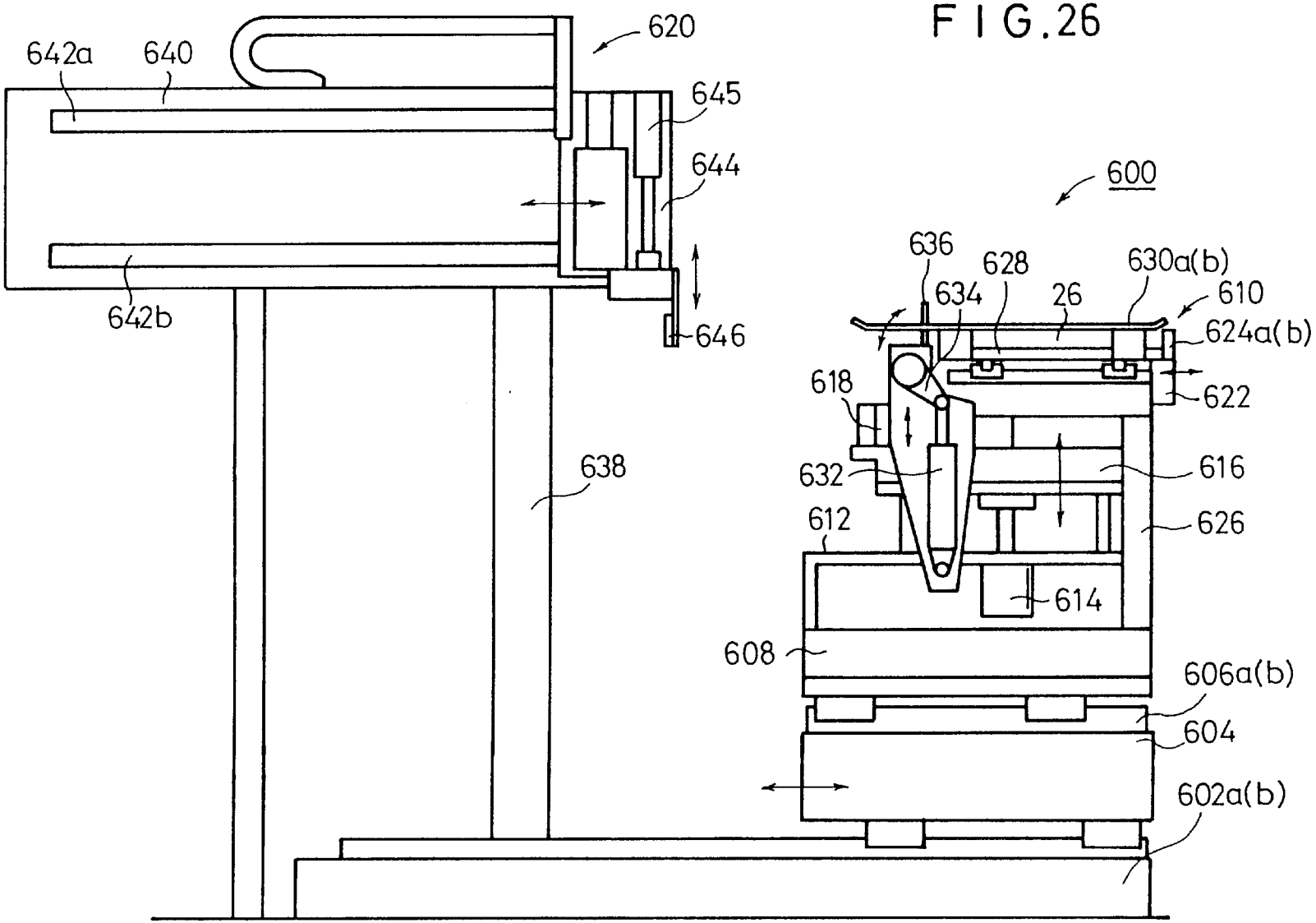
FIG. 26 is a side elevational view of a pack carriage and a pack delivery machine of the pack inverting apparatus.

Pack Feeding Apparatus 600 (See FIGS. 23 and 26):

As shown in FIG. 26, the pack feeding apparatus 600 has the pack carriage 610 and the pack delivery machine 620. The pack carriage 610 feeds a pack 26 from the pack inverting apparatus 500 to the pack delivery machine 620. The pack delivery machine 620 delivers a pack 26 placed on the pack carriage 610 to the pack feeder 710 of the package producing apparatus 700.

Guide rails 602*a*, 602*b* are laid between the pack inverting apparatus 500 and the package producing apparatus 700. The pack carriage 610 can move on and along the guide rails 602*a*, 602*b*. The pack carriage 610 comprises a first base 604 movably mounted on the guide rails 602*a*, 602*b*, a second base 608 mounted on the first base 604 by guide rails 606*a*, 606*b*, a lifting and lowering cylinder 614 fixedly mounted on the second base 608 by a bracket 612, a lifting and lowering table 616 mounted on the bracket 612 and vertically movable by the lifting and lowering cylinder 614, a displacing cylinder 618 fixedly mounted on the lifting and lowering table 616, and a pack remover 622 that is horizontally displaceable by the displacing cylinder 618. The pack remover 622 has a pair of fingers 624*a*, 424*b* for engaging a pack 26 held by the inverting mechanism 512 of the pack inverting apparatus 500. The pack remover 622 is vertically movable by the lifting and lowering cylinder 614 and horizontally displaceable by the displacing cylinder 618.

A pack drawing arm 628 is disposed above the pack remover 622 by a bracket 626 that is fixedly mounted on the second base 608. The pack drawing arm 628 supports thereon pack holder plates 630*a*, 630*b* for holding an upper surface of a pack 26 that is held between the pack drawing arm 628 and the pack holder plates 630*a*, 630*b*. A gate opening and closing cylinder 632 is disposed on a side of the bracket 612. A gate plate 636 is connected to the gate opening and closing cylinder 632 by a link 634. A pack 26 is placed on the pack drawing arm 628 and locked in position against horizontal movement by the fingers 624*a*, 624*b* and the gate plate 636.

The pack delivery machine 620 has a support post 638 and a main block 640 disposed on the support post 638, and is disposed on one side of the package producing apparatus 700. The main block 640 has a pair of guide rails 642*a*, 642*b* disposed on a side wall thereof, and a self-propelled unit 644 displaceably mounted on the guide rails 642*a*, 642*b*. The self-propelled unit 644 has a pack remover 646 projecting downwardly and vertically movable by a displacing cylinder 645. The pack remover 646 can move into a gap between the pack holder plates 630*a*, 630*b* of the pack carriage 610, removes a pack 26 between the fingers 624*a*, 624*b*, and delivers the removed pack 26 to the pack feeder 710.

Figure 27:
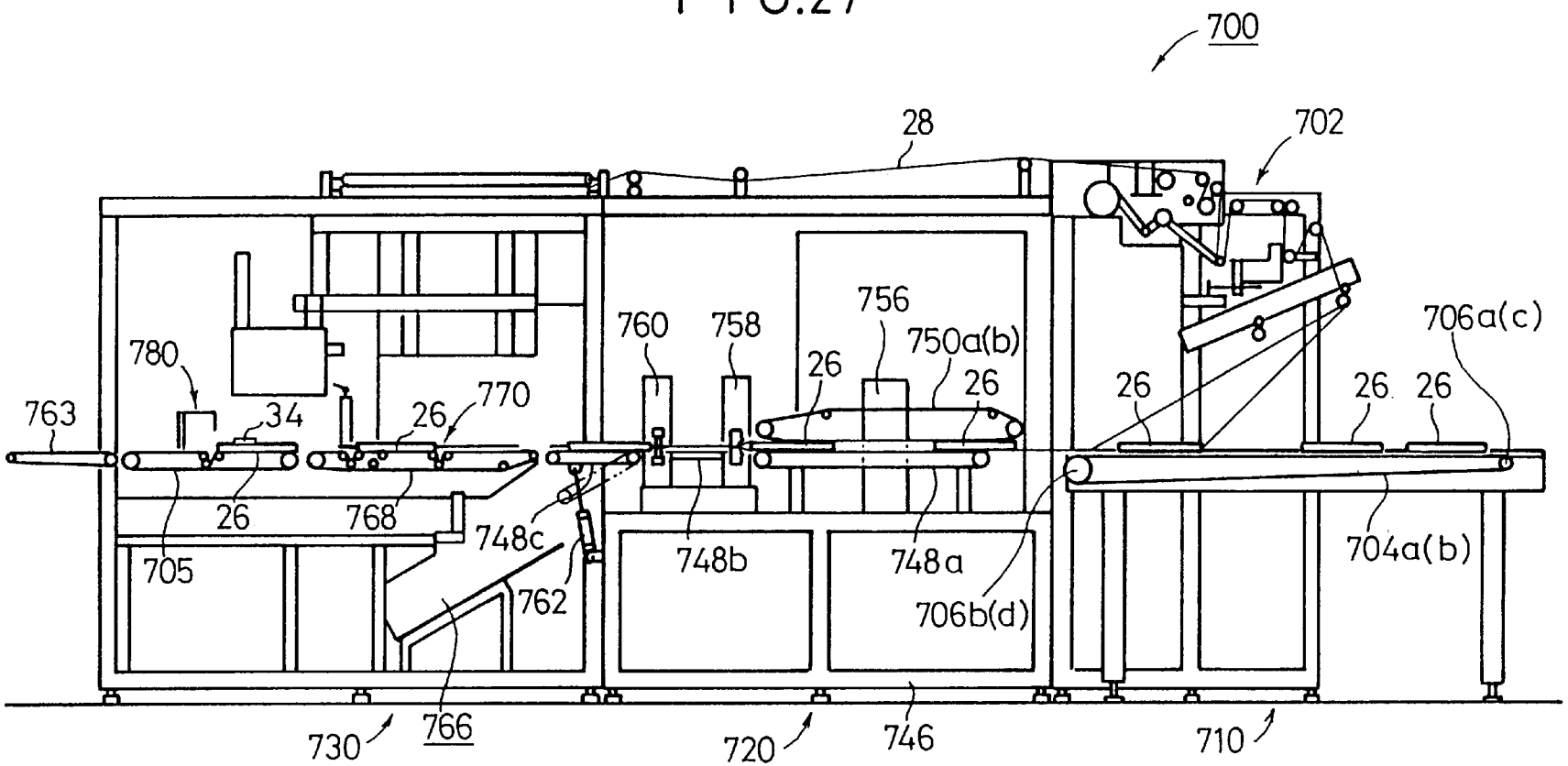
FIG. 27 is a side elevational view of a package producing apparatus.

Package Producing Apparatus 700 (See FIGS. 27 Through 35):

In FIG. 27, the package producing apparatus 700 has the pack feeder 710, the pack inserter 720, and the film package producer 730. A light-shielding bag supply mechanism 702 for supplying light-shielding bags 28 is disposed above the package producing apparatus 700.

Figure 28:
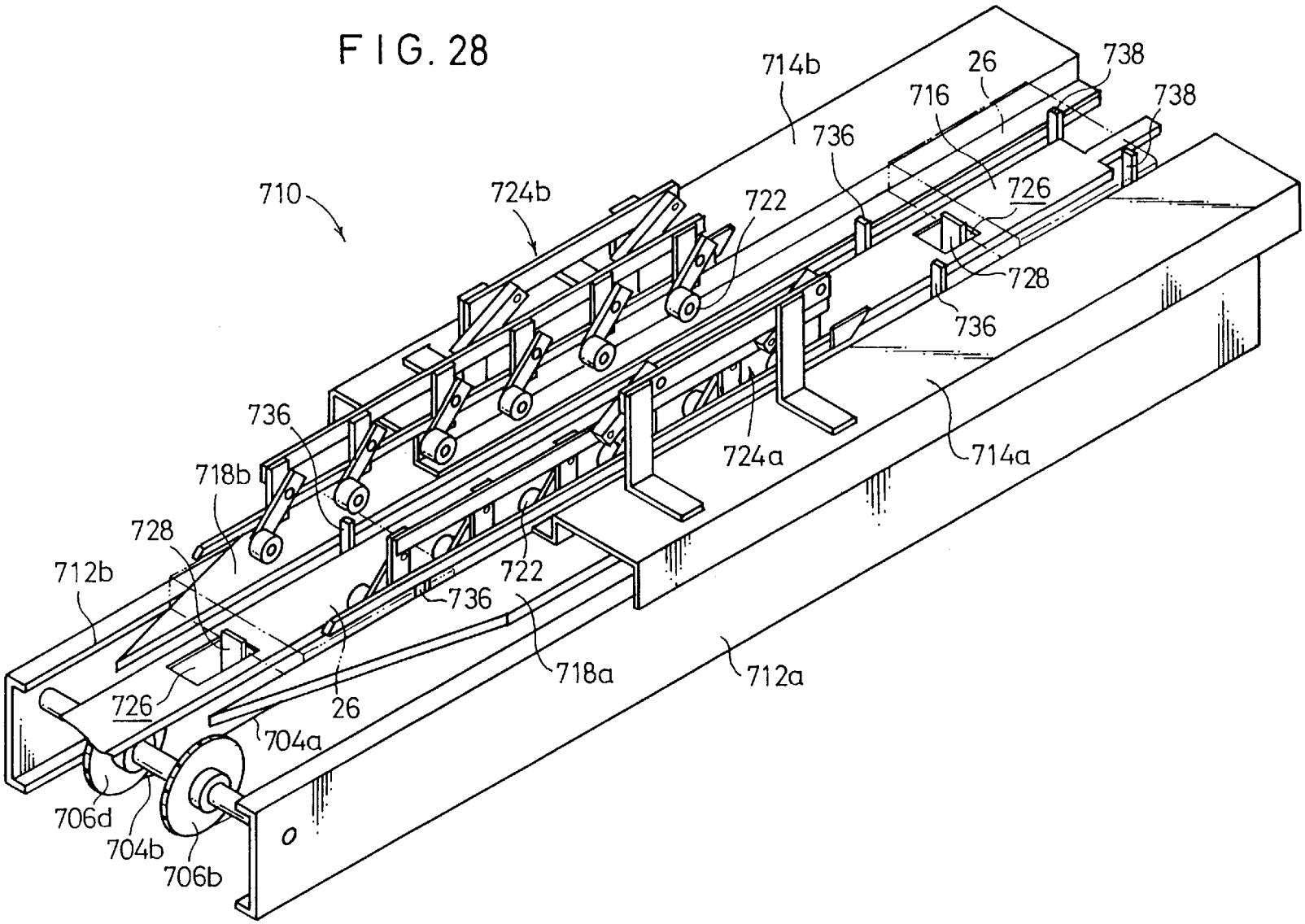
FIG. 28 is a perspective view of a pack feeder of the package producing apparatus.
Figure 29:
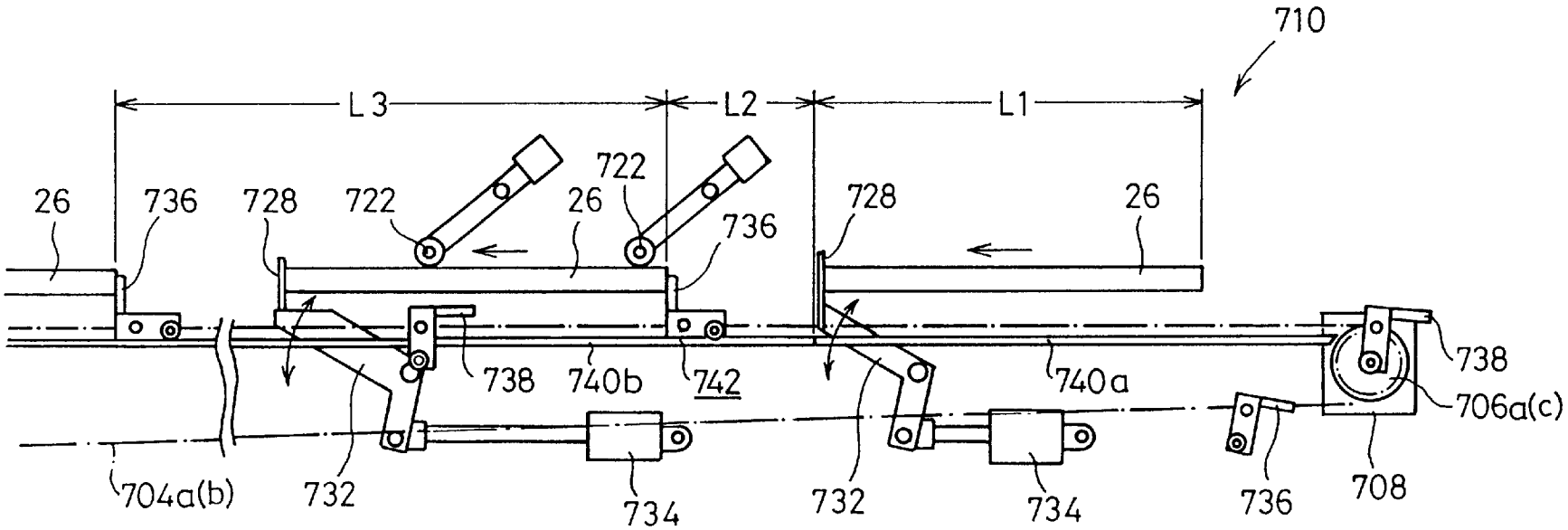
FIG. 29 is a side elevational view of the pack feeder of the package producing apparatus.

The pack feeder 710 has two chain belts 704*a*, 704*b* for feeding a pack 26 supplied from the pack feeding apparatus 600 to a pack inserter 720. As shown in FIGS. 28 and 29, the chain belts 704*a*, 704*b* are trained around sprockets 706*a*, 706*b*, 706*c*, 706*d* and driven by a chain drive motor 708. The sprockets 706*a*, 706*b*, 706*c*, 706*d* are rotatably supported on side plates 712*a*, 712*b* on which there are mounted guide plates 714*a*, 714*b* for positioning a pack 26 in directions perpendicular to the direction in which the pack 26 is fed. A support plate 716 for supporting a pack 26 is disposed between the guide plates 714*a*, 714*b*. Light-shielding bag guide plates 718*a*, 718*b* that are tapered in the direction in which the pack 26 is fed are disposed one on each side of the support plate 716 and beneath the guide plates 714*a*, 714*b*. A light-shielding bag 28 supplied from the light-shielding bag supply mechanism 702 above the package producing apparatus 700 is shaped by a package producer, not shown, and drawn below the light-shielding bag guide plates 718*a*, 718*b* in surrounding relationship to a pack 26 (see FIG. 32). Pack presser mechanisms 724*a*, 724*b* having a plurality of rollers 722 for pressing a pack 26 downwardly are disposed above the guide plates 714*a*, 714*b*.

The support plate 716 has a plurality of holes 726 defined therein at spaced intervals. Positioning plates 728 disposed between the side plates 712*a*, 712*b* project upwardly in the holes 726. The positioning plates 728 serve to position respective packs 26 in the pack feeder 710. The positioning plates 728 are movable into and out of the holes 726 by positioning plate drive cylinders 734 through links 732 in synchronism with operation of the chain belts 704*a*, 704*b*.

Figure 30:
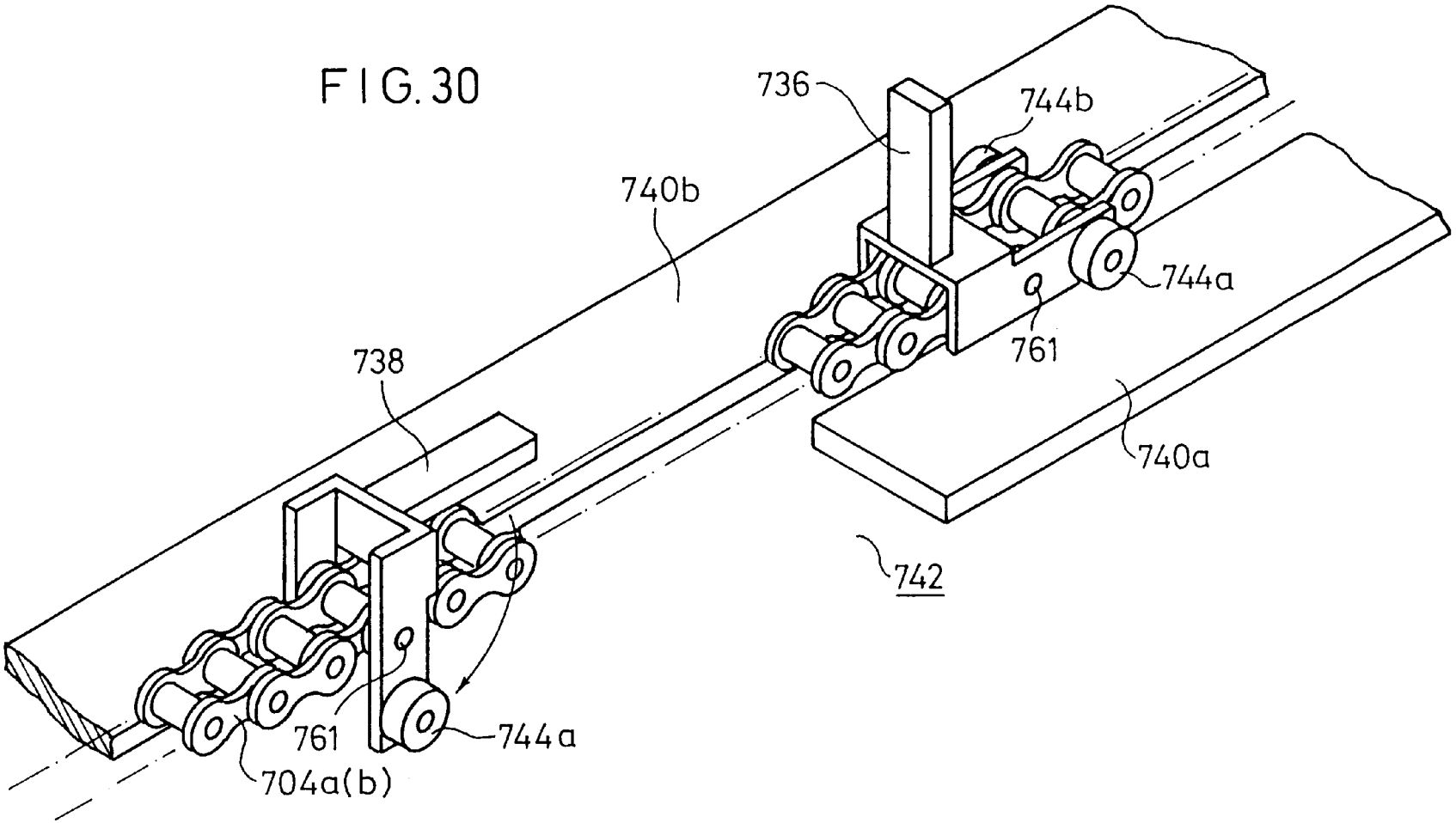
FIG. 30 is an enlarged fragmentary perspective view of the pack feeder of the package producing apparatus.

As shown in FIGS. 29 and 30, each of the chain belts 704*a*, 704*b* has a plurality of alternately positioned fixed and movable fingers 736, 738 spaced at predetermined intervals. Guide plates 740*a*, 740*b* are disposed underneath each of the chain belts 704*a*, 704*b*. The guide plate 740*a* has a recess 742 of predetermined size defined therein.

The fixed fingers 736 are pivotally supported on the chain belts 704*a*, 704*b* by pivot shafts 761. Rollers 744*a*, 744*b* that can roll on and along upper surfaces of the guide plates 740*a*, 740*b* are mounted on respective opposite sides of the fixed fingers 736. The fixed fingers 736 project upwardly through gaps between the support plate 716 and the light-shielding bag guide plates 718*a*, 718*b* in the range of the guide plate 740*b*. Adjacent ones of the fixed fingers 736 are spaced from each other by a distance L3 which is equal to the length of the light-shielding bag 28 of a film package W.

The movable fingers 738 are pivotally supported on the chain belts 704*a*, 704*b* by pivot shafts 761. Rollers 744*a* are mounted on one side of the movable fingers 738 near the guide plate 740*a*. The movable fingers 738 project upwardly through the gaps between the support plate 716 and the light-shielding bag guide plates 718*a*, 718*b* in the range in which the rollers 744*a* roll on the upper surface of the guide plate 740*a*, i.e., in the range of a distance L1 from the trailing end of a pack 26 immediately after the pack 26 is charged from the pack feeding apparatus 600. When each of the movable fingers 738 reaches the recess 742, the movable finger 738 is angularly displaced downwardly.

Figure 31:
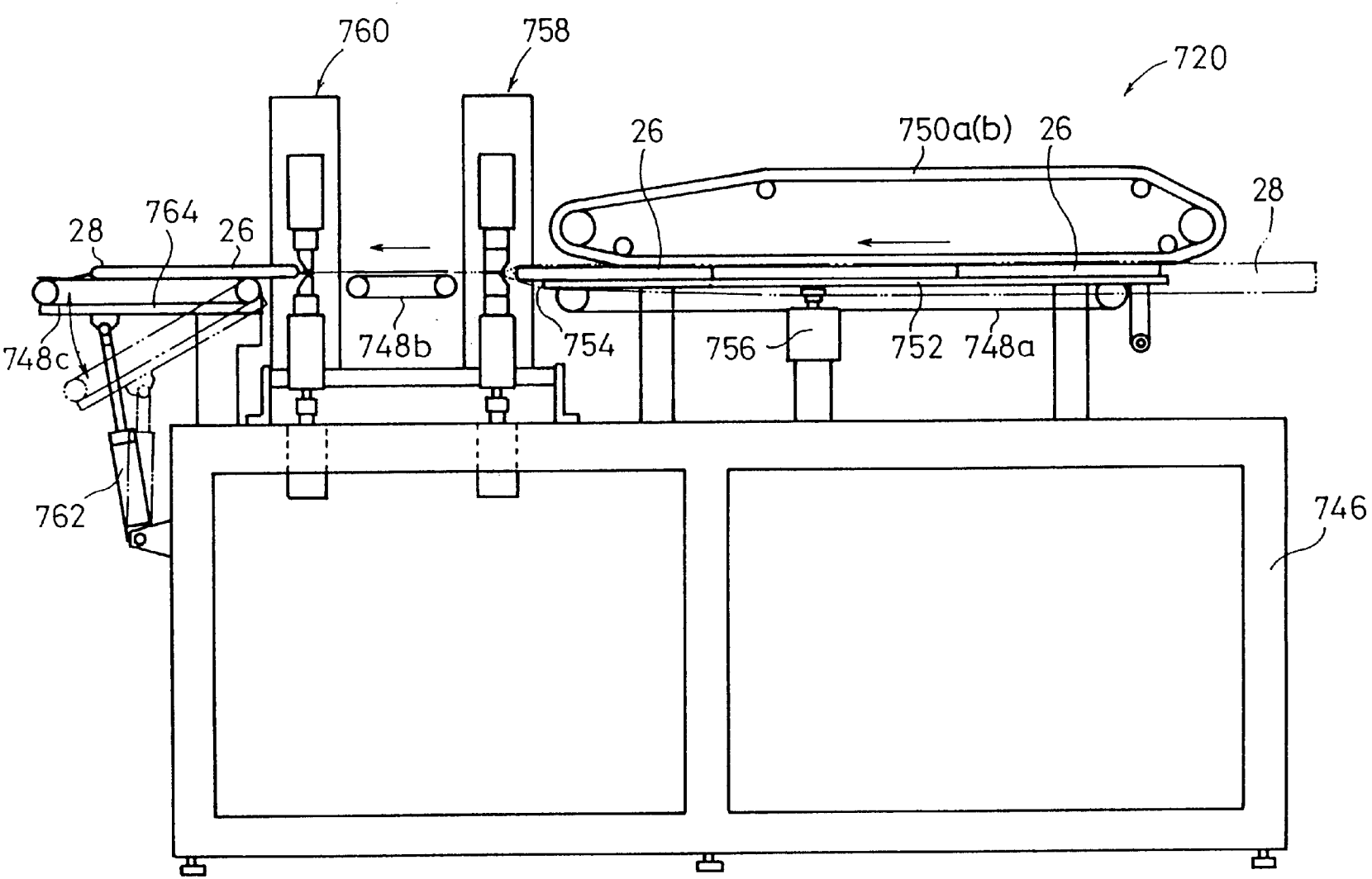
FIG. 31 is a side elevational view of a pack inserter of the package producing apparatus.

In FIG. 31, the pack inserter 720 has three feed belts 748*a*, 748*b*, 748*c* mounted on a base 746 and arrayed in the direction in which a pack 26 is fed. The feed belts 748*a*, 748*b*, 748*c* intermittently feed packs 26 by the distance L3 which corresponds to the length of light-shielding bags 28 in synchronism with the chain belts 704*a*, 704*b* in the previous pack feeder 710. Rubber belts 750*a*, 750*b* are provided on the feed belt 748*a* so as to abut both sides of the packs 26. The packs 26 are fed by being sandwiched between the feed belt 748*a* and rubber belts 750*a*, 750*b*. An air removal pipe 752 for removing air from light-shielding bags 28 is disposed between the feed belt 748*a* and packs 26 and extends in the direction in which the packs 26 are fed. The air removal pipe 752 has an air outlet opening 754 defined in a downstream end thereof. A mating surface sealer 756 for melting and sealing a mating surface 29 (see FIG. 32) of a light-shielding bag 28 with heat is disposed beneath the air removal pipe 752.

Between the feed belts 748*a*, 748*b*, there is disposed a front flap cutter sealer 758 for cutting the front and rear ends of a light-shielding bag 28 and melting and sealing a light-shielding bag 28 near its front flap 30 with heat. Between the feed belts 748*b*, 748*c*, there is disposed a rear flap sealer 760 for melting and sealing a light-shielding bag 28 near its rear flap 32 with heat. The feed belt 748*c* is supported on a support base 764 coupled to a switching cylinder 762 that is mounted on the base 746. The support base 764 is vertically movable by the switching cylinder 762 for placing those packs 26 which are defective or to be inspected into a storage case 766 (see FIG. 27) of the film package producer 730.

Figure 33:
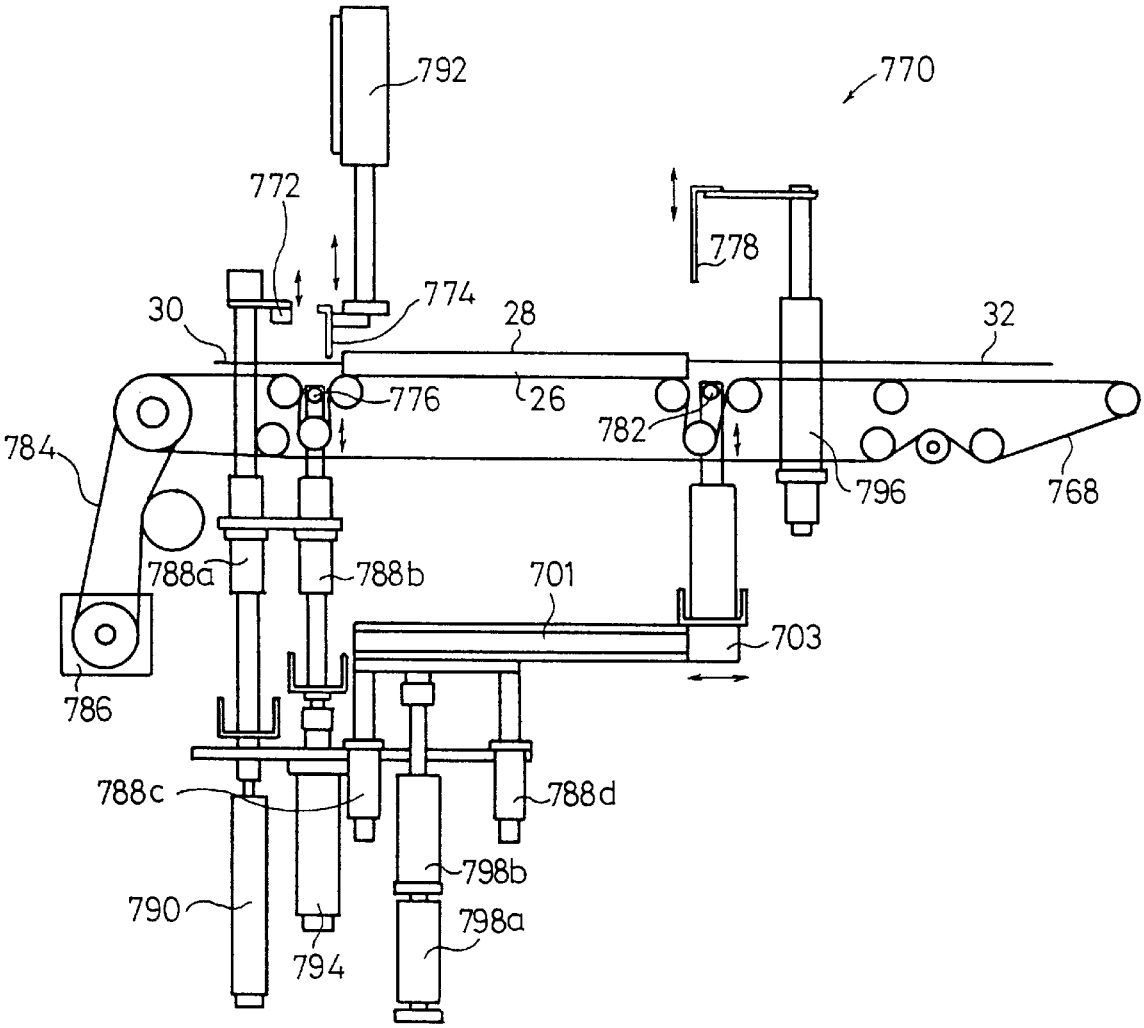
FIG. 33 is a side elevational view of a rear flap folder of the package producing apparatus.

The film package producer 730 has a rear flap folder 770 and a front flap folder 780. As shown in FIG. 33, the rear flap folder 770 comprises a feed belt 768 for feeding a pack 26 placed in a light-shielding bag 28, a front flap holder 772 for holding a front flap 30, a front corner positioning plate 774 for positioning corners of the pack 26 near the front flap 30, a shifting roller 776 for shifting the pack 26 toward a rear flap 32, a rear corner positioning plate 778 for positioning corners of a pack near a rear flap 32 in a large-size film package, and a rear flap folding roller 782 for folding the rear flap 32.

The feed belt 768 is driven by a drive motor 786 that is operatively coupled to the feed belt 768 by a belt 784. The front flap holder 772 is disposed above the feed belt 768 and displaceable toward and away from the feed belt 768 by a front flap holder lifting and lowering cylinder 790 that is guided by a guide 788*a*. The front corner positioning plate 774 is disposed above the feed belt 768 and displaceable toward and away from a front end of the pack 26 near the front flap 30 by a front corner positioning plate lifting and lowering cylinder 792. The shifting roller 776 is disposed below the front flap 30 between the front flap holder 772 and the front corner positioning plate 774, and displaceable toward and away from a portion of the front flap 30 immediately in front of the front corner positioning plate 774 by a shifting roller lifting and lowering cylinder 794 that is guided by a guide 788*b*. The rear corner positioning plate 778 is disposed above the feed belt 768 and displaceable toward and away from the rear end of a large-size pack by a rear corner positioning plate lifting and lowering cylinder 796. The rear flap folding roller 782 is disposed below the rear flap 32 and displaceable toward a portion of the rear flap 32 immediately behind the rear corner positioning plate 778 by folding roller lifting and lowering cylinders 798*a*, 798*b* that are guided by respective guides 788*c*, 788*d*. The rear flap folding roller 782 is also displaceable toward the front flap 30 along an upper surface of the light-shielding bag 28 by a rodless cylinder 703 that can be displaced along a guide rail 701.

Figure 34:
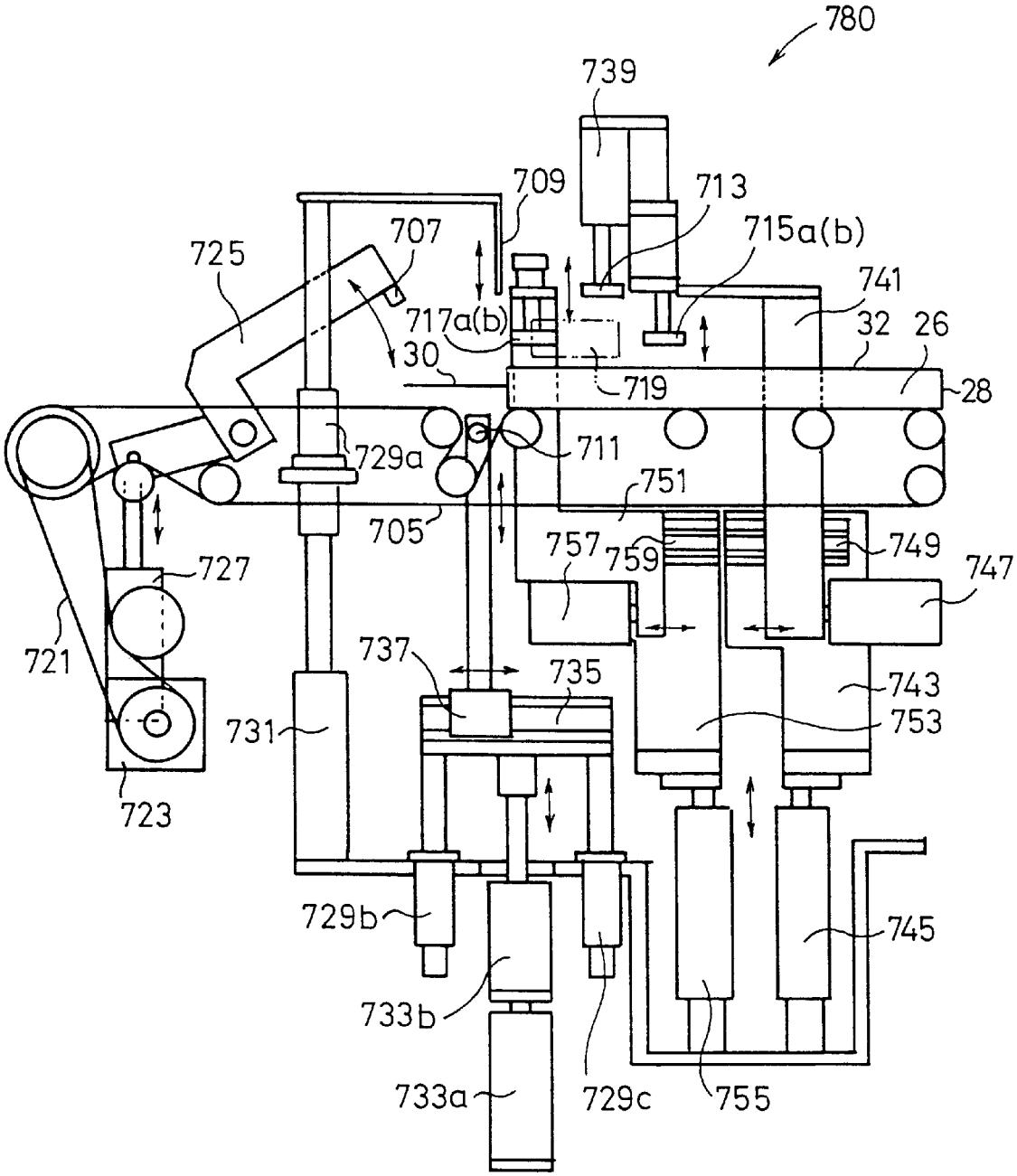
FIG. 34 is a side elevational view of a front flap folder of the package producing apparatus.
Figure 35:
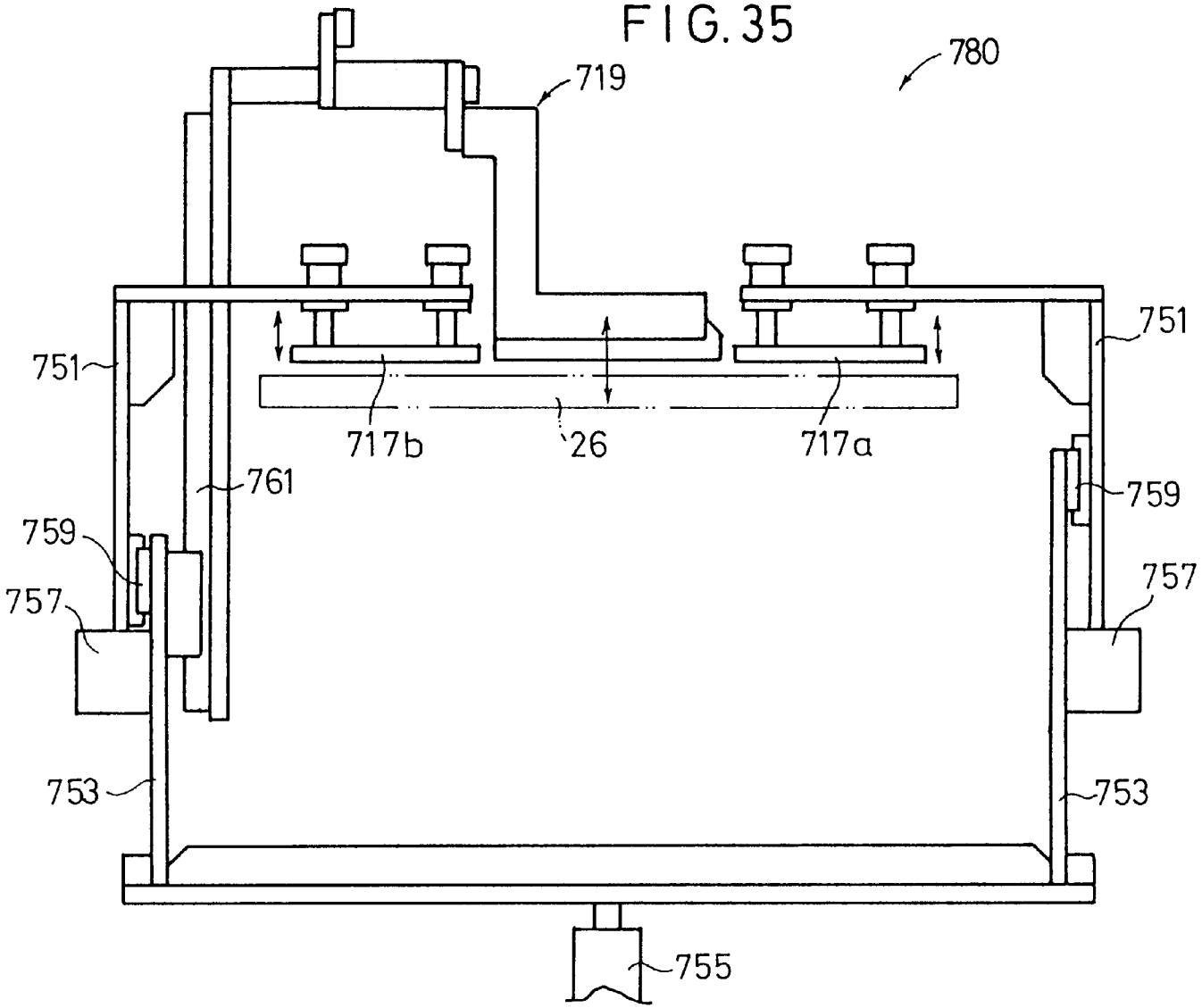
FIG. 35 is a front elevational view of the front flap folder of the package producing apparatus.

As shown in FIGS. 34 and 35, the front flap folder 780 comprises a feed belt 705 for feeding a pack 26 placed in a light-shielding bag 28, a front bag end holder 707 for holding a front flap 30, a front corner positioning plate 709 for positioning corners of the pack 26 near the front flap 30, a front flap folding roller 711 for folding the front flap 30, a rear flap pre-holder 713 for pre-holding the rear flap 32 that has been folded by the rear flap folder 770, rear flap holders 715*a*, 715*b* for fully holding the rear flap 32, front flap holders 717*a*, 717*b* for holding the front flap 30 that has been folded, and a label applicator mechanism 719 for applying a label 34 across and between the front flap 30 and the rear flap 32.

The feed belt 705 is driven by a drive motor 723 that is operatively coupled to the feed belt 705 by a belt 721. The front bag end holder 707 is disposed above the feed belt 705 and displaceable toward and away from the feed belt 705 by a front flap holder turning cylinder 727 through a link 725 that has a central portion pivotally supported. The front corner positioning plate 709 is disposed above the feed belt 705 and displaceable toward and away from the front end of the pack 26 near the front flap 30 by a front corner positioning plate lifting and lowering cylinder 731 that is guided by a guide 729*a*. The front flap folding roller 711 is disposed below the front flap 30 and displaceable toward a portion of the front flap 30 immediately behind the front corner positioning plate 709 by folding roller lifting and lowering cylinders 733*a*, 733*b* that are guided by respective guides 729*b*, 729*c*. The front flap folding roller 711 is also displaceable toward the rear flap 32 along an upper surface of the light-shielding bag 28 by a rodless cylinder 737 that can be displaced along a guide rail 735. The rear flap pre-holder 713 is disposed above the pack 26 and displaceable toward and away from the rear flap 32 by a rear flap pre-holder lifting and lowering cylinder 739. The rear flap holders 715*a*, 715*b* are disposed upstream of the rear flap pre-holder 713 and displaceable toward and away from the rear flap 32 by a rear flap holder lifting and lowering cylinder 745 through brackets 741, 743. The brackets 743 support thereon rear flap holder displacing cylinders 747 to which the brackets 741 are coupled and guide rails 749 on which the brackets 741 are movably supported. When the brackets 741 are displaced along the guide rails 749 by the rear flap holder displacing cylinders 747, the rear flap holders 715*a*, 715*b* are displaced along the rear flap 32. The front flap holders 717*a*, 717*b* are disposed above the pack 26 near the front corner positioning plate 709 and displaceable toward and away from the pack 26 by a front flap holder lifting and lowering cylinder 755 through brackets 751, 753. The brackets 753 support thereon front flap holder displacing cylinders 757 to which the brackets 751 are coupled and guide rails 759 on which the brackets 751 are movably supported. When the brackets 751 are displaced along the guide rails 759 by the front flap holder displacing cylinders 757, the front flap holders 717*a*, 717*b* are displaced along the front flap 30. As shown in FIG. 35, the front flap holders 717*a*, 717*b* are positioned over opposite sides of the pack 26 at a spaced interval. The label applicator mechanism 719 is displaceable along a guide rail 759 toward and away from the front flap 30 and the rear flap 32 in the gap between the front flap holders 717*a*, 717*b*.

Figure 36:
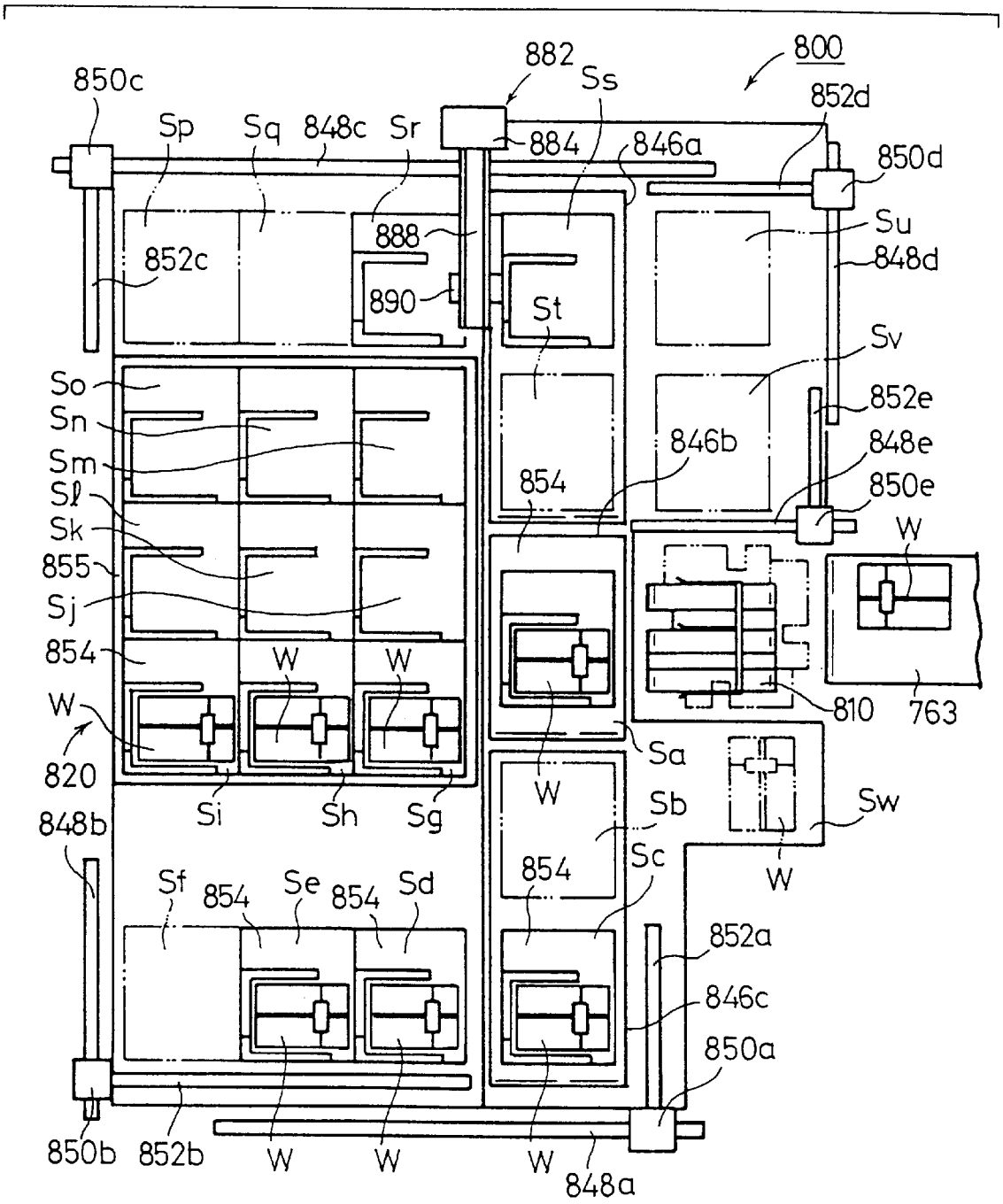
FIG. 36 is a plan view of a package stacking apparatus.

Package Stacking Apparatus 800 (See FIGS. 36 Through 41):

The package stacking apparatus 800 is coupled to the package producing apparatus 700 via a feed belt 763. The package stacking apparatus 800 serves to stack film packages W. As shown in FIG. 36, the package stacking apparatus 800 has the package delivery machine 810 disposed near the feed belt 763.

Figure 37:
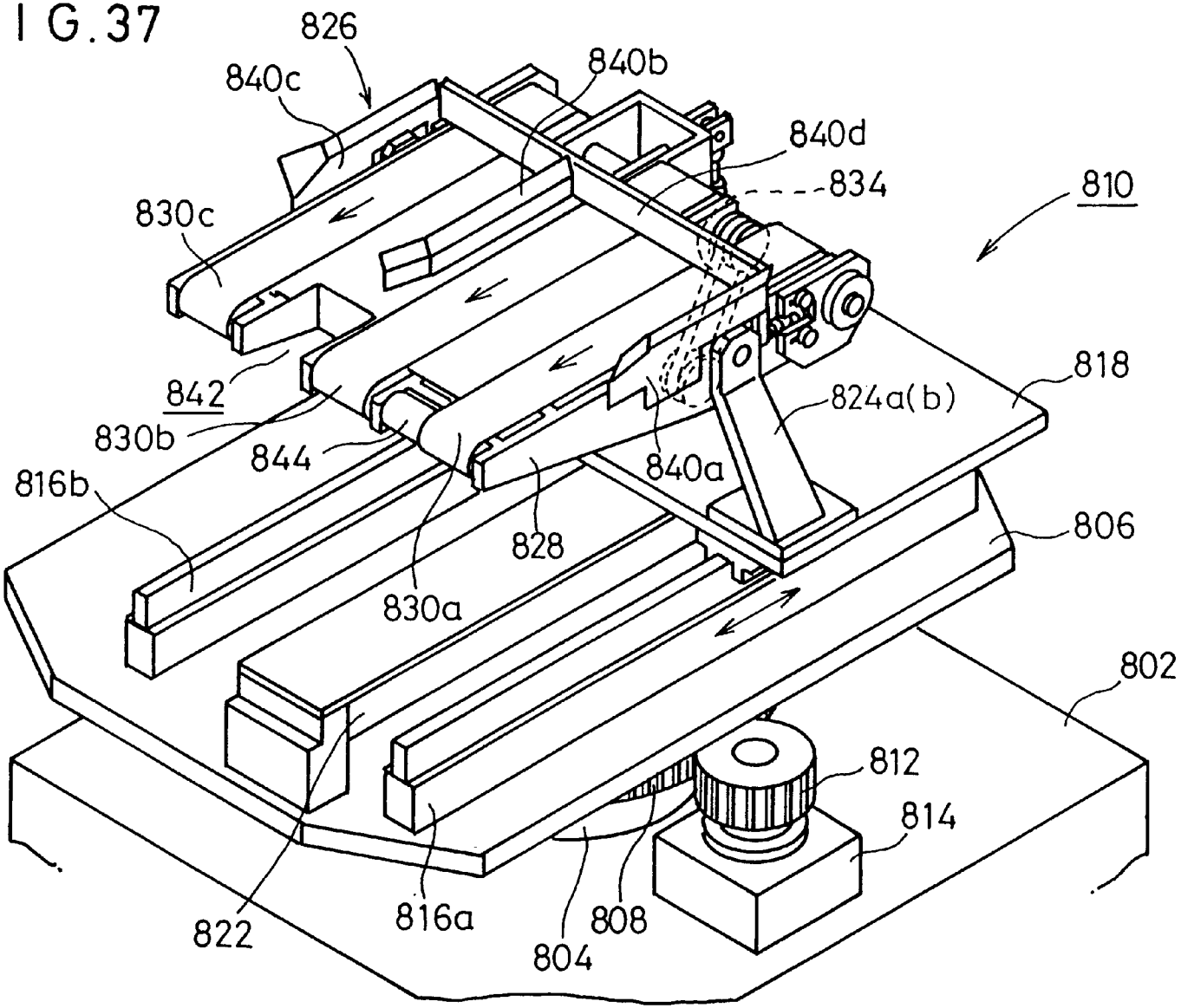
FIG. 37 is a perspective view of a package delivery machine of the package stacking apparatus.
Figure 38:
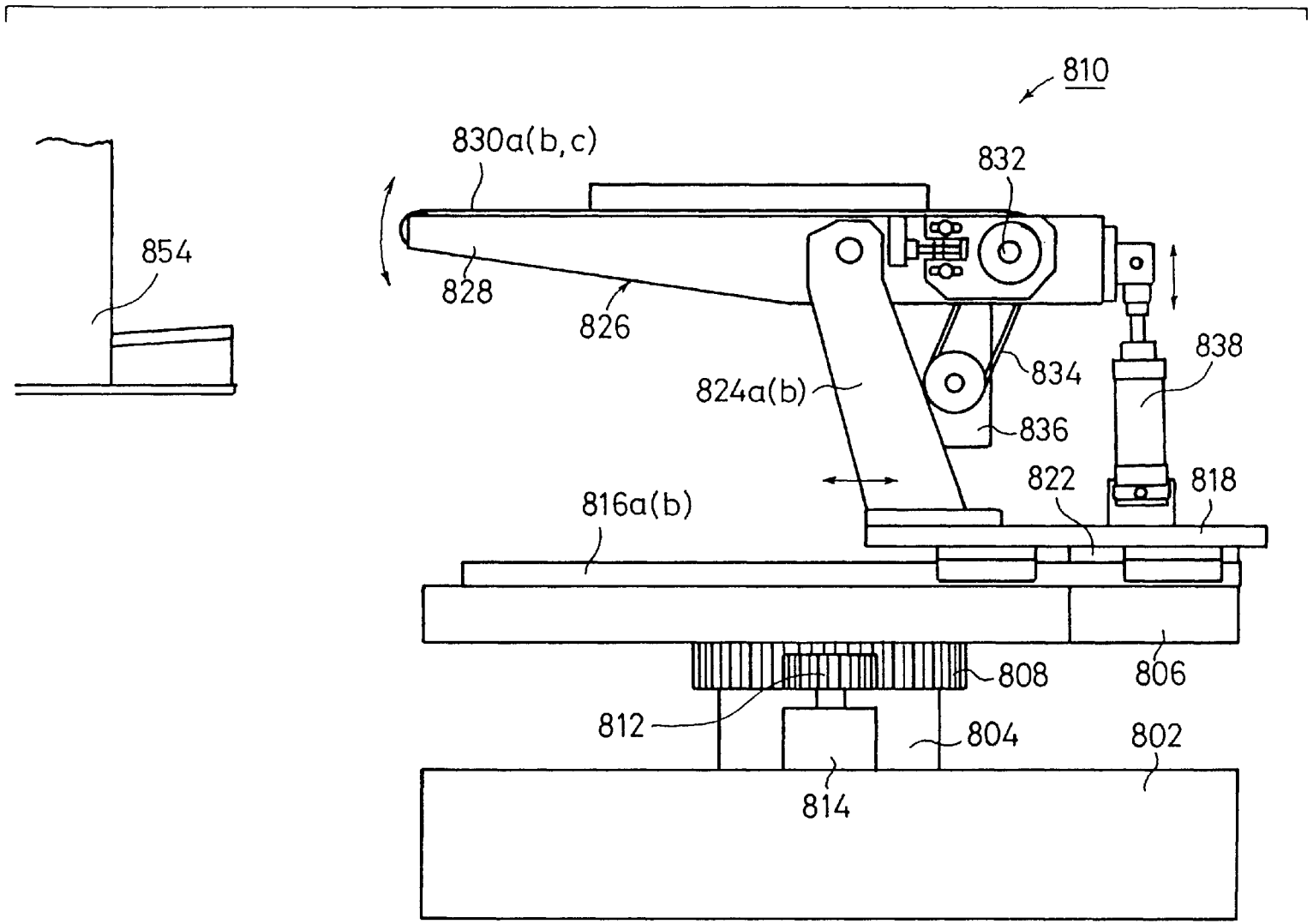
FIG. 38 is a side elevational view of the package delivery machine of the package stacking apparatus.

As shown in FIGS. 37 and 38, the package delivery machine 810 has a turntable 806 mounted on a base 802 by a support shaft 804. A gear 808 is disposed around the outer circumferential surface of the support shaft 804 and held in mesh with a gear 812 coupled to a turntable drive motor 814 mounted on the base 802. Guide rails 816*a*, 816*b* are mounted on the turntable 806, and a slide table 818 is held in sliding engagement with the guide rails 816*a*, 816*b*. The slide table 818 is displaceable along the guide rails 816*a*, 816*b* by a rodless cylinder 822 that is disposed between the guide rails 816*a*, 816*b*.

A package retaining mechanism 826 is mounted on the slide table 818 by brackets 824*a*, 824*b*. The package retaining mechanism 826 has a frame 828 having an intermediate portion pivotally supported on upper ends of the brackets 824*a*, 824*b*. Three feed belts 830*a*, 830*b*, 830*c* are disposed around the frame 828 and supported by a support shaft 832 that is operatively coupled to a feed belt drive motor 836 via a belt 834. A rear portion of the frame 828 and the slide table 818 are coupled to each other by a package retaining mechanism tilting cylinder 838 for tilting the package retaining mechanism 826.

Guide plates 840*a*, 840*b*, 840*c*, 840*d* for positioning a film package W are disposed on an upper surface of the frame 828. The guide plates 840*a*, 840*b*, 840*d* serve to position a small-size film package W, and the guide plates 840*a*, 840*c*, 840*d* serve to position a large-size film package. When large-size film packages are employed, the guide plate 840*b* is detached from the frame 828. The frame 828 has a slot 842 defined in a distal end thereof near the guide plate 840*b*. A roller 844 is disposed in the distal end of the frame 828 between the feed belts 830*a*, 830*b*.

The package stacker 820 is positioned near the package delivery machine 810. The package stacker 820 has a plurality of stations Sa through Sw through which film packages W delivered from the package delivery machine 810 are movable. Feed chains 846*a*, 846*b*, 846*c* are disposed in the stations Ss, St, the station Sa, and the stations Sb, Sc, respectively. The feed chain 846*b* that is centrally positioned is vertically movable. The station Sv is angularly movable 90° and is also vertically movable. Guide rails 848*a*, 848*b*, 848*c*, 848*d*, 848*e* are disposed on sides of the stations Sc through Sf, Sf, Sp through Ss, Su, Sv, respectively, and mobile robots 850*a*, 850*b*, 850*c*, 850*d*, 850*e* are disposed on the respective guide rails 848*a*, 848*b*, 848*c*, 848*d*, 848*e* for moving film packages W. The mobile robots 850*a*, 850*b*, 850*c*, 850*d*, 850*e* have respective arms 852*a*, 852*b*, 852*c*, 852*d*, 852*e* extending perpendicularly to the guide rails 848*a*, 848*b*, 848*c*, 848*d*, 848*e*, and are movable along the guide rails 848*a*, 848*b*, 848*c*, 848*d*, 848*e*.

Figure 39:
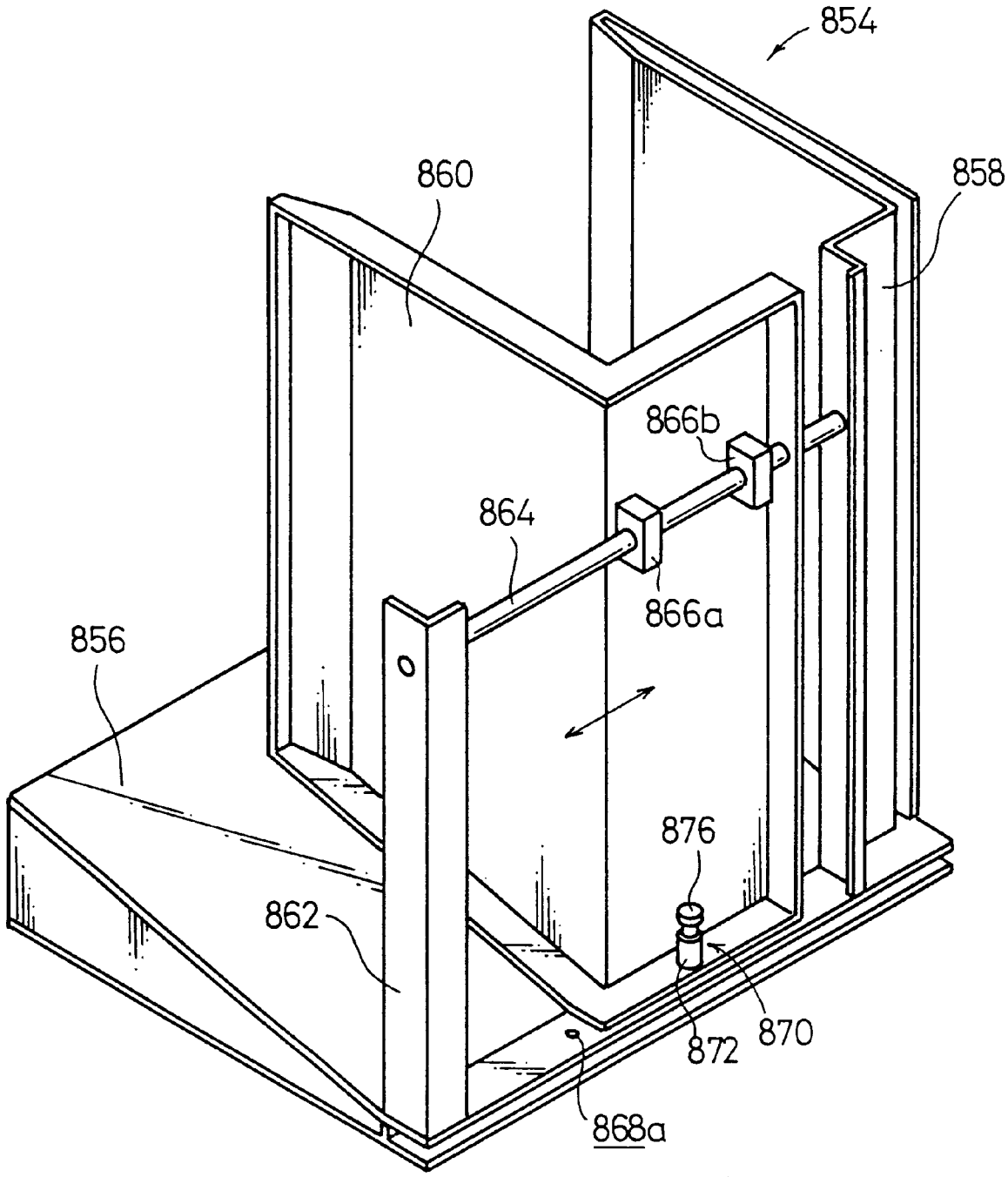
FIG. 39 is a perspective view of a magazine to be placed in the package stacking apparatus.

A magazine 854 for storing stacked film packages W is disposed in each of the stations Sa through Sv. As shown in FIG. 39, the magazine 854 comprises a bottom plate 856 inclined downwardly away from the package delivery machine 810, a first side wall 858 fixed to a side of the bottom plate 856, and a second side wall 860 movable on the bottom plate 856 toward and away from the first side wall 858. A support post 862 is vertically mounted on a corner of the bottom plate 856. A guide bar 864 is supported on and extends between the support post 862 and the first side wall 858. Brackets 866*a*, 866*b* mounted on a back of the second side wall 860 are movably fitted over the guide bar 864 such that the second side wall 860 is displaceable along the guide bar 864.

Figure 40:
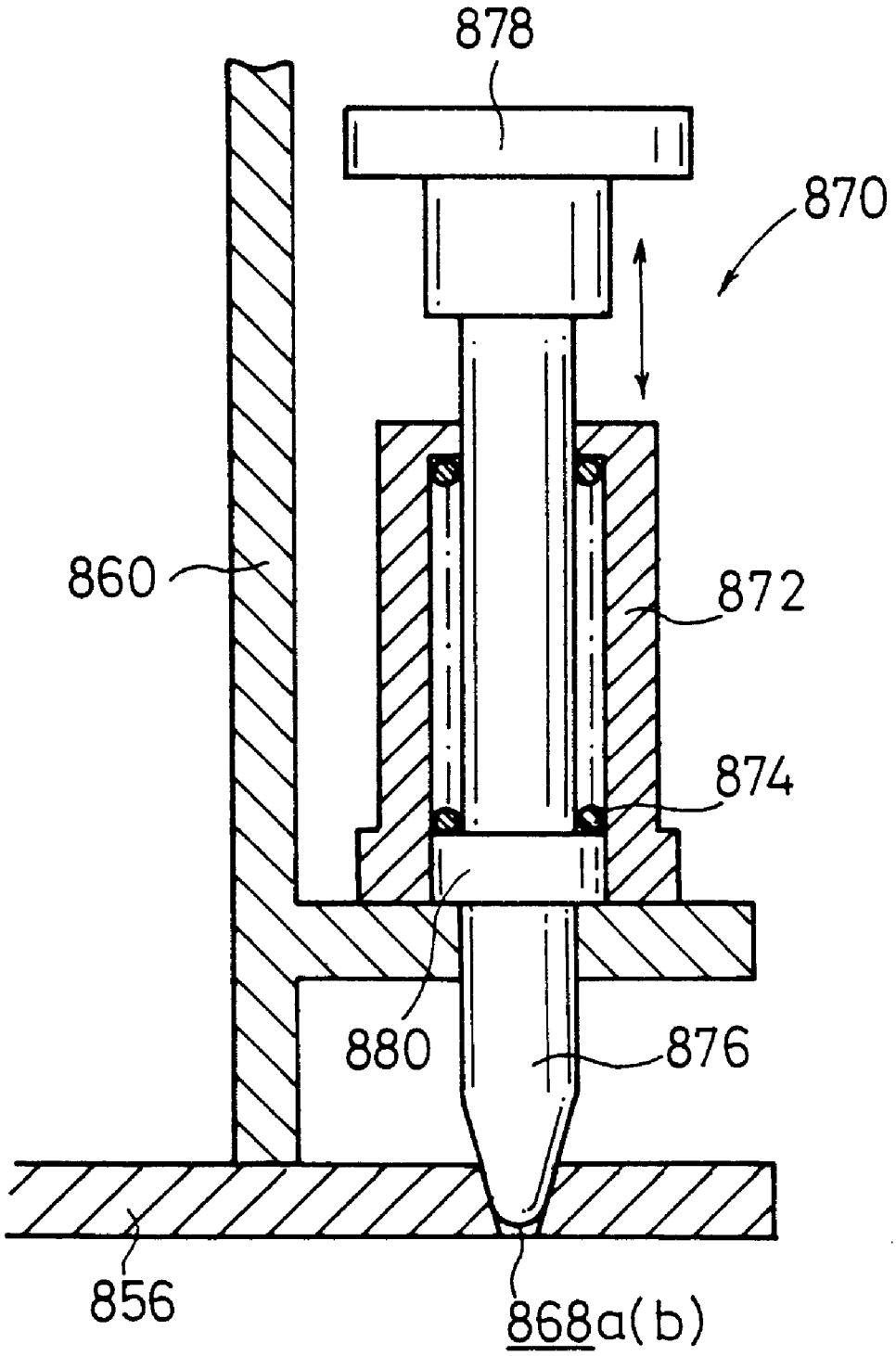
FIG. 40 is a cross-sectional view of a fixing means of the magazine to be placed in the package stacking apparatus.
Figure 41:
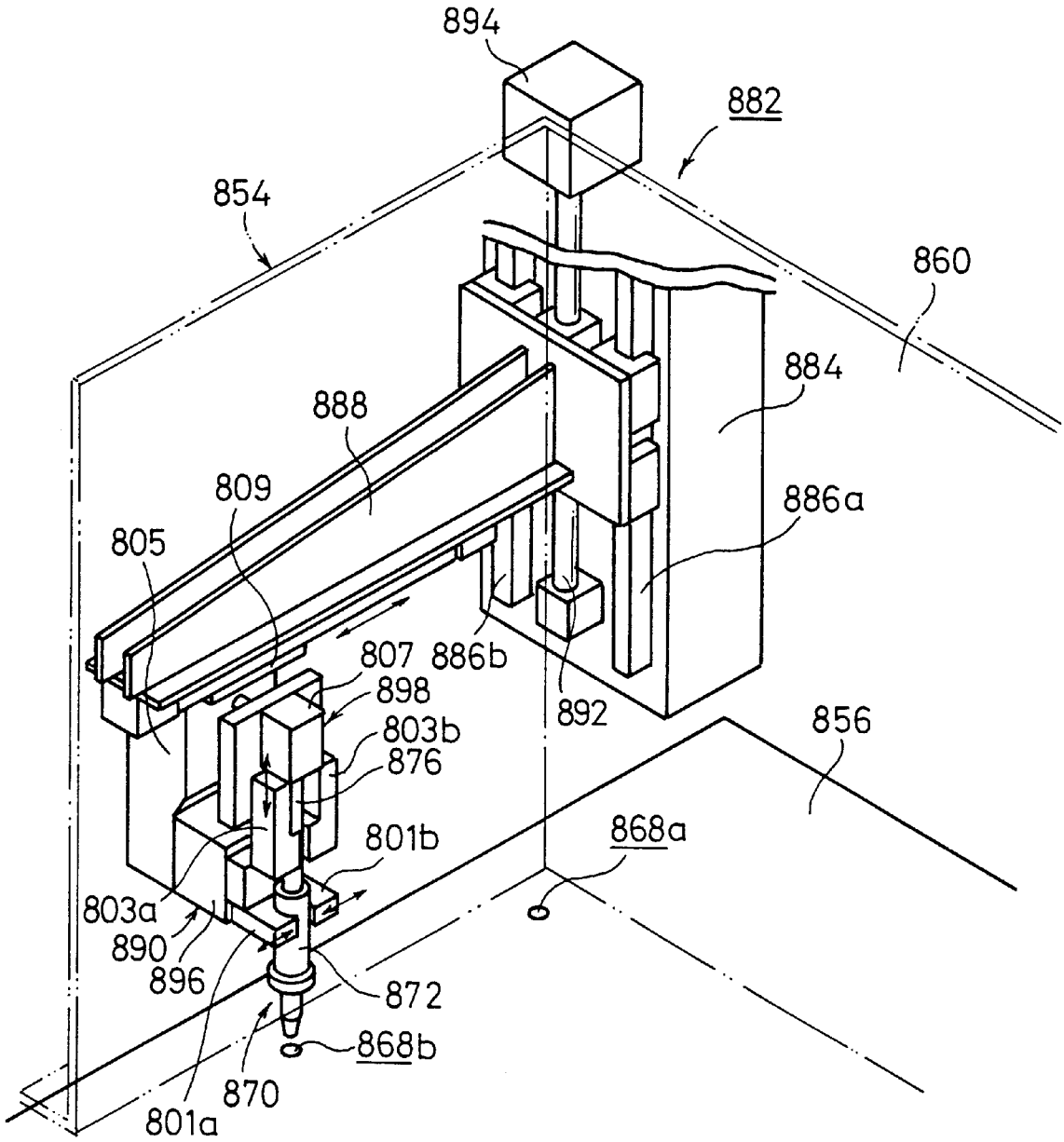
FIG. 41 is a perspective view of a magazine size changing robot of the package stacking apparatus.
Figure 42:
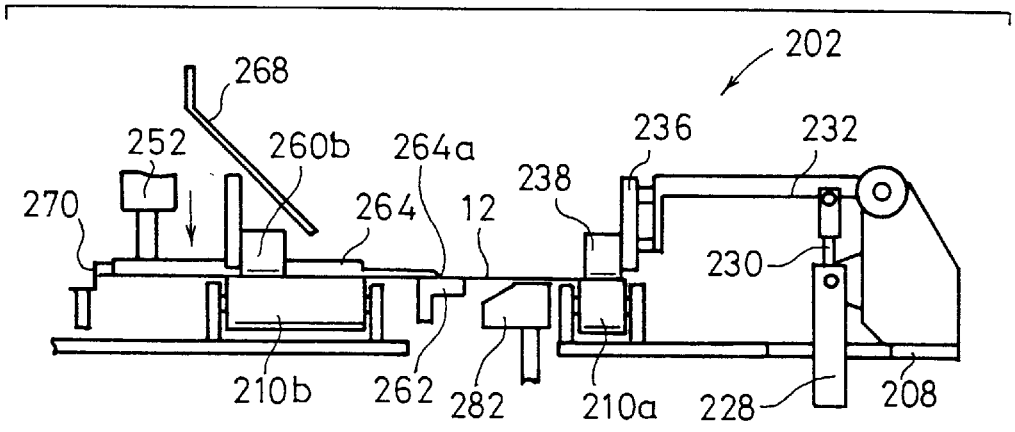
FIG. 42 is an elevational view showing the manner in which a protective cover is held in position by the first pre-folding mechanism in the protective cover pre-folding apparatus.
Figure 43:
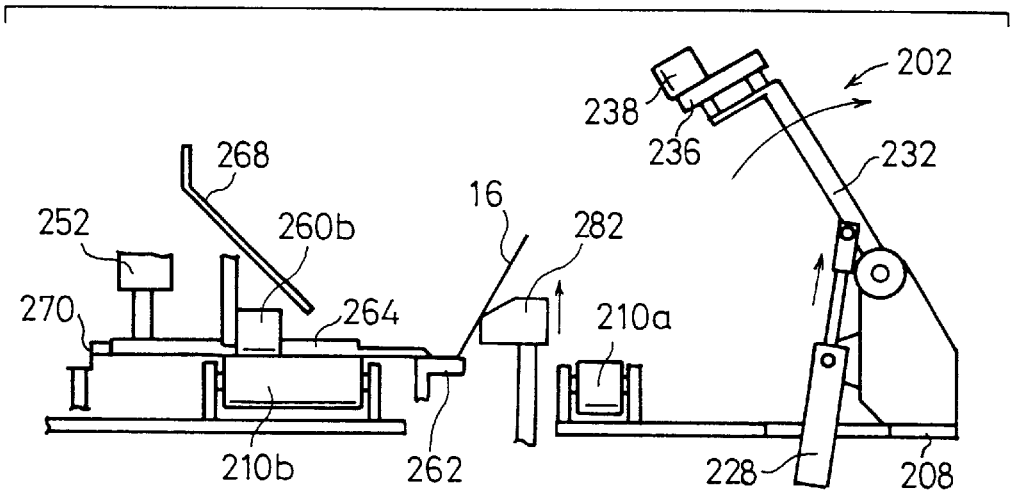
FIG. 43 is an elevational view showing the manner in which the protective cover is folded along a first fold line by the first pre-folding mechanism in the protective cover pre-folding apparatus.
Figure 44:
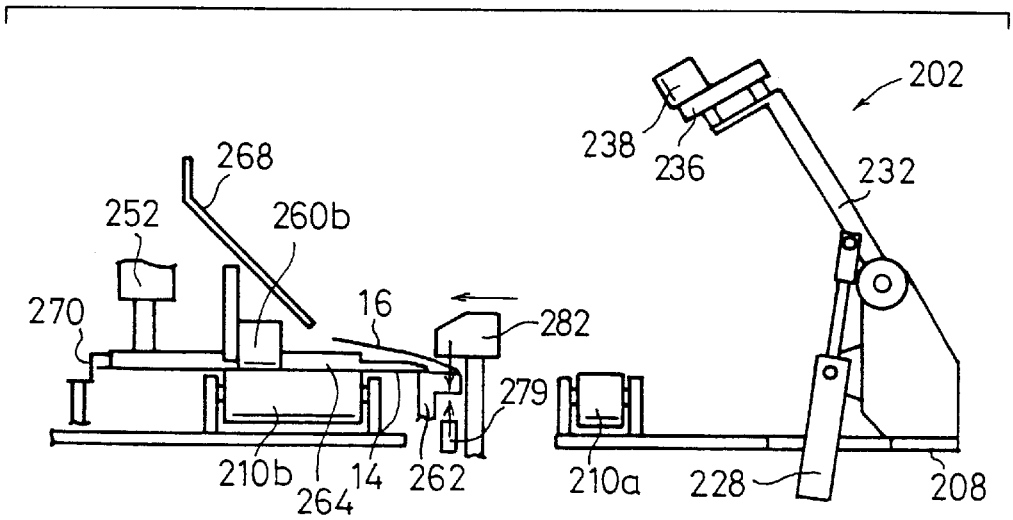
FIG. 44 is an elevational view showing the manner in which the protective cover is folded along the first fold line by the first pre-folding mechanism in the protective cover pre-folding apparatus.
Figure 45:
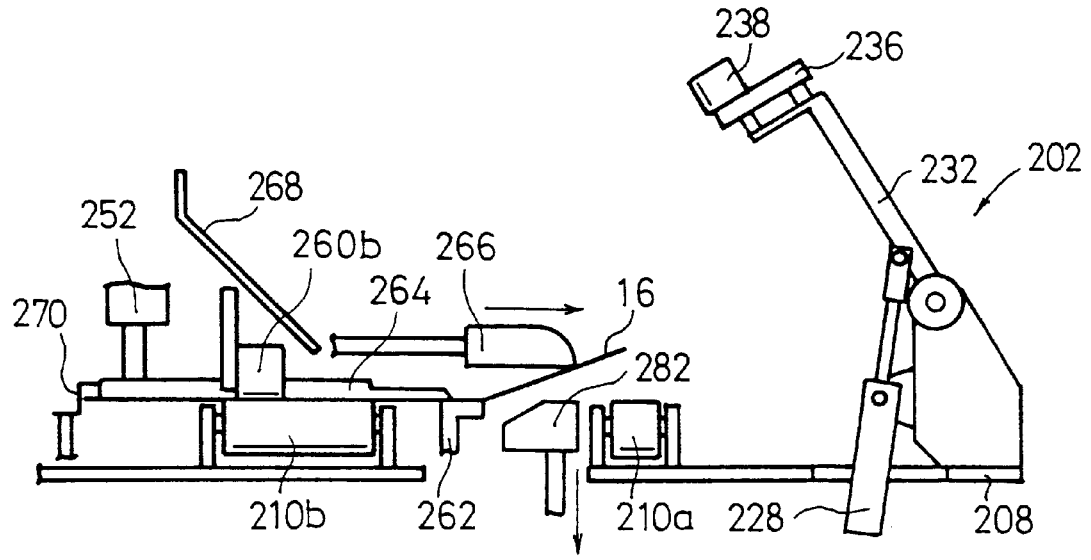
FIG. 45 is an elevational view showing the manner in which the protective cover is extended across the first fold line by the first pre-folding mechanism in the protective cover pre-folding apparatus.
Figure 46:
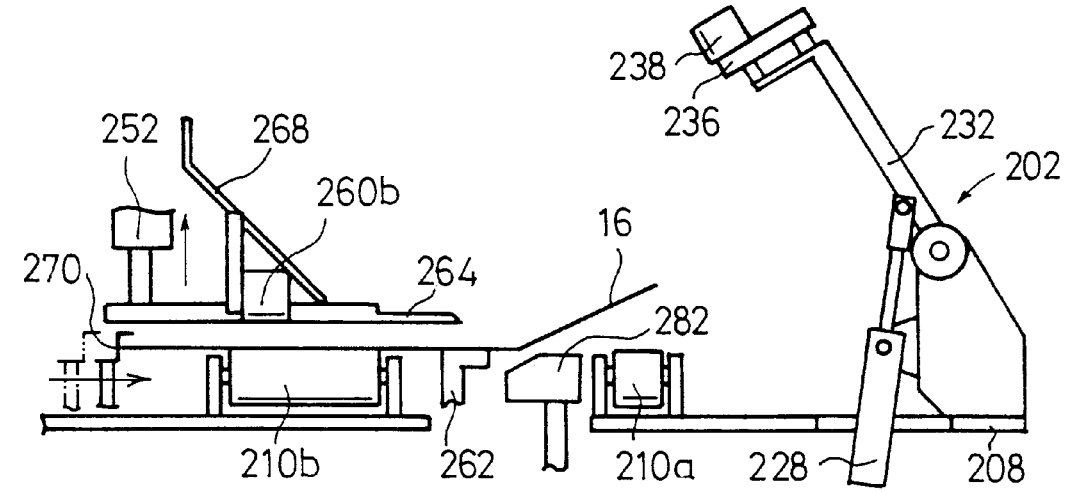
FIG. 46 is an elevational view showing the manner in which the protective cover is displaced by the first pre-folding mechanism in the protective cover pre-folding apparatus.

As shown in FIGS. 40 and 41, the bottom plate 856 has holes 868*a*, 868*b* for fixing the second side wall 860 in one of selectable positions with respect to the first side wall 858. A fixing means 870 for fixing the second side wall 860 is disposed on the back of the second side wall 860. The fixing means 870 has a pin 876 supported in a tubular member 872 fixed to the back of the second side wall 860 and a spring 874 disposed around the pin 876 in the tubular member 872. The pin 876 has a first flange 878 on an upper end thereof and a tapered lower end projecting downwardly from the tubular member 872. The spring 874 disposed in the tubular member 872 acts between an upper end wall of the tubular member 872 and a second flange 880 mounted on a lower portion of the pin 876 in the tubular member 872, for thereby normally biasing the pin 876 downwardly.

A magazine size changing robot 882 is disposed above the station Ss of the package stacker 820. The magazine size changing robot 882 has a main block 884, a horizontal arm 888 movably held in engagement with guide rails 886*a*, 886*b* on the main block 884, and a pin gripper unit 890 mounted on and displaceable along the arm 888.

As shown in FIG. 41, an air cylinder 894 for vertically moving the arm 888 has a rod 892 extending vertically between the guide rails 886*a*, 886*b*. The pin gripper unit 890 has a first chuck 896 for chucking the tubular member 872 of the fixing means 870, and a second chuck 898 for chucking the pin 876. The pin gripper unit 890 is displaceable along the arm 888 by a displacing cylinder 809. The first chuck 896, which serves to chuck the tubular member 872 laterally, has a pair of openable and closable chuck arms 801*a*, 801*b*. The second chuck 898 has a pair of fixed chuck arms 803*a*, 803*b* for engaging the first flange 878 of the pin 876. The chuck arms 803*a*, 803*b* are displaceable by displacing cylinders 805, 807 for engaging the first flange 878 of the pin 876 and vertically moving the pin 876. Wit the pin 876 pulled upwardly, the pin gripper unit 890 is displaced along the arm 888 by the displacing cylinder 809 to change sizes of the magazine 854.

The film package production system 10 is basically constructed as described above. A process of producing a film package W with the film package production system 10 will be described below.

First, a process of pre-folding a protective cover 12 with the protective cover pre-folding apparatus 200 will be described below with reference to FIGS. 42 through 50.

A flat protective cover 12 is supplied to and positioned in the first pre-folding mechanism 202. Since the protective cover 12 is flat, a number of stacked protective covers 12 can easily be supplied to the protective cover pre-folding apparatus 200.

The protective cover 12 supplied to the first pre-folding mechanism 202 is gripped between the feed belts 210*a*, 210*b* driven by the feed belt drive motor 214 and the rollers 226, 238, 260*a*, 260*b*, and fed thereby until it is stopped when the side panels 21, 23 of the protective cover 12 abut against the positioning plates 284*a*, 284*b* (see FIG. 4). If a large-size protective cover is supplied, then it is also fed by the feed belt 210*c* and the roller 244 as well as the feed belts 210*a*, 210*b* and the rollers 226, 238, 260*a*, 260*b*.

When the protective cover 12 is positioned, the holder plate displacing cylinder 254 is actuated to lower the holder plate 264. The holder plate 264 and the support table 262 jointly grip the protective cover 12 therebetween (see FIG. 42). At this time, a linear distal end 264*a* (see FIG. 4) of the holder plate 264 is disposed along the first fold line 18 of the protective cover 12.

Then, the roller displacing cylinder 218 is actuated to move the roller 226 in the direction in which the protective cover 12 is fed, and the roller turning cylinder 228 is actuated to turn the roller 238 upwardly, thus releasing the top panel 16 of the protective cover 12. Thereafter, the lifting and lowering cylinder 280 (see FIG. 5) is actuated to lift the bending member 282 for thereby bending the top panel 16 along the first fold line 18 (see FIG. 43).

After the bending member 282 is lifted a predetermined distance, the bracket displacing cylinder 278 (see FIG. 5) is actuated to move the bending member 282 and the bracket 276 toward the bottom panel 14 of the protective cover 12. Thereafter, the bending member 282 is lowered to depress the top panel 16 toward the bottom panel 14. At this time, the attachment bracket 279 whose upper end projects upwardly from the lifting and lowering cylinder 280 is elevated by reaction along the guide rail 277 (see FIG. 44). The bottom panel 14 and the top panel 16 are now gripped by the bending member 282 and the attachment bracket 279 through the support table 262, whereupon the folding along the first fold line 18 is completed.

After the first fold line 18 is produced, the bracket displacing cylinder 278 and the lifting and lowering cylinder 280 are actuated to retract the bending member 282 downwardly of the base 208. Then, the extending plate displacing cylinder 256 (see FIG. 4) is actuated to move the extending plate 266 toward the feed belt 210*a* for thereby returning the folded top panel 16 to the original unfolded state (see FIG. 45).

When the folded top panel 16 is returned to the original unfolded state, the roller displacing cylinder 252 and the holder plate displacing cylinder 254 are actuated to lift the roller 260*a*, 260*b* and the holder plate 264 away from the protective sheet 12. Subsequently, the presser plate displacing cylinder 272 (see FIG. 5) is actuated to move the presser plate 270 toward the top panel 16 by a distance between the first fold line 18 and the second fold line 20 (see FIG. 46).

Then, with the bottom panel 14 of the protective cover 12 being held by the holder plate 264, the top panel 16 is folded by the bending member 282, producing the second fold line 20. At this time, the inclined top panel support plate 268, which is disposed above the bending member 282, supports the folded top panel 16.

A large-size protective cover can be folded in substantially the same manner as with the small-size protective cover 12 except that the presser plate 248 is moved toward the top panel of the protective cover by the presser plate displacing cylinder 250.

After the first fold line 18 and the second fold line are produced, the roller displacing cylinder 218 and the roller turning cylinder 228 are actuated to cause the feed belt 210*a* and the rollers 226, 238 to grip the top panel 16 of the protective cover 12 again. The positioning plates 284*a*, 284*b* are lowered by the non-illustrated lifting and lowering cylinder. Thereafter, the feed belts 210*a*, 210*b*, 210*c* are driven to feed the protective cover 12 to the second prefolding mechanism 204.

Figure 47:
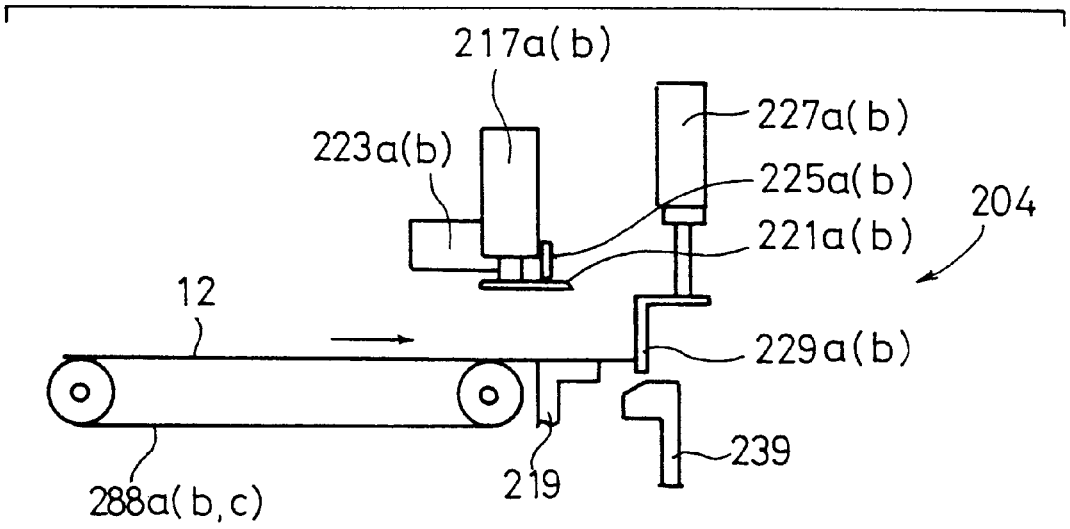
FIG. 47 is an elevational view showing the manner in which the protective cover is positioned by the second pre-folding mechanism in the protective cover pre-folding apparatus.
Figure 48:
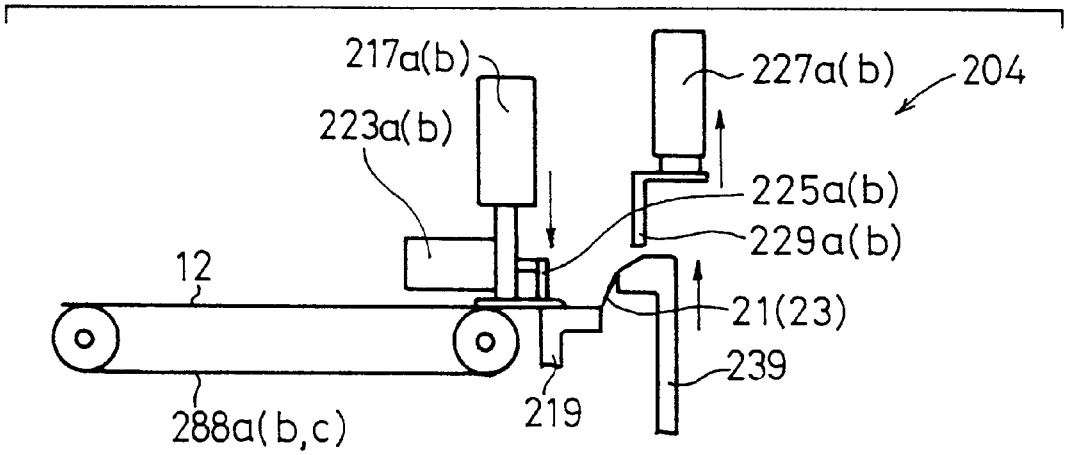
FIG. 48 is an elevational view showing the manner in which the protective cover is folded along third and fourth fold lines by the second pre-folding mechanism in the protective cover pre-folding apparatus.

The protective cover 12 supplied to the second prefolding mechanism 204 is gripped between the feed belts 288*a*, 288*b* and the rollers 203, 294, 213*a*, 213*b*, and fed thereby until it is positioned when the side panels 21, 23 of the protective cover 12 abut against the positioning plates 229*a*, 229*b* (see FIG. 47). If a large-size protective cover is supplied, then it is also fed by the feed belt 288*c* and the rollers 213*c*, 213*d* as well as the feed belts 288*a*, 288*b* and the rollers 203, 294, 213*a*, 213*b* (see FIG. 6).

When the protective cover 12 is positioned, the holder plate displacing cylinders 217*a*, 217*b* are actuated to lower the holder plates 221*a*, 221*b*. The holder plates 221*a*, 221*b* and the support table 219 jointly grip the protective cover 12 therebetween (see FIG. 48). At this time, linear distal ends of the holder plates 221*a*, 221*b* are disposed along the third fold line 22 and the fourth fold line 24 of the protective cover 12. Then, the positioning plate displacing cylinders 227*a*, 227*b* are actuated to lift the positioning plates 229*a*, 229*b*, and the lifting and lowering cylinder 237 is actuated to lift the bending member 239, thus folding the side panels 21, 23 along the third fold line 22 and the fourth fold line 24.

Figure 49:
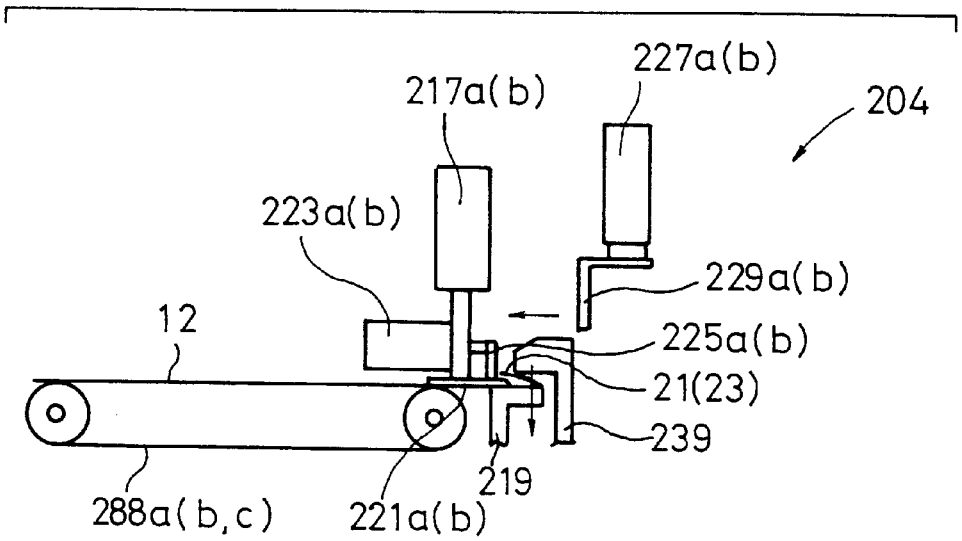
FIG. 49 is an elevational view showing the manner in which the protective cover is folded along the third and fourth fold lines by the second pre-folding mechanism in the protective cover pre-folding apparatus.
Figure 50:
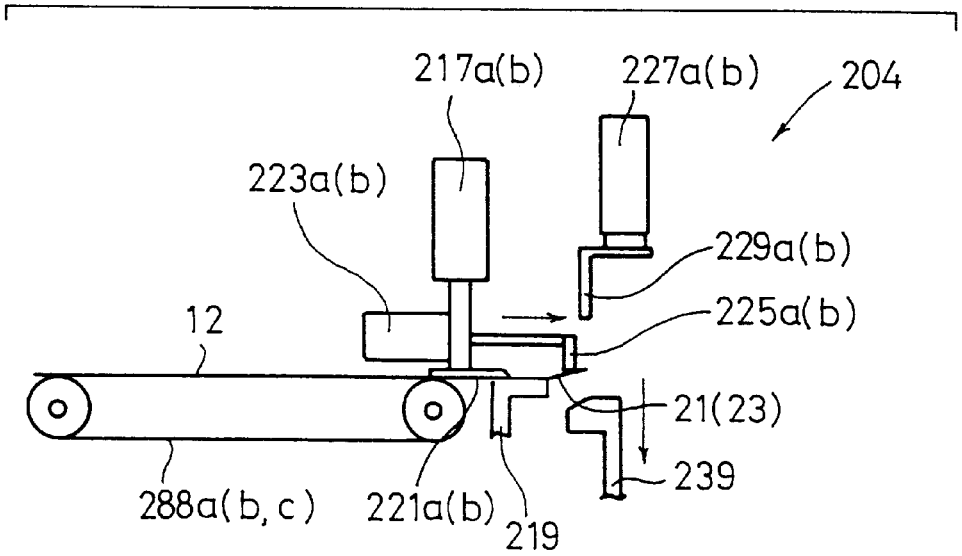
FIG. 50 is an elevational view showing the manner in which the protective cover is extended across the third and fourth fold lines by the second pre-folding mechanism in the protective cover pre-folding apparatus.

After the bending member 239 is lifted a predetermined distance, the bracket displacing cylinder 235 (see FIG. 7) is actuated to move the bending member 239 and the bracket 233 toward the bottom panel 14 and the top panel 16 of the protective cover 12 (see FIG. 49). Thereafter, the bending member 239 is lowered to fold the side panels 21, 23.

After the third fold line 22 and the fourth fold line 24 are produced, the bracket displacing cylinder 235 and the lifting and lowering cylinder 237 are actuated to retract the bending member 239 downwardly of the base 286. Then, the extending plate displacing cylinders 223*a*, 223*b* (see FIG. 7) are actuated to move the extending plates 225*a*, 225*b* toward the side panels 21, 23 for thereby returning the folded side panels 21, 23 to the original unfolded state (see FIG. 50).

When the third fold line 22 and the fourth fold line 24 are produced, the feed belts 288*a*, 288*b*, 288*c* are driven to feed the protective cover 12 to the lifting and lowering mechanism 206 shown in FIG. 8.

The protective cover 12 supplied to the lifting and lowering mechanism 206 is gripped and fed by the feed belts 249*a*, 249*b*, 249*c* and the rollers 257*a*, 257*b*. Thereafter, the bottom panel 14 and the top panel 16 of the protective cover 12 are held by the holder plates 263*a*, 263*b* of the holder mechanisms 259*a*, 259*b*, and the side panels 21, 23 are directionally positioned by the positioning plates 261*a*, 261*b*. When the protective cover 12 is thus positioned, the lifting and lowering cylinder 243 shown in FIG. 9 is actuated to move upwardly the lifting and lowering table 245 on which the protective cover 12 is placed.

The attracting and feeding mechanism 908 of the protective cover attracting and feeding apparatus 900 has been waiting above the lifting and lowering mechanism 206. When the lifting and lowering mechanism 245 is lifted to its upper limit position, the suction cups 922 (see FIG. 10) of the attracting and feeding mechanism 908 attract the bottom panel 14 and the top panel 16 of the protective cover 12. Then, the roller displacing cylinder 253 of the lifting and lowering mechanism 206 is actuated to move the rollers 257*a*, 257*b* to the leading side of the protective cover 12, and the cylinders 265*a*, 265*b* of the holder mechanisms 259*a*, 259*b* are actuated to retract the holder plates 263*a*, 263*b*, thus releasing the protective cover 12.

After the protective cover 12 is released, the lifting and lowering cylinder 918 of the attracting and feeding mechanism 908 is actuated to lift the suction cups 922 that are attracting the protective cover 12 by a predetermined distance. As a result, the protective cover 12 is transferred from the protective cover pre-folding apparatus 200 to the protective cover attracting and feeding apparatus 900. The attracting and feeding mechanism 908 which has attracted the protective cover 12 is moved by the belt 912 driven by the drive motor 210 along the guide rails 906*a*, 906*b* to the protective cover distributing and supplying apparatus 300.

The protective cover 12 fed to the protective cover distributing and supplying apparatus 300 is then transferred onto the protective cover transfer table 310 that has been waiting therebelow. The protective cover transfer table 310 has the suction holes 318 defined in the protective cover transfer surface 320 thereof. When the protective cover 12 attracted by the attracting and feeding mechanism 908 is lowered by the lifting and lowering cylinder 918 and placed on the protective cover transfer surface 320 of the protective cover transfer table 310, air is drawn through the suction holes 318, attracting the protective cover 12 against the protective cover transfer surface 320.

Whether the protective cover 12 has been transferred from the protective cover attracting and feeding apparatus 900 onto the protective cover distributing and supplying apparatus 300 is confirmed by detecting whether a there is a reflected beam from the pit 322 in the protective cover transfer table 310 or not with the protective cover sensor 324.

After the protective cover transfer table 310 attracts the protective cover 12, the displacing cylinder 316 is actuated to turn the protective cover transfer table 310 about the pivot shaft 312 to tilt the protective cover 12 such that a side thereof opposite to the side panels 21, 23 is directed downwardly. Then, the lifting and lowering cylinder 304 is actuated to move the protective cover transfer table 310 along the guide rails 302*a*, 302*b* to an upper or lower position.

The attracting and feeding mechanism 956A of the upper protective cover attracting and feeding apparatus 950A has been waiting in the upper position, and the attracting and feeding mechanism 956B of the lower protective cover attracting and feeding apparatus 950B has been waiting in the lower position (see FIG. 11). The upper protective cover attracting and feeding apparatus 950A feeds the protective cover 12 to the upper pack producing apparatus 400A, and the lower protective cover attracting and feeding apparatus 950B feeds the protective cover 12 to the lower pack producing apparatus 400B.

The attracting and feeding mechanism 956A is tilted an angle depending on the angular displacement of the protective cover transfer table 310. When the drive motor 964 is energized, the attracting and feeding mechanism 956A is moved to a position above the protective cover transfer table 310. Thereafter, the lifting and lowering cylinder 970 is actuated to lower the lifting and lowering plate 972 (see FIG. 12). Then, the turning cylinder 982 is actuated to cause the positioning tooth 978 to engage the top panel 16 of the protective cover 12, and the lifting and lowering cylinder 984 is actuated to cause the positioning tooth 980 to hold the side panels 21, 23 of the protective cover 12. Thereafter, the suction cups 974 attract the protective cover 12, and the protective cover transfer table 310 releases the protective cover 12, whereupon the protective cover 12 is transferred to the upper protective cover attracting and feeding apparatus 950A.

Similarly, if the protective cover transfer table 310 is disposed in the lower position, the protective cover 12 is transferred to the lower protective cover attracting and feeding apparatus 950B.

The attracting and feeding mechanism 956A, 956B which have attracted the protective covers 12 are moved by the belts 966 driven by the drive motors 964 along the guide rails 954*a*, 954*b* and the guide rails 962*a*, 962*b*, and thereafter supply the protective covers 12 to the pack producing apparatus 400A, 400B.

When the attracting and feeding mechanisms 956A, 956B have moved to positions above the pack producing apparatus 400A, 400B, the lifting and lowering cylinder 970 is actuated to lower the lifting and lowering plate 972 for placing the protective cover 12 in a region ranging from the guide plate 460*a* to the attracting table 456 (see FIG. 13). The protective cover 12 is positioned by the positioning pins 462*a* through 462*d* that abut against sides thereof. If a large-size protective cover is employed, then the positioning pins 462*c*, 462*d* are retracted downwardly, and the protective cover is placed in a region ranging from the guide plate 460*b* to the fixed table 454 and positioned by the positioning pins 462*a*, 462*b*, 462*e*, 462*f*.

As with the attracting and feeding mechanisms 956A, 956B, the pack producing apparatus 400A, 400B are tilted such that a side thereof opposite to the side panels 21, 23 and the top panel 16 are directed downwardly. Therefore, the protective cover 12 as it is tilted in the same direction is positioned in each of the pack producing apparatus 400A, 400B.

Figure 51:
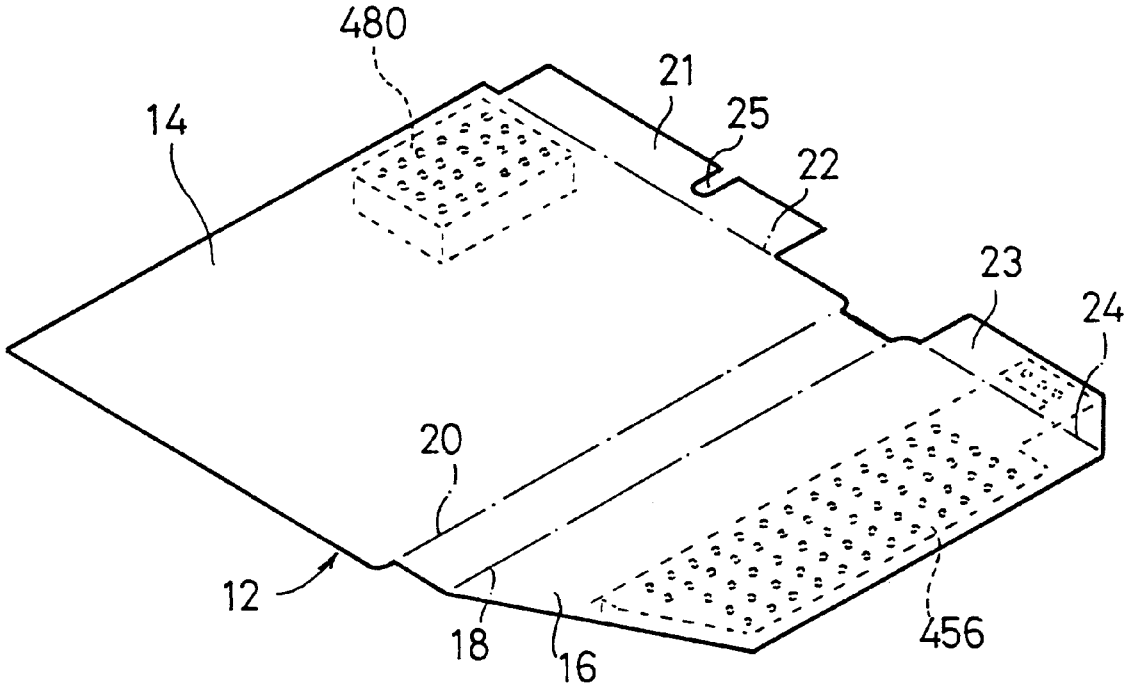
FIG. 51 is a perspective view showing the manner in which the protective cover is attracted in the pack producing apparatus.

After the protective cover 12 is positioned, as shown in FIG. 51, the top panel 16 and the side panel 23 thereof are attracted by the attracting table 456, and the bottom panel 14 thereof is attracted by the attracting table 480. The first fold line 18 of the protective cover 12 is positioned at the boundary between the arm 442*d* and the folding guide 407 shown in FIG. 13.

Figure 52:
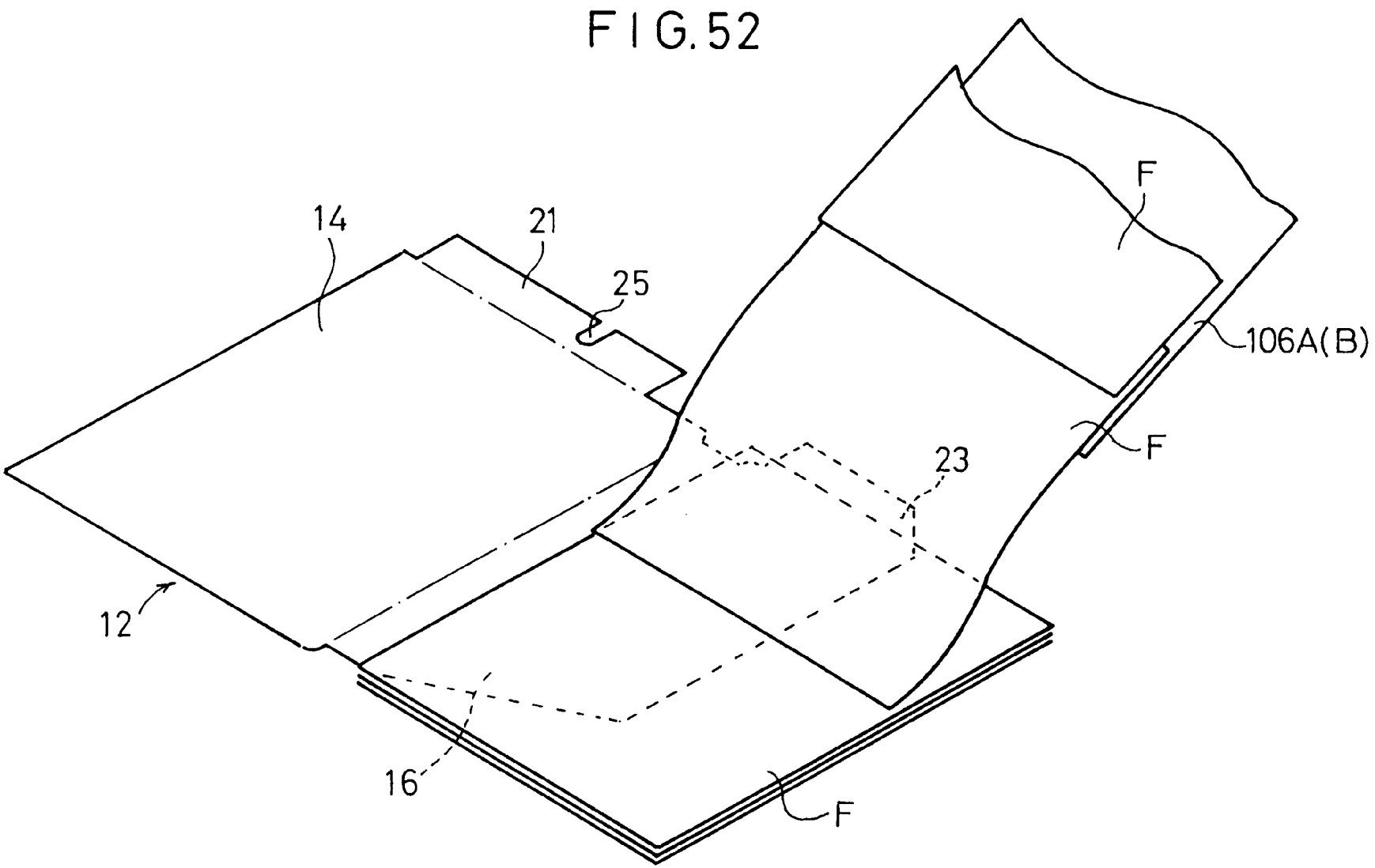
FIG. 52 is a perspective view showing the manner in which films are stacked on the protective cover in the pack producing apparatus.
Figure 53:
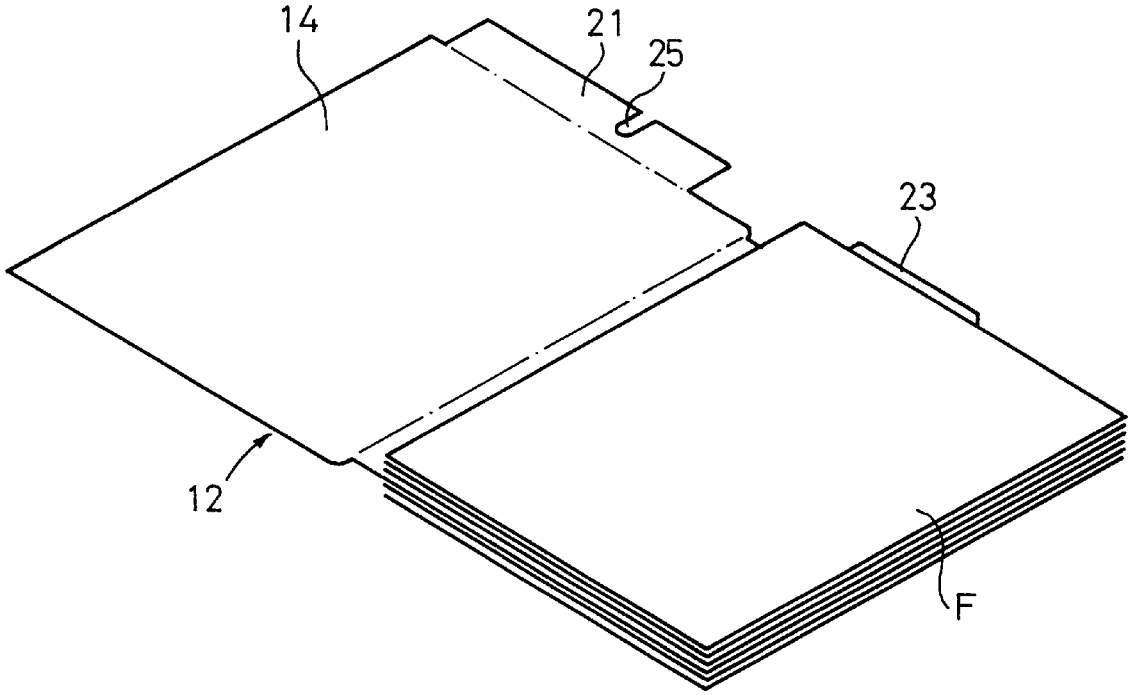
FIG. 53 is a perspective view showing the manner in which films are stacked on the protective cover in the pack producing apparatus.

Then, a film F is supplied from the film supply apparatus 100 onto the protective cover 12 in each of the pack producing apparatus 400A, 400B. Specifically, as shown in FIG. 2, the roll film 36 supplied from the carriage 108 is cut off into films F of predetermined length, which are distributed to the upper film feed line 106A and the lower film feed line 106B. The films F are then stacked on a protective cover 12, as shown in FIGS. 52 and 53. Since the second slide table 440 is tilted downwardly as shown in FIG. 15, the films F are stacked in abutment against the guide plates 458*c*, 458*d*. Since the pack producing apparatus 400A, 400B are tilted such that a side of the protective cover 12 opposite to the side panels 21, 23 and the top panel 16 are directed downwardly, the films F are not stacked on the bottom panel 14, but accurately stacked in a desired position on the top panel 16.

If large-size films are to be stacked on a large-size protective cover, then the guide plate 458*c* is removed, and the second slide table 440 with the large-size protective cover fixedly placed thereon is turned 90° by the turntable drive motor 408 (see FIG. 15) such that the bottom panel of the large-size protective cover is positioned upstream. Thereafter, the films are stacked on the arms 442*a* through 442*d* of the second slide table 440.

After a predetermined number of films F are stacked, the protective cover 12 in each of the pack producing apparatus 400A, 400B is folded. The process of folding the protective cover 12 will be described below with reference to FIGS. 54 through 60.

Figure 54:
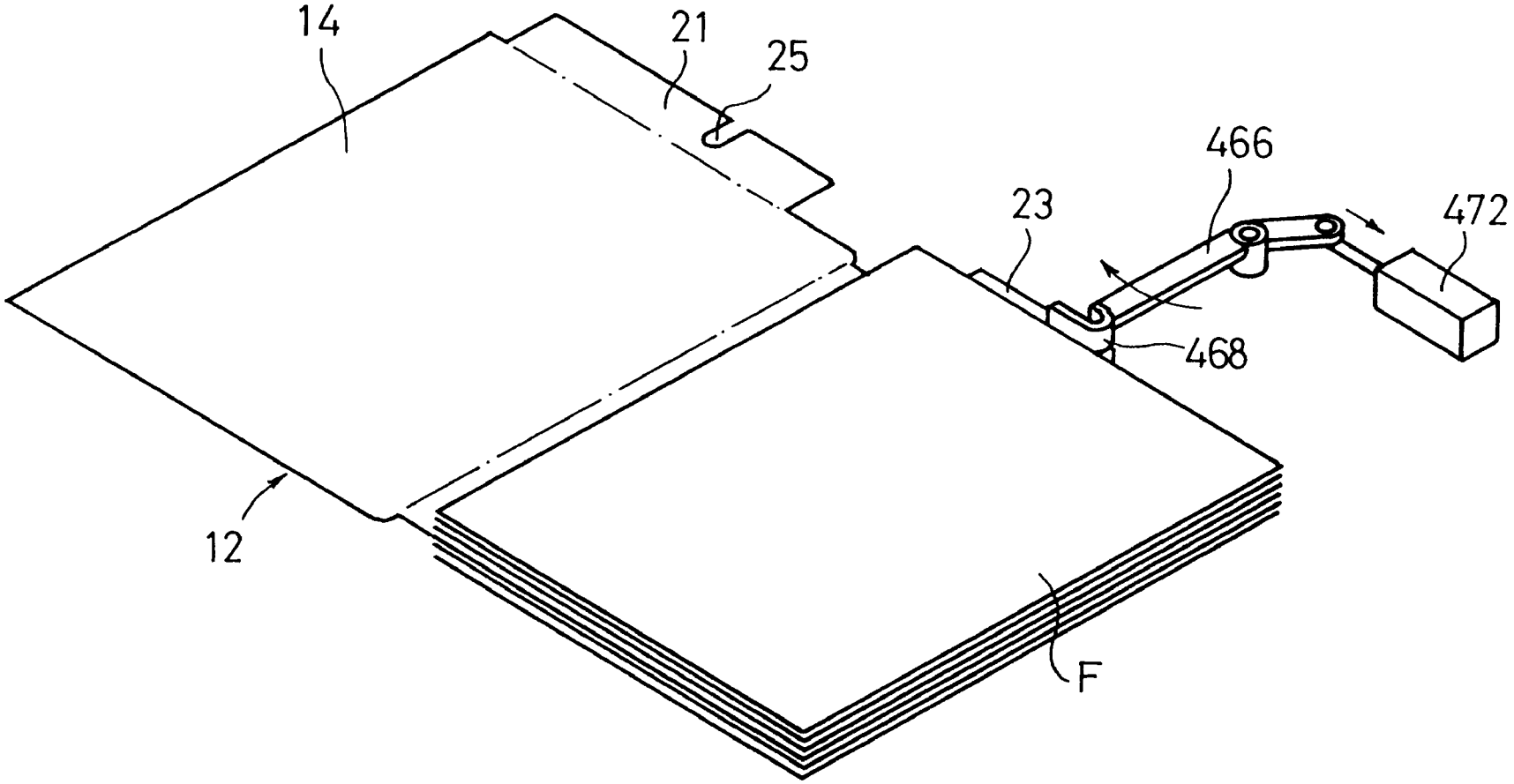
FIG. 54 is a perspective view showing the manner in which a side panel holder guide in the pack producing apparatus operates.
Figure 55:
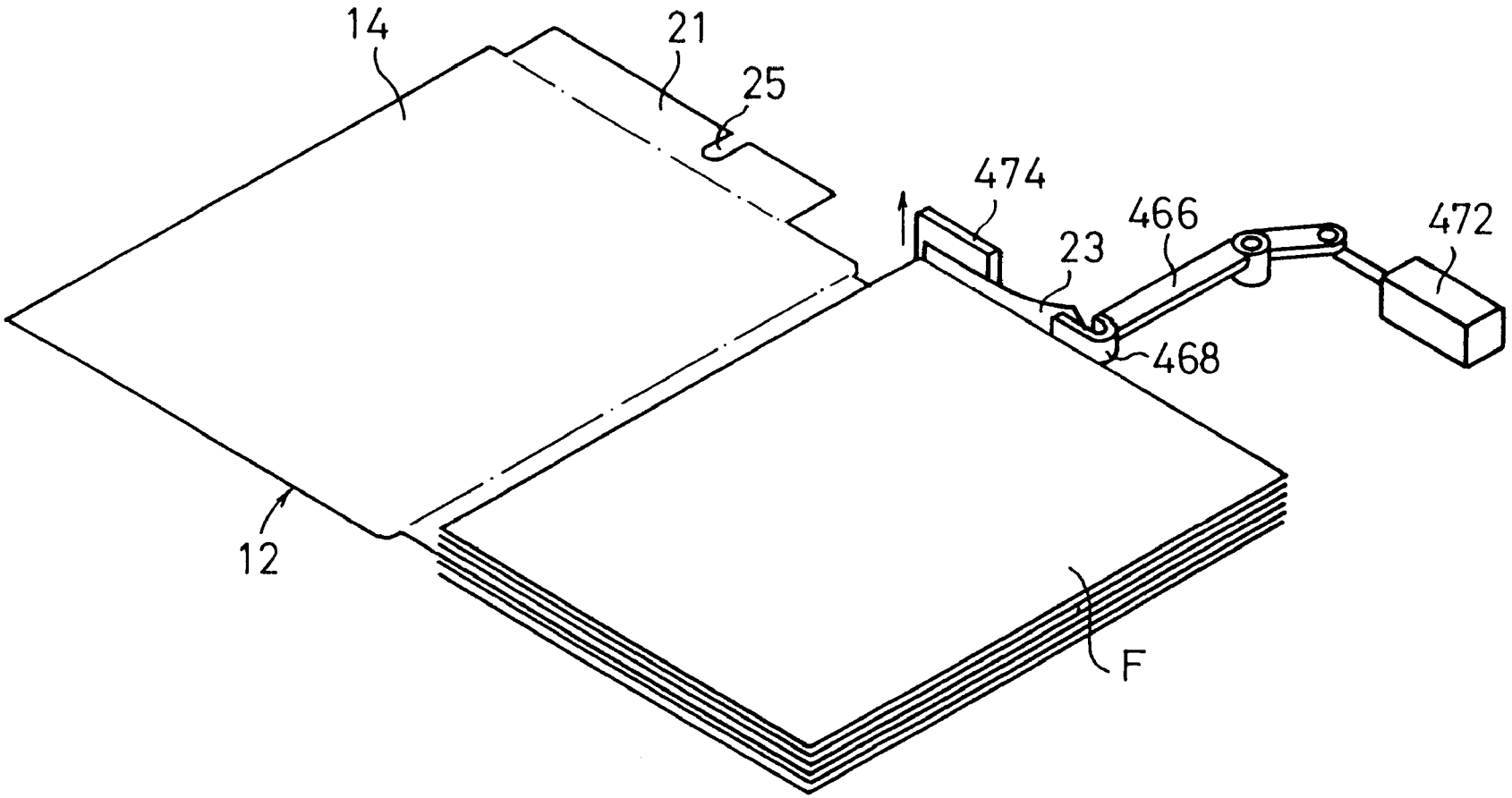
FIG. 55 is a perspective view showing the manner in which the raising guide in the pack producing apparatus operates.

After a predetermined number of films F have been stacked on the top panel 16 of the protective cover 12, the guide drive cylinder 472 is actuated to turn the side panel holder guide 466 that is pivotally supported on the support plate 470 to position the engaging finger 468 above the side panel 23 (see FIG. 54). When the guide drive cylinder 476 (see FIG. 18) is then actuated, the raising guide 474 pivotally supported on the bracket 478 is angularly moved to a position above the second slide table 440 (see FIG. 55). At this time, the side panel 23 is raised by the raising guide 474. Since an end of the side panel 23 is engaged by the engaging finger 468, the side panel 23 is twisted.

Figure 56:
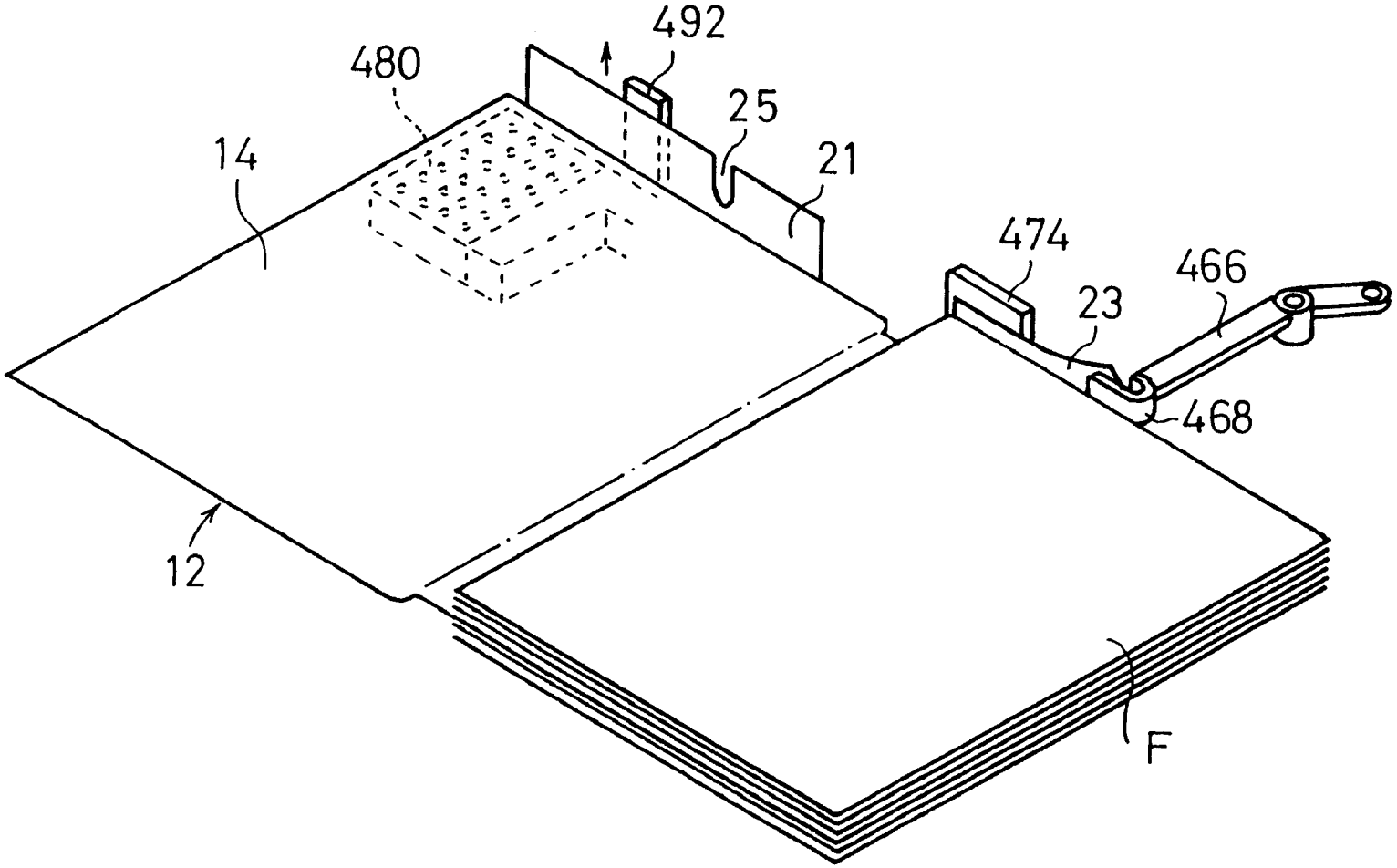
FIG. 56 is a perspective view showing the manner in which the raising guide in the pack producing apparatus operates.
Figure 57:
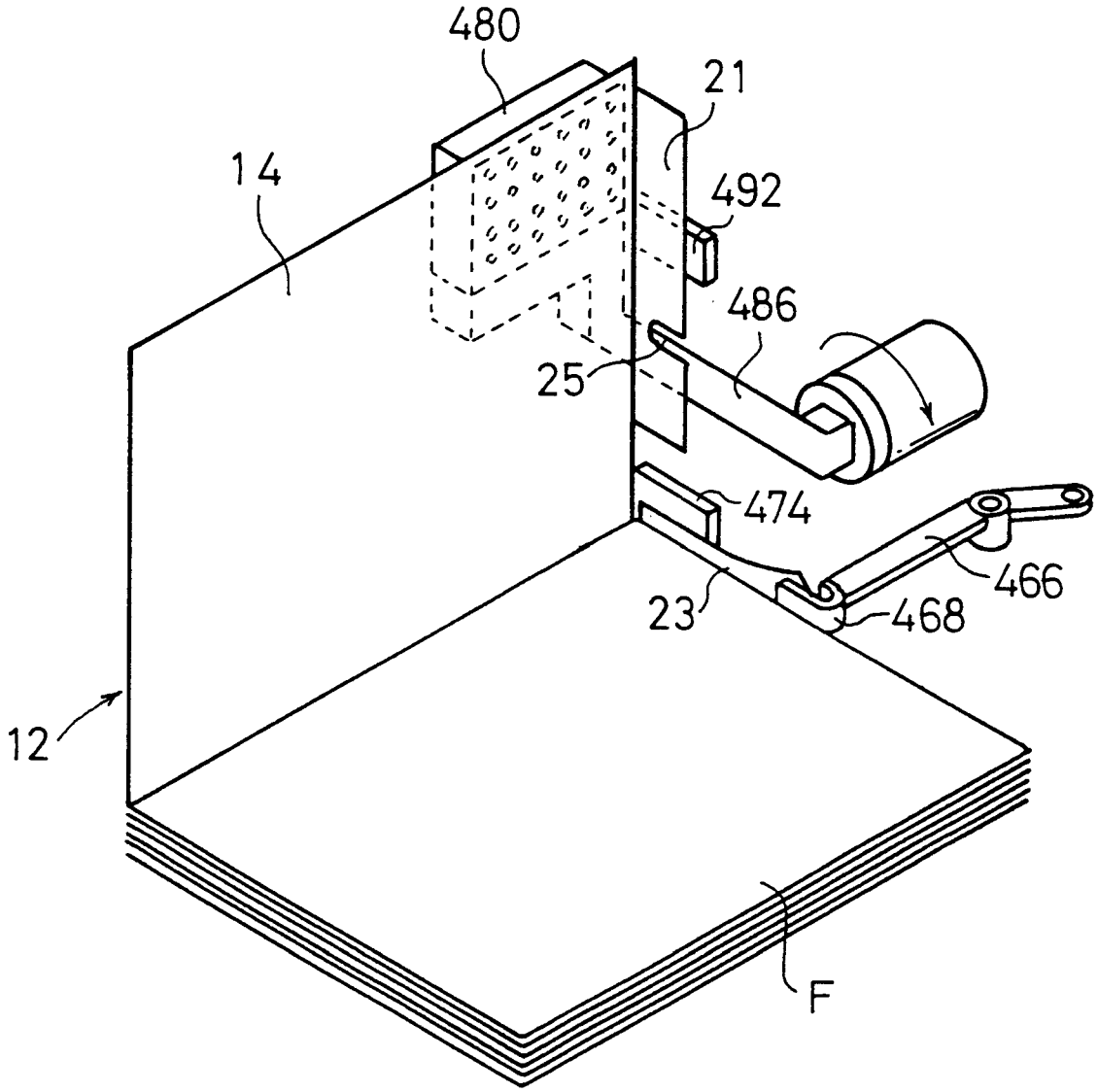
FIG. 57 is a perspective view showing the manner in which an attracting table and the raising guide in the pack producing apparatus operates.

Then, as shown in FIG. 19, when the guide drive cylinder 494 is lowered, the raising guide 492 is turned to project along a side of the attracting table 480, thus raising the side panel 21 of the protective cover 12 (see FIG. 56). Then, the attracting table turning cylinder 482 is actuated to displace the rack 484 (see FIG. 13), the pinion 488 meshing with the rack 484 is rotated to turn the arm 486 about the bearing 490. Therefore, the bottom panel 14 attracted by the attracting table 480 coupled to the arm 486 is raised (see FIG. 57).

Figure 58:
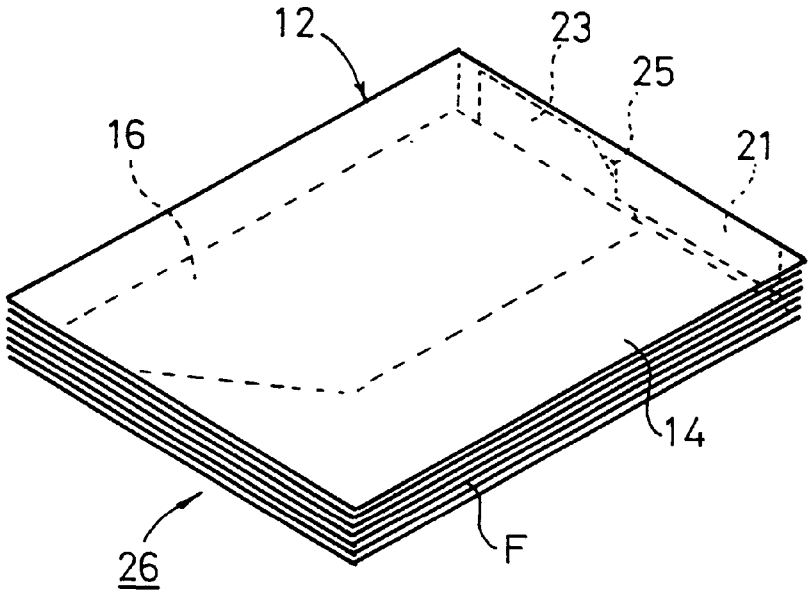
FIG. 58 is a perspective view of a pack produced by the pack producing apparatus.
Figure 59:
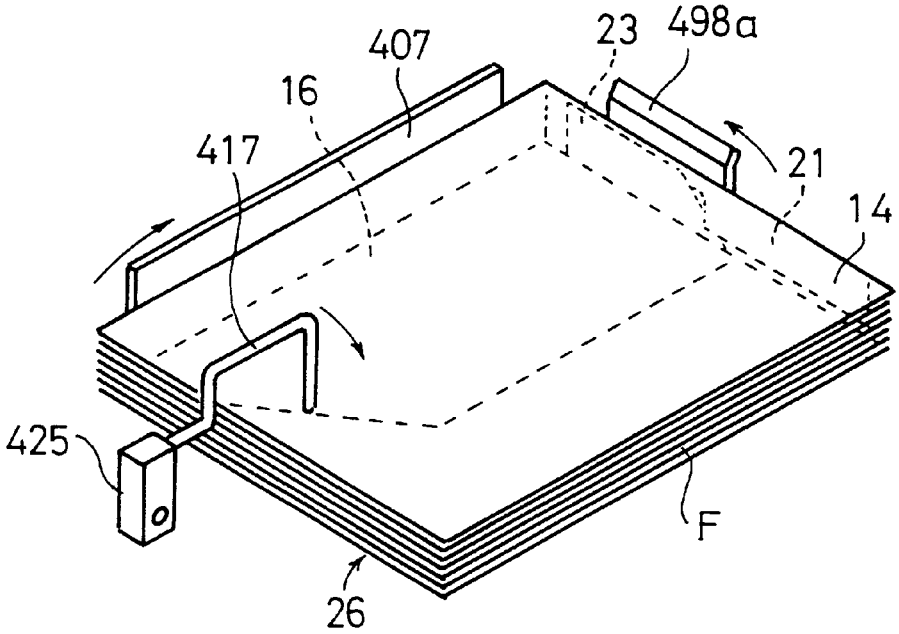
FIG. 59 is a perspective view showing the manner in which a pack holder, a folding guide, and a protective cover holder in the pack producing apparatus operates.
Figure 60:
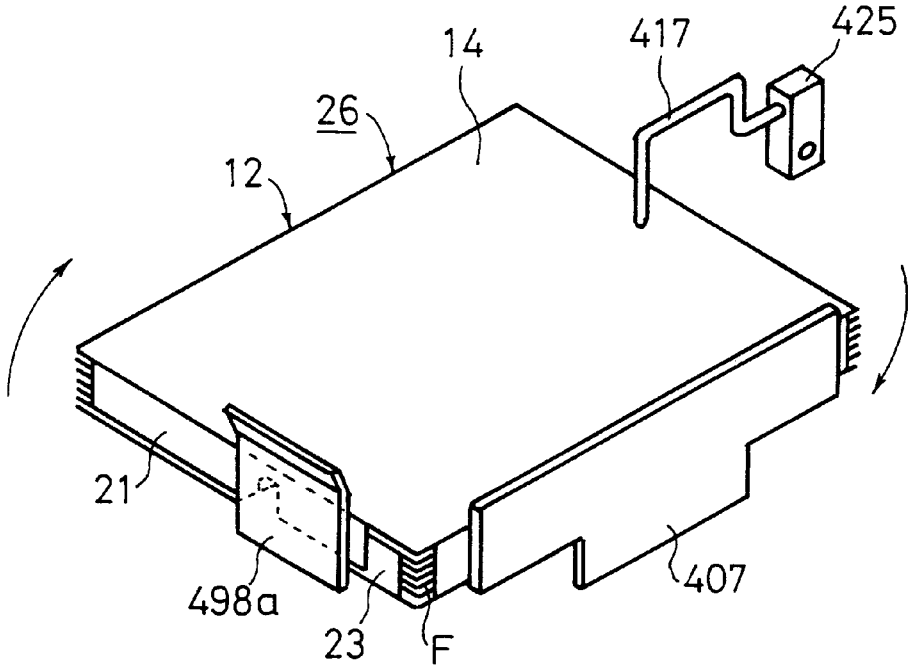
FIG. 60 is a perspective view showing the manner in which a slide table in the pack producing apparatus turns.

When the arm 486 is turned about 180°, as shown in FIG. 58, the side panels 21, 23 engage each other. Specifically, the portion of the side panel 21 which extends from the slit 25 toward the top panel 16 engages an outer surface of the side panel 23 that is raised by the raising guide 474, and the remaining portion of the side panel 21 engages an inner surface of the side panel 23 that is twisted by the engaging finger 468.

As described above, the protective cover 12 is folded to complete a pack 26.

Then, the holder drive cylinder 401 shown in FIG. 20 is actuated to cause the springs 405 coupled to the arms 442*b*, 442*c* of the second slide table 440 to raise the pack holders 498*a*, 498*b* thereby to hold the side panels 21, 23 from their outer surfaces. When the guide drive cylinder 415 shown in FIG. 21 is actuated to cause the spring 411 coupled to the arm 442*d* of the second slide table 440 to raise the folding guide 407 thereby to hold the back of the pack 26 which interconnects the bottom panel 14 and the top panel 16. When the rotary actuator 419 shown in FIG. 22 is actuated to cause the link 421, the connecting rod 423, and the link 425 to turn the protective cover holder 417 until its tip end holds the bottom panel 14 of the protective cover 12 (see FIG. 59). In this manner, the pack 26 is fixed to each of the pack producing apparatus 400A, 400B.

When the pack 26 is fixed, the bottom panel 14 is released from the attracting table 480, and the side panel holder guide 466, the raising guide 474, the attracting table 480, and the raising guide 492 return their original Positions. Then, the turntable drive motor 408 is energized to cause the gears 410, 412 to turn the first slide table 430 and the second slide table 440 by 180° (see FIG. 60). At this time, the side panels 21, 23 of the protective cover 12 are positioned closely to the pack inverting apparatus 500.

Figure 61:
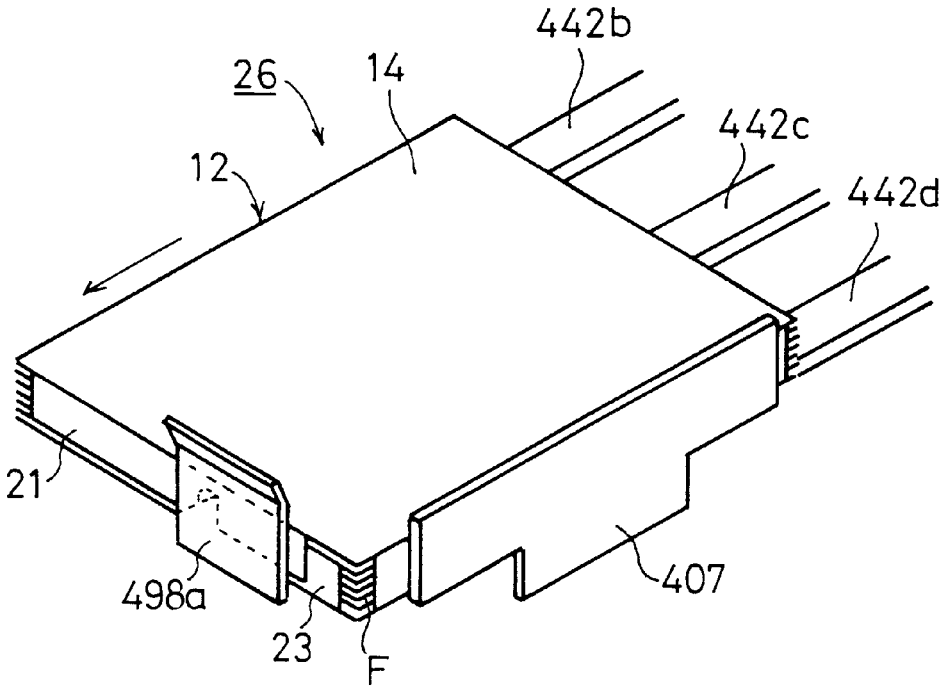
FIG. 61 is a perspective view showing the manner in which the slide table in the pack producing apparatus moves.

Then, when the rodless cylinder 414 (see FIGS. 16 and 17) is actuated, the displacement member 420 is displaced to move the first slide table 430 toward the pack inverting apparatus 500 (see FIG. 23). As the first slide table 430 is thus moved, the slide table drive belt 446 is operated to move the second slide table 440 on which the pack 26 is placed toward the pack inverting apparatus 500 by a greater distance than the first slide table 430 (see FIG. 61).

Figure 62:
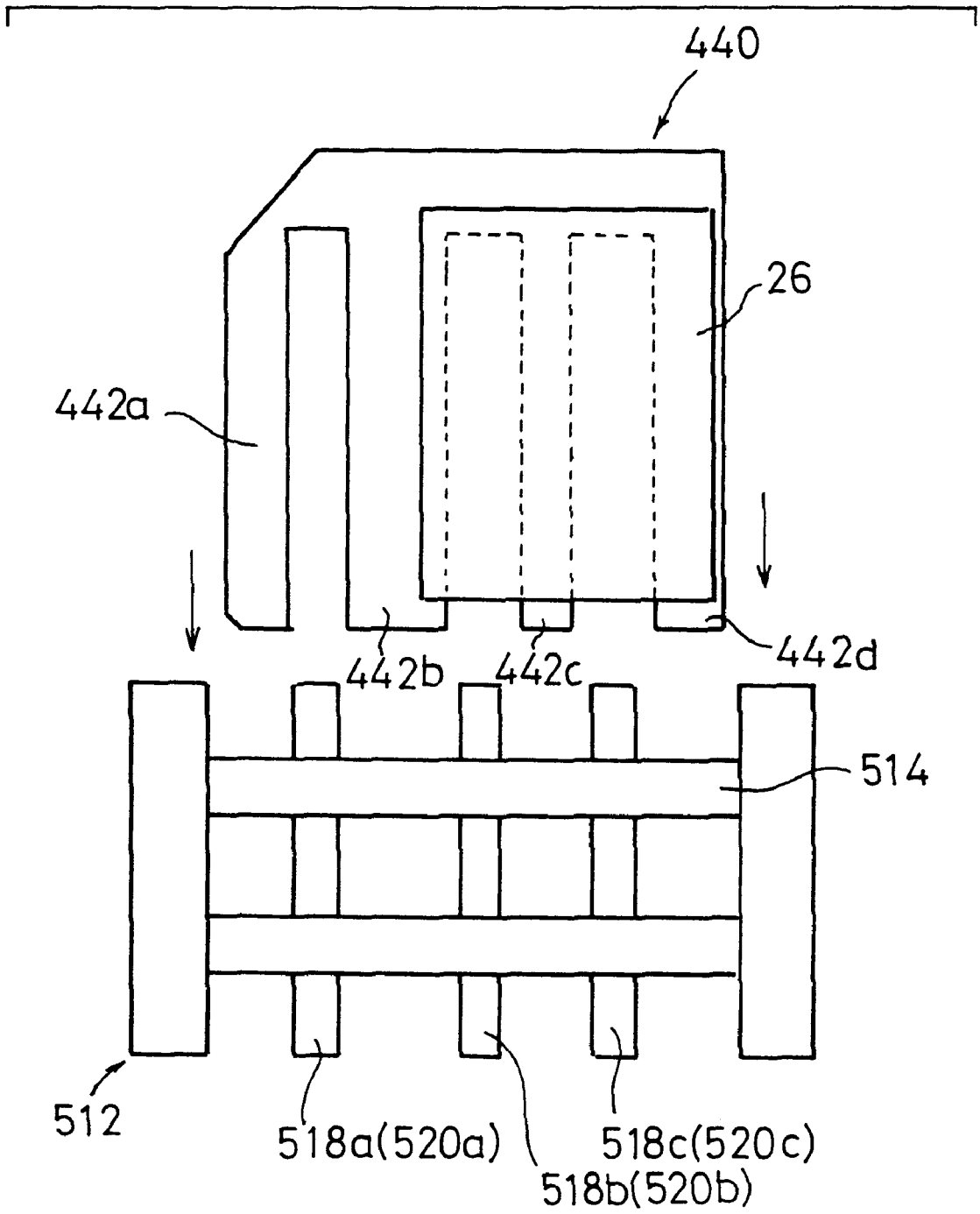
FIG. 62 is a plan view showing the manner in which a second slide table of the pack producing apparatus moves toward an inverting mechanism of a pack inverting apparatus.

As shown in FIGS. 25 and 62, the inverting mechanism 512 of the pack inverting apparatus 500 has been waiting downstream of the pack producing apparatus 400A, 400B. The pack 26 is supplied to the inverting mechanism 512. As shown in FIG. 23, the inverting mechanism 512 has been waiting in the upper position when the pack 26 is received from the pack producing apparatus 400A, and waiting in the lower position when the pack 26 is received from the pack producing apparatus 400B.

Figure 63:
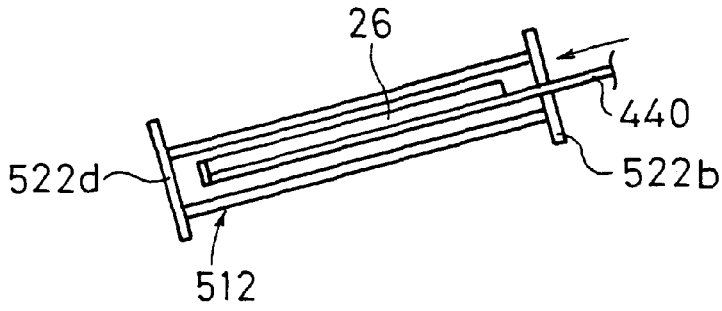
FIG. 63 is an elevational view showing the second slide table of the pack producing apparatus which is inverted into the inverting mechanism of the pack inverting apparatus.

The arms 442*b*, 442*c*, 442*d* of the second slide table 440 of the pack producing apparatus 400A, 400B are inserted between the support bars 518*a*, 518*b*, 518*c* and 520*a*, 520*b*, 520*c* of the inverting mechanism 512 (see FIG. 63).

When the pack 26 and the second slide table 440 are inserted into the inverting mechanism 512, the frame opening and closing cylinders 526*a*, 526*b* (see FIG. 25) are actuated to cause the racks 528*a*, 528*b* to displace the support bars 518*a*, 518*b*, 518*c* and the support bars 520*a*, 520*b*, 520*c* toward each other along the guide rails 522*a*, 522*b*, 522*c*, 522*d*, thus gripping the pack 26.

Figure 64:
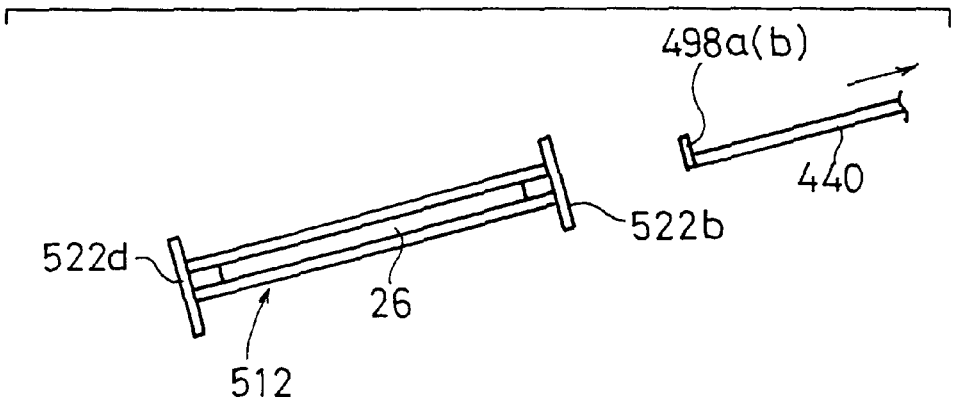
FIG. 64 is an elevational view showing the manner in which a pack is gripped by the inverting mechanism of the pack inverting apparatus.

After the pack 26 is gripped, the first slide table 430 and the second slide table 440 of the pack producing apparatus 400A, 400B return to their original positions (see FIG. 64). Upon return of the second slide table 440 to its original position, the inverting mechanism 512 is lifted a predetermined distance to move the pack holders 498*a*, 498*b* away from the pack 26 to avoid interference between the second slide table 440 and the pack 26.

Figure 65:
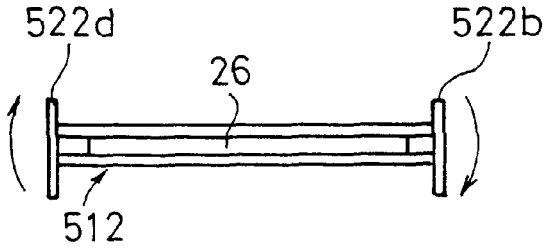
FIG. 65 is an elevational view showing the manner in which the pack is inverted by the inverting mechanism of the pack inverting apparatus.

Then, the frame inverting motor 536 is energized to cause the smaller gear 534 and the larger gear 532 (see FIG. 25) to invert the inverting mechanism 512 which grips the pack 26 for thereby placing the pack 26 in a horizontal state with the top panel 16 of the protective cover 12 facing upwardly (see FIG. 65).

After the pack 26 is inverted, the inverting mechanism displacing motor 540 (see FIG. 24) is energized to rotate the ball screw 538 to cause the tables 510*a*, 510*b* to lift or lower the inverting mechanism 512 to a position corresponding to the pack carriage 610 of the pack feeding apparatus 600 that is waiting downstream.

The pack 26, which is relatively heavy, is easily and reliably inverted without being disintegrated because it is inverted while being gripped by the upper frame 514 and the lower frame 516. The protective cover 12 is folded in each of the pack producing apparatus 400A, 400B, and the pack 26 is inverted by the pack inverting apparatus 500. These apparatus can be made smaller in size than if the protective cover 12 were folded and the pack 26 were inverted by one apparatus.

Then, the pack 26 is fed from the pack inverting apparatus 500 to the pack feeder 710 of the package producing apparatus 700 by the pack feeding apparatus 600. Such a process of feeding the pack 26 will be described below with reference to FIGS. 66 through 69.

Figure 66:
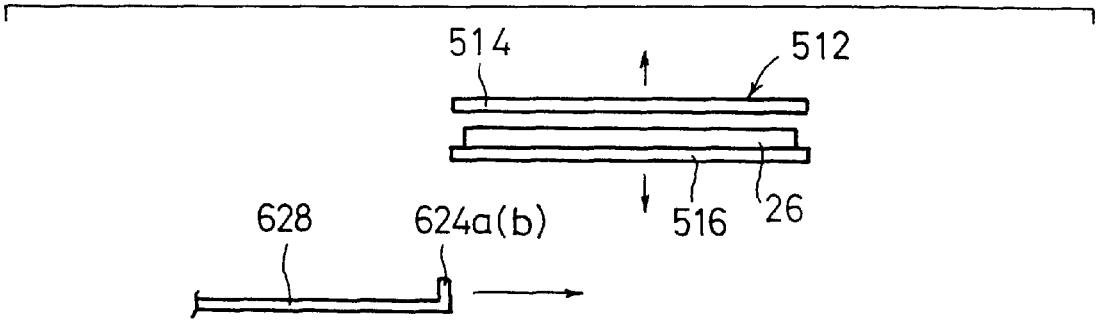
FIG. 66 is an elevational view showing the manner in which the pack is removed from the inverting mechanism by a package carriage in a pack feeding apparatus.
Figure 67:
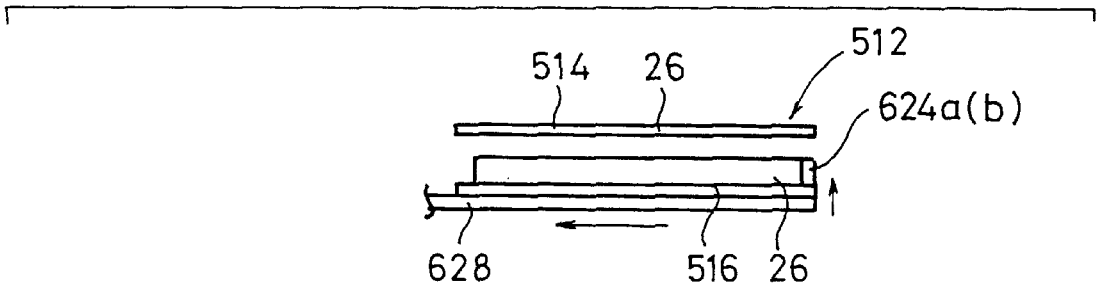
FIG. 67 is an elevational view showing the manner in which the pack is removed from the inverting mechanism by the package carriage in the pack feeding apparatus.
Figure 68:
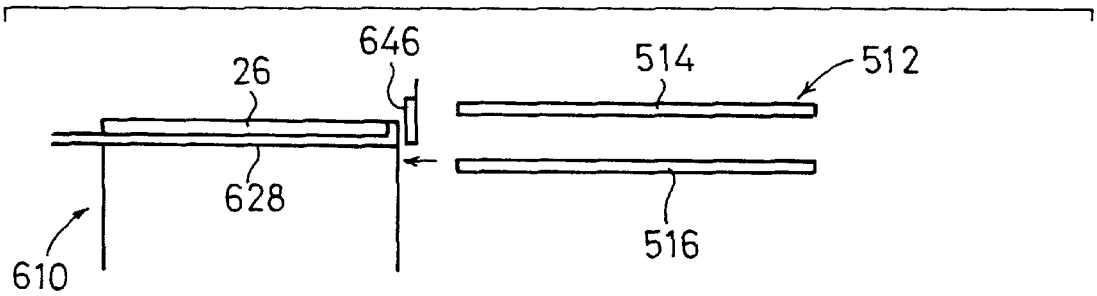
FIG. 68 is an elevational view showing the manner in which the pack is removed from the package carriage by the pack delivery machine in the pack feeding apparatus.
Figure 69:
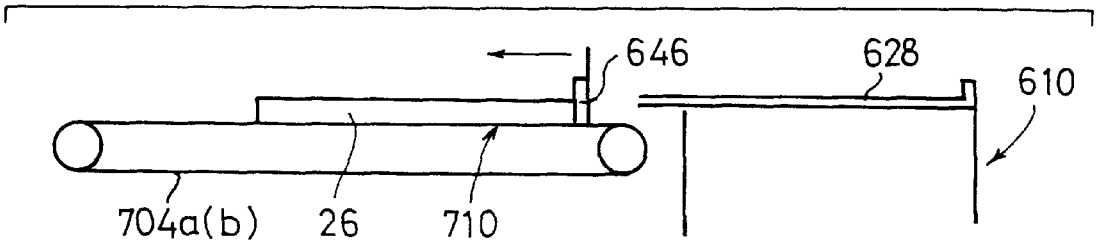
FIG. 69 is an elevational view showing the manner in which the pack is transferred to the pack feeder by the pack delivery machine in the pack feeding apparatus.

After the inverting mechanism 512 of the pack inverting apparatus 500 is placed in a given position while holding the pack 26, the frame opening and closing cylinders 526*a*, 526*b* are actuated to move the upper frame 514 and the lower frame 516 away from each other (see FIG. 66). Then, the pack drawing arm 628 of the pack carriage 610 of the pack feeding apparatus 600 is displaced to a position below the inverting mechanism 512 by the displacing cylinder 618 (see FIG. 26).

Then, the lifting and lowering cylinder 614 is actuated to lift the pack drawing arm 628 into abutment against the bottom panel 14 of the pack 26 between the support bars 518*a*, 518*b*, 518*c* of the inverting mechanism 512. The fingers 624*a*, 424*b* fixed to the pack drawing arm 628 engage a side of the pack 26 that is positioned upstream (see FIG. 67).

After the fingers 624*a*, 424*b* engage the side of the pack 26, the displacing cylinder 618 is actuated to displace the pack drawing arm 628. The pack 26 is now removed from the inverting mechanism 512 by the fingers 624*a*, 624*b*, and transferred onto the pack carriage 610. As shown in FIG. 26, the pack 26 is held on the pack carriage 610 by the gate plate 636 disposed downstream of the pack carriage 610, the fingers 624*a*, 624*b*, and the pack holder plates 630*a*, 630*b* disposed above the pack 26.

The pack carriage 610 which holds the pack 26 is moved along the guide rails 602*a*, 602*b* to a position below the pack delivery machine 620, after which the gate opening and closing cylinder 632 is actuated to bring down the gate plate 636 for thereby allowing the pack 26 to be removed. The, displacing cylinder 645 of the pack delivery machine 620 is actuated to lower the pack remover 646 between the pack holder plates 630*a*, 630*b* (see FIG. 68), after which the self-propelled unit 644 is actuated to move toward the pack feeder 710 along the guide rails 642*a*, 642*b*. The pack 26 is now removed from the pack carriage 610, and placed on the support plate 716 (see FIG. 28) of the pack feeder 710 (see FIG. 69).

A process of feeding the pack 26 with the pack feeder 710 of the package producing apparatus 700 will be described below with reference to FIGS. 70 through 75.

Figure 70:
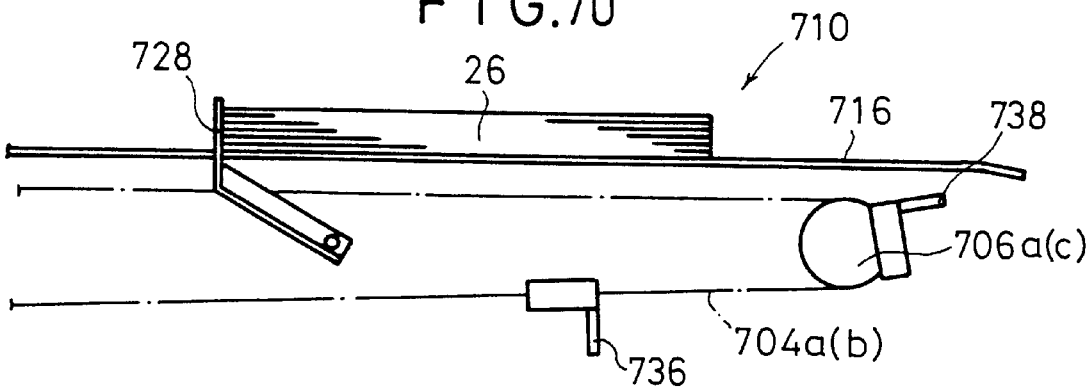
FIG. 70 is an elevational view showing the manner in which the pack is transferred to the pack feeder of the package producing apparatus.
Figure 71:
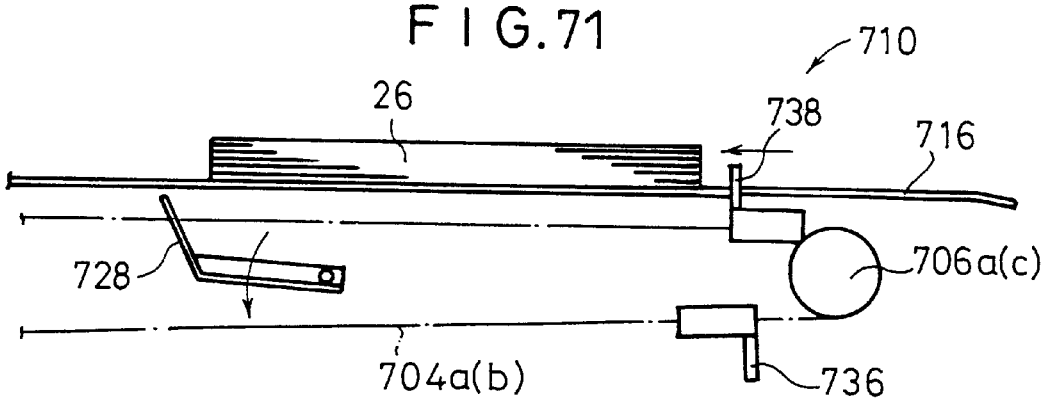
FIG. 71 is an elevational view showing the manner in which a chain belt starts being driven in the pack feeder of the package producing apparatus.
Figure 72:
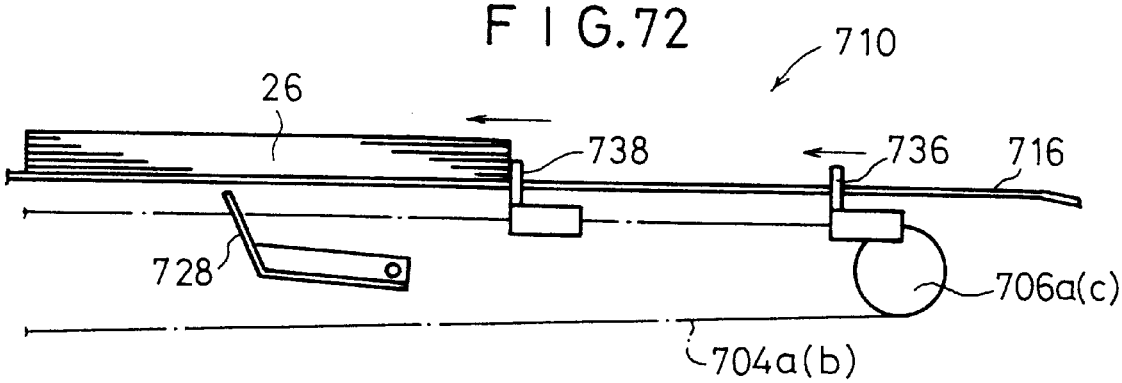
FIG. 72 is an elevational view showing the manner in which the pack is fed by movable fingers in the pack feeder of the package producing apparatus.
Figure 73:
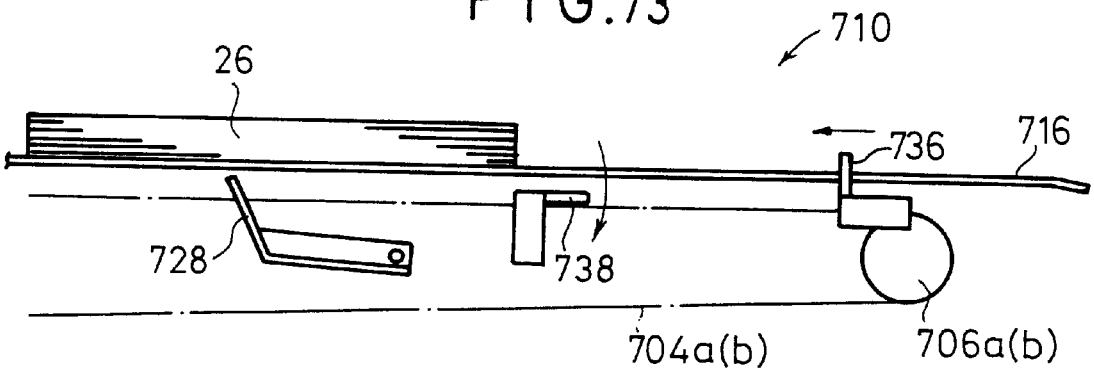
FIG. 73 is an elevational view showing the manner in which the movable fingers are retracted in the pack feeder of the package producing apparatus.
Figure 74:
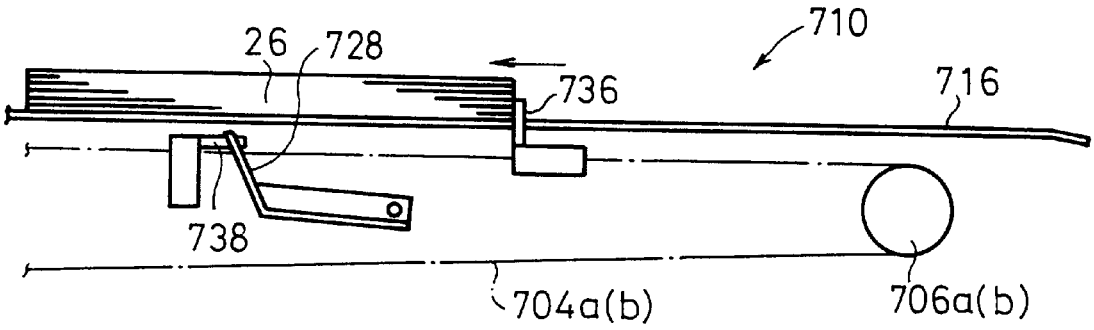
FIG. 74 is an elevational view showing the manner in which the pack is fed by fixed fingers in the pack feeder of the package producing apparatus.

When the pack delivery machine 620 moves the pack 26 downstream in the pack feeder 710, the leading end of the pack 26 abuts against the positioning plate 728 projecting upwardly from the hole 726 in the support plate 716, and the pack 26 is positioned by the positioning plate 728 (see FIG. 70). At this time, the chain belts 704*a*, 704*b* of the pack feeder 710 are held at rest. Then, at the same time that the chain belts 704*a*, 704*b* start being driven, the positioning plate drive cylinder 734 is actuated to retract the positioning plate 728 downwardly of the support plate 716 (see FIG. 71).

Figure 75:
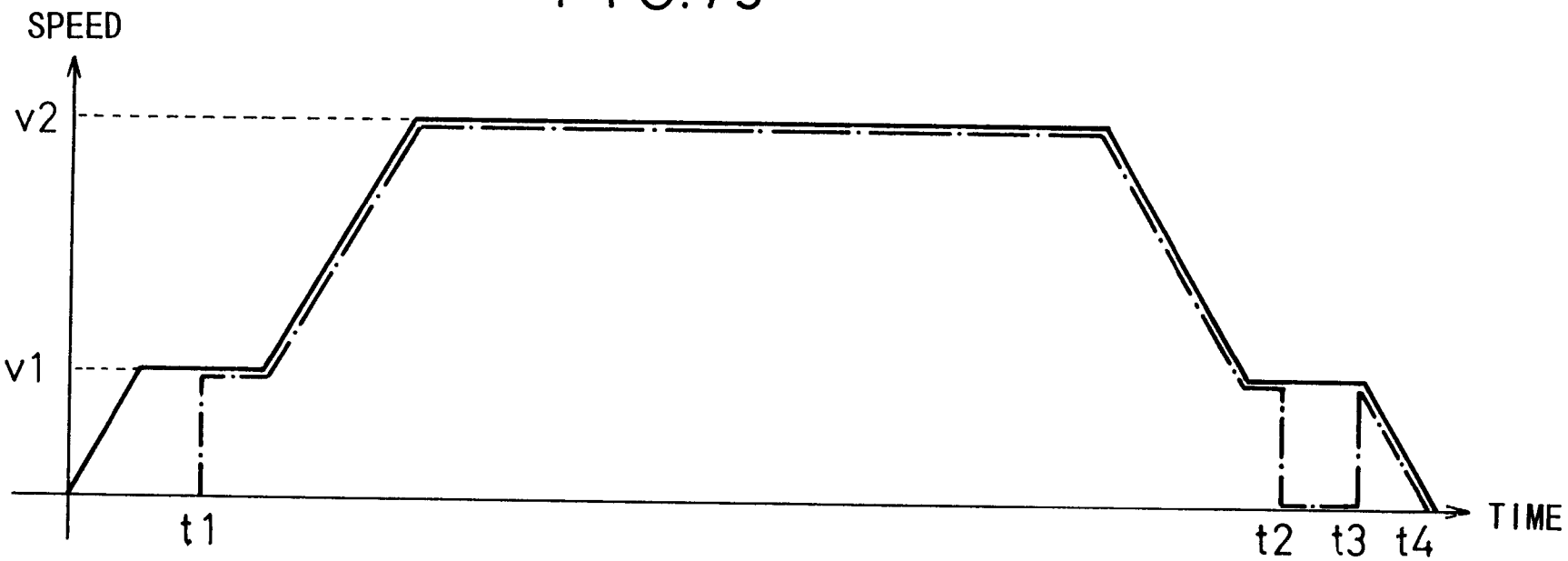
FIG. 75 is a timing chart of operation of the pack feeder of the package producing apparatus.

When the chain belts 704*a*, 704*b* are driven and the rollers 744*a* of the movable fingers 738 start rolling on the guide plate 740*a*, the movable fingers 738 project upwardly (see FIGS. 29 and 30). The speed of the chain belts 704*a*, 704*b* gradually increases up to a low speed v1 (see FIG. 75), after which the speed temporarily becomes constant. At a time t1 while the chain belts 704*a*, 704*b* are driven at the constant speed v1, the movable fingers 738 coupled to the chain belts 704*a*, 704*b* but against the trailing end of the pack 26, which then starts being fed (see FIG. 72). Since the movable fingers 738 abut against the pack 26 at the low speed v1, the films F stacked on the protective cover 12 are not caused to project in the direction in which the pack 26 is fed. In FIG. 75, the solid-line curve represents the speed at which the chain belts 704*a*, 704*b* move, and the dot-and-dash-line curve represents the speed at which the pack 26 is fed.

After the pack 26 starts being fed by the movable fingers 738, the speed of the chain belts 704*a*, 704*b* increases up to a speed v2 higher than the speed v1, after which the speed of the chain belts 704*a*, 704*b* becomes constant. Since the acceleration of the pack 26 is small, the films F in the pack 26 are prevented from project when the speed of the chain belts 704*a*, 704*b* increases.

Then, the chain belts 704*a*, 704*b* are decelerated to the low speed v1, whereupon the movable fingers 738 that have fed the pack 26 are retracted downwardly. Specifically, as shown in FIGS. 29 and 30, each guide plate 740*a* has the recess 742 of predetermined size defined therein. When the pack 26 is fed the distance L1 by the movable fingers 738 until the rollers 744*a* of the movable fingers 738 reach the recesses 742, the rollers 744*a* disengage from the guide plates 740*a* and fall into the recesses 742. Therefore, the movable fingers 738 are retracted downwardly. As a result, the pack 26 temporarily stops being fed at a time t2.

Since the fixed fingers 736 have the rollers 744*a*, 744*b* on its both sides, they remain projecting upwardly even when it reaches the recesses 742 in the guide plates 740*a*. The chain belts 704*a*, 704*b* are continuously moving, bringing the fixed fingers 736 into abutment against the trailing end of the pack 26 at a time t3, whereupon the pack 26 is fed again the low speed v1 for the distance L2 (see FIGS. 29 and 74). At a time t4, when the chain belts 704*a*, 704*b* stop moving, the pack 26 also stops being fed. Inasmuch as the fixed fingers 736 abut against the pack 26 at the low speed v1, the films F are prevented from projecting from the protective cover 12.

As shown in FIG. 29, with the fixed fingers 736 abutting against the trailing end of the pack 26, the pack 26 is temporarily stopped at a position to which it has been fed a distance (L1+L2) from the position where the pack 26 is initially charged from the pack delivery machine 620. When the chain belts 704*a*, 704*b* are actuated again, the positioning plate 728 is retracted downwardly, and the pack 26 is fed the distance L3 by the fixed fingers 736 at a speed equal to or lower than the low speed v1, and is thereafter stopped. The above process of feeding the pack 26 is repeated until it is supplied to the pack inserter 720 without the films F projecting out of the pack 26. The distance L3 is selected to be equal to the length of the light-shielding bag 28. Since the speeds at which the pack 26 is fed and the positions in which the pack 26 is stopped are determined by the fixed fingers 736 disposed behind the movable fingers 738, the pack 26 can efficiently be fed without a reduction in the speeds at which it is fed and also without an increase in the cycle time.

Figure 32:
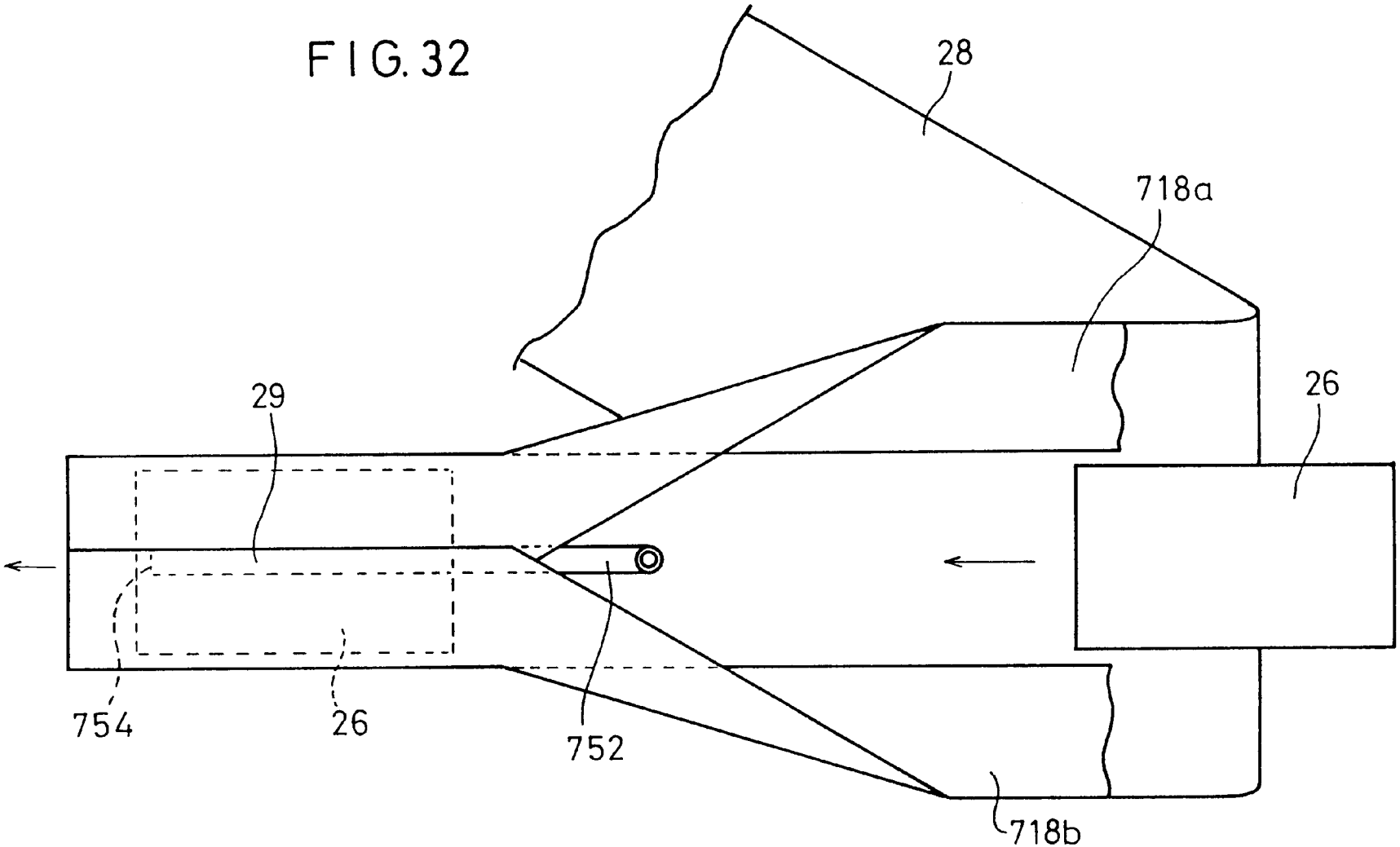
FIG. 32 is a bottom view of the pack inserter of the package producing apparatus.

In the pack inserter 720, the feed belts 748*a*, 748*b*, 748*c* are being driven in synchronism with the chain belts 704*a*, 704*b* in the pack feeder 710. The pack inserter 720 inserts the pack 26 into a light-shielding bag 28 that is supplied from above. Specifically, as shown in FIG. 31, the pack 26 is fed while being griped by the feed belt 748*a* and the rubber belts 750*a*, 750*b*. While the pack 26 is being thus fed, it is progressively inserted into the light-shielding bag 28 that is supplied from above, as shown in FIG. 32. Overlapping edges of the light-shielding bag 28 beneath the pack 26 are fused with heat by the mating surface sealer 756 that is disposed below the feed belt 748*a*. The front end of the light-shielding bag 28 is cut off by the front flap cutter sealer 758, leaving the front flap 30, and the pack 26 is also fused with heat near its front end.

Figure 76:
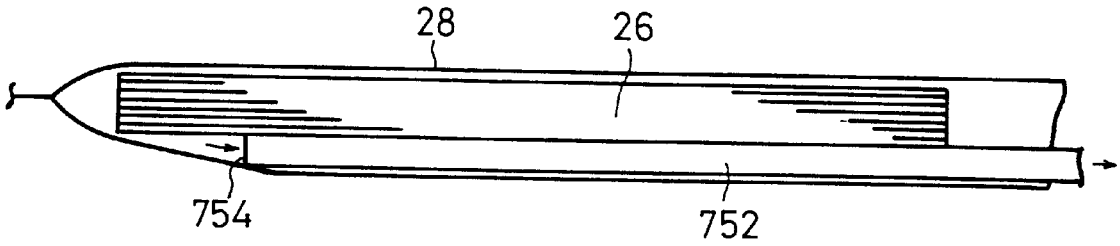
FIG. 76 is a cross-sectional view showing the manner in which a pack inserter of the package producing apparatus operates.

The air removal pipe 752, which is inserted between the feed belt 748*a* and the pack 26, draws air from within the light-shielding bag 28 whose front end and lower mating edges have been fused with heat while the pack 26 is being fed. For initially starting to draw air from within the light-shielding bag 28 (see FIG. 76), two valves A, B connected to the air removal pipe 752 are simultaneously turned on to remove air at a high speed, as shown in FIG. 78. When the pack 26 has been fed a certain distance (see FIG. 77) and its speed becomes the low speed v1, only the valve B is turned off to remove air at a low speed. By thus removing air from within the light-shielding bag 28, the light-shielding bag 28 shrinks tightly around the pack 26, thus securing the films F in position. Therefore, the films F are prevented from collapsing in a finally produced film package W while the film package W is being shipped. Furthermore, because air can be prevented from being excessively removed from within the light-shielding bag 28, the light-shielding bag 28 will not subsequently be sealed at an undesired position which would otherwise tend to be displaced due to excessive shrinkage of the light-shielding bag 28.

After air has been removed from the light-shielding bag 28, the front end of the light-shielding bag 28 is fused with heat by the rear flap sealer 760, and the rear end thereof is cut off by the front flap sealer 758, leaving the rear flap 32.

The pack 26 in the light-shielding bag 28 thus shielded from light is fed to the film package producer 730 by the feed belt 748*c*. If the light-shielding bag 28 with the pack 26 therein is defective or to be inspected, then the light-shielding bag 28 is discharged into the storage case 766 by the support base 764 that is lowered by the switching cylinder 762.

When the light-shielding bag 28 with the pack 26 therein is fed to the film package producer 730, the rear flap 32 is folded by the rear flap folder 770. Such a process of folding the rear flap 32 will be described below with reference to FIGS. 33, 79, and 80 through 85.

When the drive motor 786 is energized, the pack 26 is fed by the feed belt 768. If the front end of the light-shielding bag 28 is detected in step S1, then the front flap holder lifting and lowering cylinder 790 is actuated to lower the front flap holder 772 in step S2. Therefore, the front flap 30 is sandwiched between the front flap holder 772 and the feed belt 768 (see FIG. 80).

Figure 80:
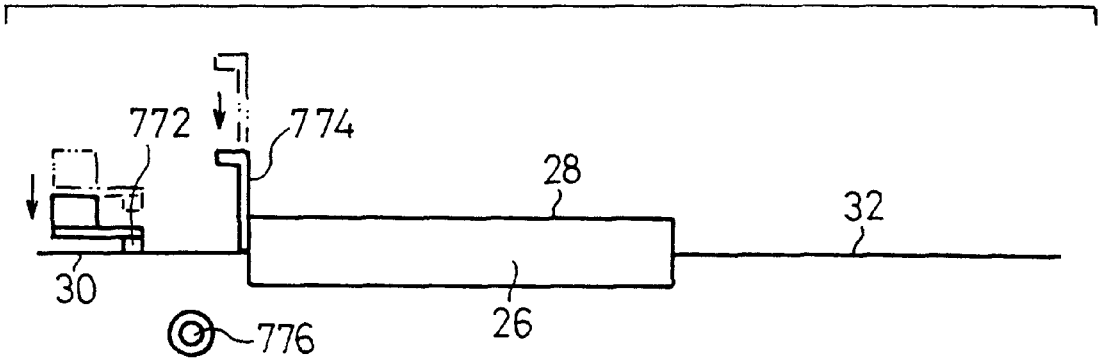
FIG. 80 is an elevational view showing the manner in which a front flap holder in the film package producer of the package producing apparatus operates.
Figure 81:
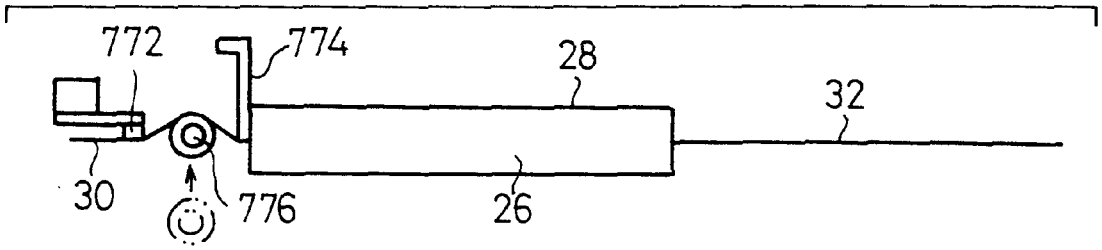
FIG. 81 is an elevational view showing the manner in which the pack is positioned in the film package producer of the package producing apparatus.

Then, the front corner positioning plate lifting and lowering cylinder 792 is actuated to lower the front corner positioning plate 774 for thereby positioning the front end of the pack 26 stored in the light-shielding bag 28 in step S3 (see FIG. 80). Then, the shifting roller lifting and lowering cylinder 794 is actuated to elevate the shifting roller 776 for thereby lifting the front flap 30 near the front end of the pack 26. The pack 26 in the light-shielding bag 28 is now shifted toward the rear flap 32 by the front corner positioning plate 774 in step S4 (see FIG. 81).

Figure 82:
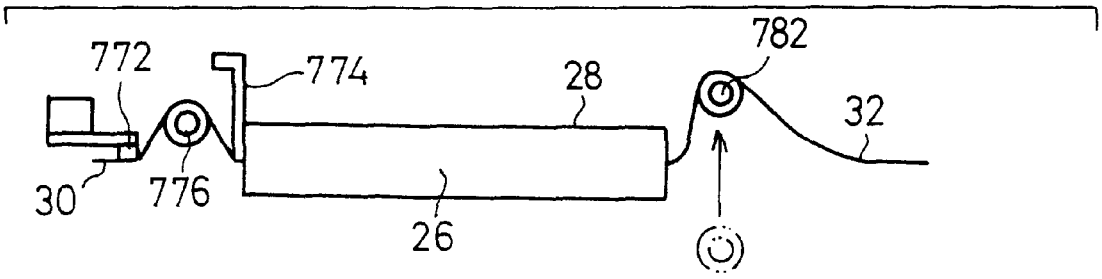
FIG. 82 is an elevational view showing the manner in which a rear flap is folded in the film package producer of the package producing apparatus.
Figure 83:
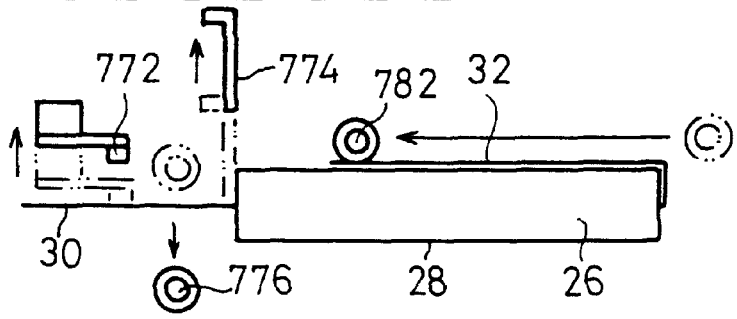
FIG. 83 is an elevational view showing the manner in which the rear flap is folded in the film package producer of the package producing apparatus.

After the pack 26 is positioned at the front flap 30, the folding roller lifting and lowering cylinder 798*a* is actuated to lift the rear flap folding roller 782 together with the guide rail 701 in step S5 (see FIG. 82). If a large-size film package is to be folded, then before the rear flap folding roller 782 is lifted, the rear corner positioning plate lifting and lowering cylinder 796 is actuated to lower the rear corner positioning plate 778 for thereby positioning the rear end of the pack.

After the shifting roller 776 is lowered in step S6, the rodless cylinder 703 is actuated to move the rear flap folding roller 782 forward toward the front flap 30 in step S7. As a result, the rear flap 32 is folded toward the front flap 30 along the upper surface of the light-shielding bag 28 (see FIG. 83). The front flap holder 772 and the front corner positioning plate 774 are lifted to release the front flap 30.

Figure 84:
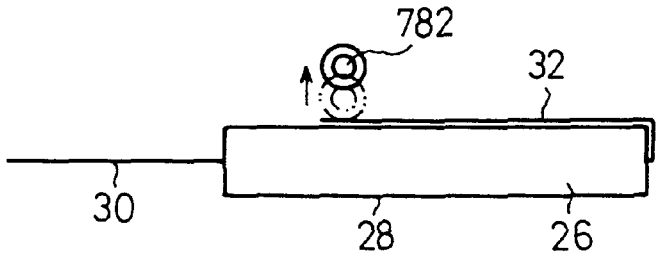
FIG. 84 is an elevational view showing the manner in which a rear flap folder roller in the film package producer of the package producing apparatus is retracted.

After the rear flap 32 is folded, the folding roller lifting and lowering cylinder 798*b* is actuated to lift the rear flap folding roller 782 by a small distance away from the rear flap 32 in step S8 (see FIG. 84).

Figure 85:
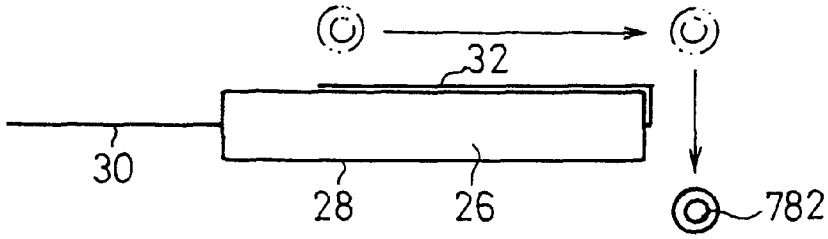
FIG. 85 is an elevational view showing the manner in which the rear flap folder roller in the film package producer of the package producing apparatus is retracted.
Figure 86:
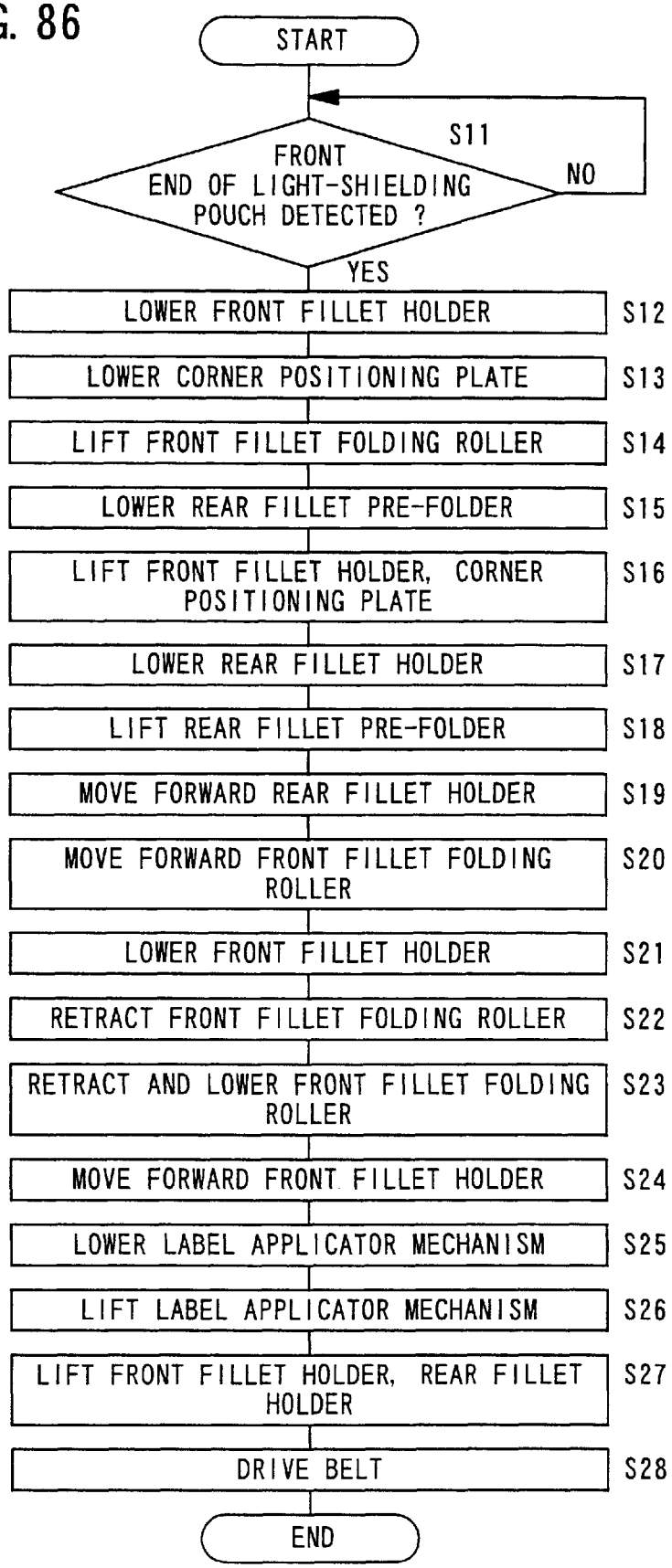
FIG. 86 is a flowchart of a front flap folding process carried out by the film package producer of the package producing apparatus.
Figure 87:
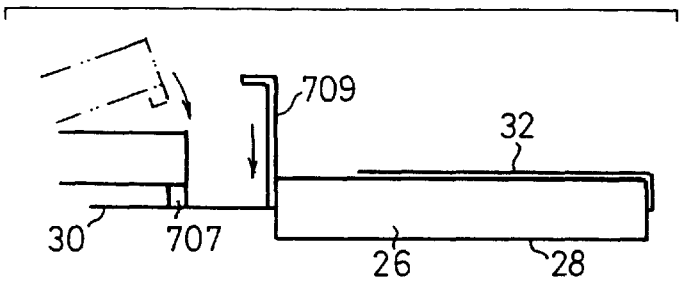
FIG. 87 is an elevational view showing the manner in which a front flap holder in the film package producer of the package producing apparatus operates.
Figure 88:
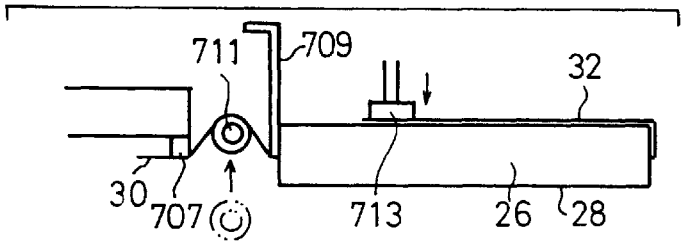
FIG. 88 is an elevational view showing the manner in which a rear flap pre-holder in the film package producer of the package producing apparatus operates.
Figure 89:
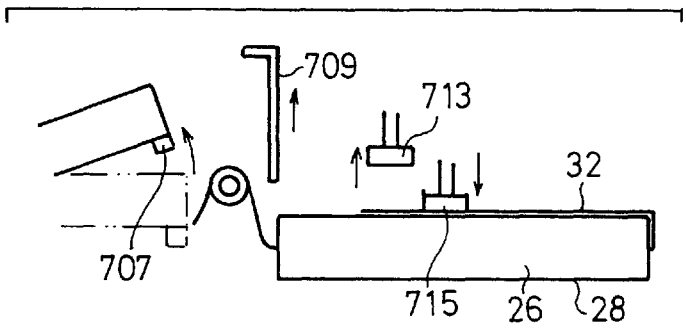
FIG. 89 is an elevational view showing the manner in which a rear flap holder in the film package producer of the package producing apparatus operates.

Thereafter, the feed belt 768 is actuated to feed the light-shielding bag 28 with the folded rear flap 32 to the front flap folder 780, and the rear flap folding roller 782 is retracted downwardly to its original position in step S9 (see FIG. 85).

The light-shielding bag 28 with the pack 26 contained therein is supplied to the front flap folder 780, and the front flap folder 780 folds the front flap 30. Such a process of folding the front flap 30 will be described below with reference to FIGS. 34, 35, 86, and 87 through 94.

When the drive motor 723 is energized, the feed belt 705 feeds the pack 26. If the front end of the light-shielding bag 28 is detected in step S11, then the front flap holder turning cylinder 727 is actuated to cause the link 725 to lower the front bag end holder 707 in step S12.

Therefore, the front flap 30 is gripped by the front bag end holder 707 and the feed belt 705. Then, the front corner positioning plate lifting and lowering cylinder 731 is actuated to lower the front corner positioning plate 709 to position the front end of the pack 26 placed in the light-shielding bag 28 in step S13 (see FIG. 87).

Then, the folding roller lifting and lowering cylinder 733*a* is actuated to lift the guide rail 735 and the front flap folding roller 711 to a position for placing the front flap 30 onto the upper surface of the light-shielding bag 28 in step S14. Then, the rear flap pre-holder lifting and lowering cylinder 739 is actuated to lower the rear flap pre-holder 713 for thereby pre-holding the front end of the rear flap 32 in step S15 (see FIG. 88).

Then, the front bag end holder 707 and the front corner positioning plate 709 are elevated release the front flap 30 in step S16. Thereafter, the rear flap holder lifting and lowering cylinder 745 is actuated to lower the rear flap holders 715*a*, 715*b* for thereby fully holding the rear flap 32 in step S17. Then, the rear flap pre-holder 713 is lifted in step S18 (see FIG. 89).

After the flap pre-holder 713 is released from the rear flap 32, the rear flap holder displacing cylinders 747 are actuated to move the brackets 741 along the guide rails 749 for thereby moving the rear flap holders 715*a*, 715*b* forward toward the front flap 30 in step S19. As a result, the rear flap 32 is shifted toward the front flap 30.

Figure 90:
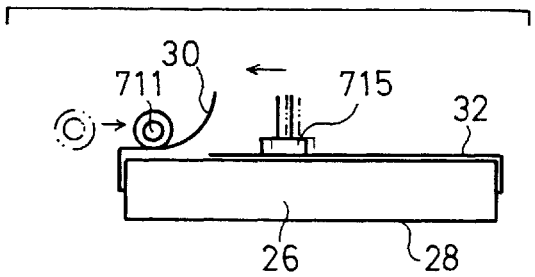
FIG. 90 is an elevational view showing the manner in which the rear flap is shifted in the film package producer of the package producing apparatus.
Figure 91:
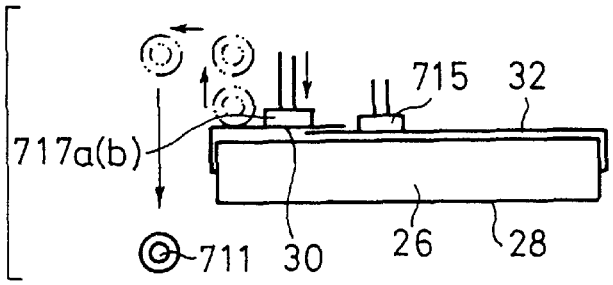
FIG. 91 is an elevational view showing the manner in which the front flap holder in the film package producer of the package producing apparatus operates.

Then, the rodless cylinder 737 is actuated to move the front flap folding roller 711 along the guide rail 735 toward the rear flap 32 in step S20 (see FIG. 90). As a result, the end of the front flap 30 is superposed on the end of the rear flap 32.

After the front flap 30 is superposed on the rear flap 32, the front flap holder lifting and lowering cylinder 755 is actuated to cause the brackets 753, 751 to lower the front flap holders 717*a*, 717*b*, thus holding the front flap 30 in step S21. Subsequently, the folding roller lifting and lowering cylinder 733*b* is actuated to lift the front flap folding roller 711 by a small distance away from the front flap 30 in step S22. Then, the rodless cylinder 737 is actuated to retract the front flap folding roller 711. Thereafter, the front flap folding roller 711 is lowered back to its original position by the folding roller lifting and lowering cylinder 733*a* in step S23 (see FIG. 91).

Figure 92:
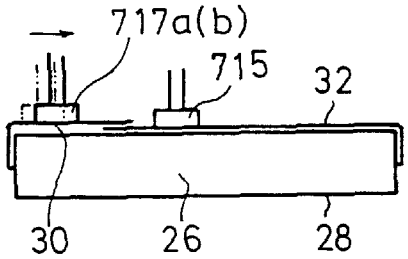
FIG. 92 is an elevational view showing the manner in which the front flap is shifted in the film package producer of the package producing apparatus.

Then, the front flap holder displacing cylinders 757 are actuated to move the front flap holders 717*a*, 717*b* along the guide rails 759 toward the rear flap 32, so that the rear flap 32 and the front flap 30 are superposed on each other while under tension in step S24 (see FIG. 92).

Figure 93:
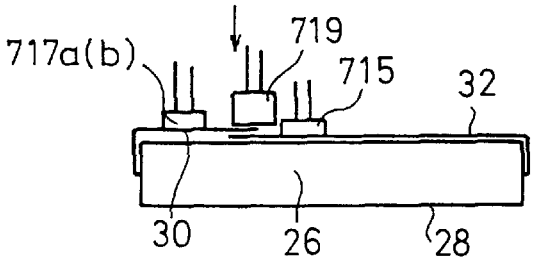
FIG. 93 is an elevational view showing the manner in which a label is applied in the film package producer of the package producing apparatus.
Figure 94:
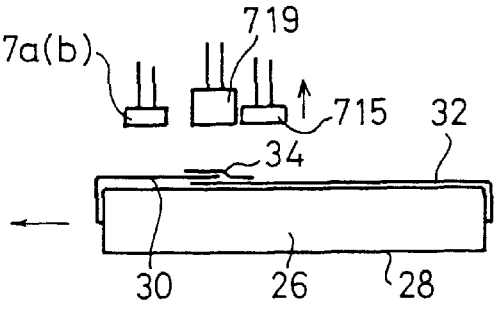
FIG. 94 is an elevational view showing the manner in which the front flap holder, the rear flap holder, and the label applicator mechanism are retracted in the film package producer of the package producing apparatus.

The label applicator mechanism 719 enters from between the front flap holders 717*a*, 717*b*, and applies a label 34 across the superposed front and rear flaps 30, 32 in step S25 (see FIG. 93). A film package W is now completed.

After having applied the label 34, the label applicator mechanism 719 is lifted in step S26. The front flap holders 717*a*, 717*b* and the rear flap holders 715*a*, 715*b* are lifted in step S27. The feed belt 705 is actuated to feed the film package W to the package stacking apparatus 800 in step S28 (see FIG. 94).

The film package W thus produced is supplied to the package stacking apparatus 800 by the feed belt 763 (see FIG. 27). A stacking process carried out by the package stacking apparatus 800 will be described below with reference to FIGS. 36 through 41 and 95 through 98.

Figure 95:
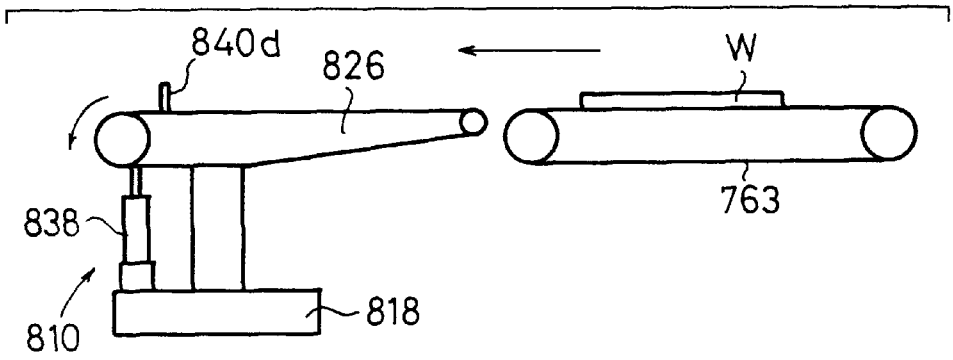
FIG. 95 is an elevational view showing the manner in which a film package is received by the package delivery machine of the package stacking apparatus.
Figure 96:
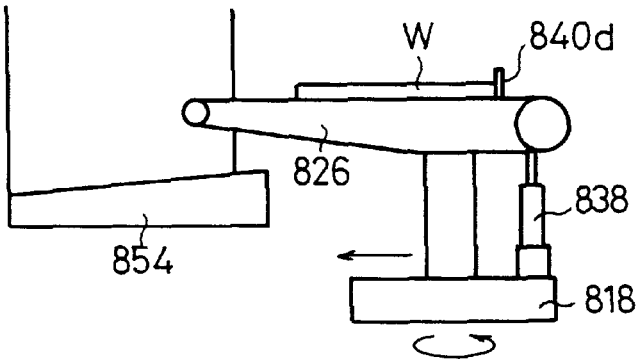
FIG. 96 is an elevational view showing the manner in which the film package is supplied to a magazine by the package delivery machine of the package stacking apparatus.
Figure 97:
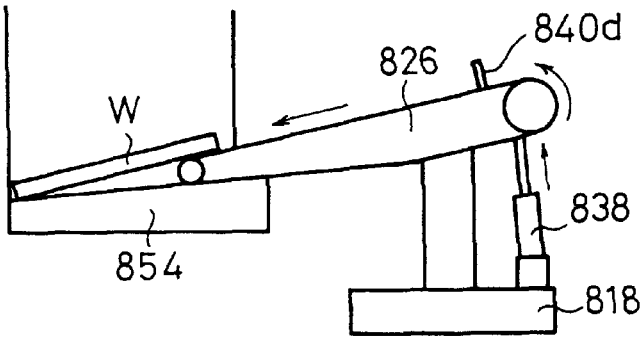
FIG. 97 is an elevational view showing the manner in which the film package is supplied to the magazine by the package delivery machine of the package stacking apparatus.
Figure 98:
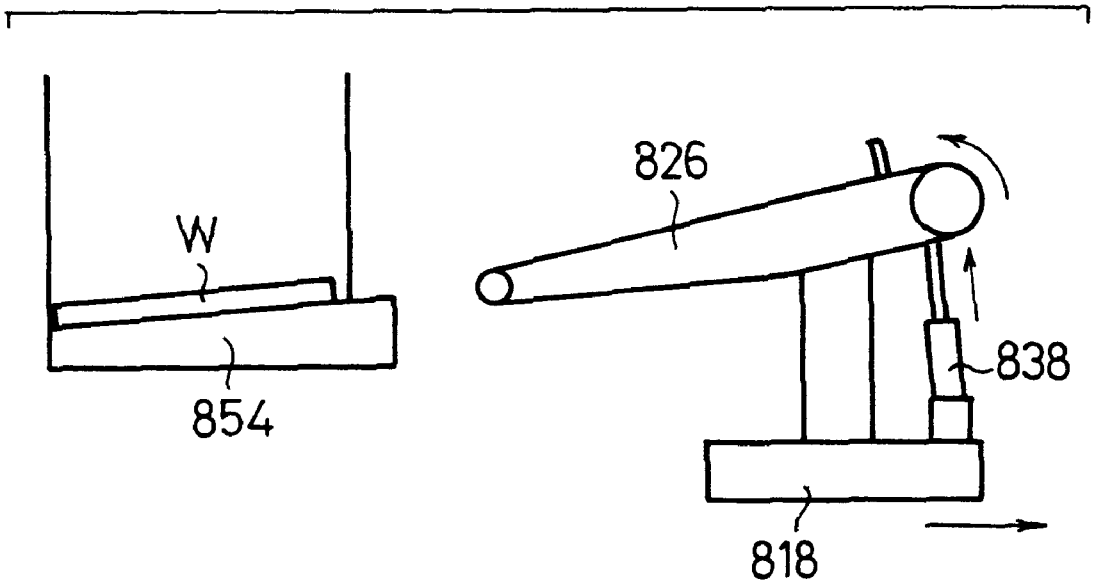
FIG. 98 is an elevational view showing the manner in which the package delivery machine of the package stacking apparatus is retracted.

The film package W supplied from the feed belt 763 is placed onto the feed belts 830*a*, 830*b* of the package delivery machine 810 (see FIG. 37), and positioned by the guide plates 840*a*, 840*b*, 840*d* (see FIG. 95). If a large-size film package is employed, then the guide plate 840*b* is removed, and the large-size film package is placed on the feed belts 830*a*, 830*b*, 830*c*, and positioned by the guide plates 840*a*, 840*c*, 840*d*.

The package retaining mechanism 826 with the film package W placed thereon is turned 180° via the gears 812, 808 by the turntable drive motor 814. Thereafter, the rodless cylinder 822 is actuated to move the package retaining mechanism 826 along the guide rails 816*a*, 816*b* toward the magazine 854 disposed in the station Sa of the package stacker 820 (see FIG. 96).

Then, after the distal end of the package retaining mechanism 826 enters the magazine 854 in the station Sa, the package retaining mechanism tilting cylinder 838 is actuated to tilt the package retaining mechanism 826. Then, the feed belt drive motor 836 is energized to cause the belt 834 to move the feed belts 830*a*, 830*b*, 830*c* for thereby moving the film package W from the package retaining mechanism 826 into the magazine 854 (see FIG. 97). At the time the film package W is displaced a given distance into the magazine 854, the rodless cylinder 822 is actuated to retract the package retaining mechanism 826 while the feed belt drive motor 836 is being energized, thus fully placing the film package W into the magazine 854 (see FIG. 98).

The magazine 854 in the station Sa is placed on the feed chain 846*b* that is vertically movable. Each time a film package W is stacked, the magazine 854 is lowered one step, so that a plurality of film packages W can be stacked in the magazine 854. As shown in FIG. 39, since the magazine 854 has its bottom plate 856 inclined downwardly toward the back of the second side wall 860, a plurality of film packages W can stably be stacked in the magazine 854 without collapsing.

The magazine 854 with the film packages W stacked therein is fed from the station Sa with the feed chain 846*b* successively to the stations Sb, Sc with the feed chain 846*c*. The magazine 854 fed to the station Sc is pushed successively to the stations Sd, Se, Sf by the arm 852*a* of the mobile robot 850*a* positioned alongside of the station Sc. The magazine 854 pushed successively to the stations Sd, Se, Sf is then pushed successively to the stations Sg through Si on the pallet 855 by the arm 852*b* of the mobile robot 850*b* disposed alongside of the station Sf.

When nine magazines 854 are fed to the stations Sg through So, they are delivered together with the pallet 855 by a fork lift or the like.

Then, empty magazines 854 are placed in the stations Sg through So. These empty magazines 854 are pushed to the stations Sp through Sr, and thereafter pushed to the station Ss with the feed chain 846*a* by the mobile robot 850*c*. Then, the empty magazines 854 are supplied via the station St to the station Sa.

A defective film package W, for example, is discharged to the station Sw by the package delivery machine 810. A film package W to be inspected is discharged to the station Sv by the package delivery machine 810 or via the station Su. The inspected film package W can be returned to the station St by the mobile robot 850*e*.

The magazine size changing robot 882 for changing the size of the magazine 854 depending on the size of film packages W is disposed near the station Ss. Operation of the magazine size changing robot 882 will be described below with reference to FIGS. 39 through 41.

As shown in FIG. 39, the magazine 854 has the side wall 860 movable along the guide bar 864. Now, a process of changing the size of a magazine 854 for storing small-size film packages W to the size of a magazine 854 for storing large-size film packages W will be described below.

When a magazine 854 is placed in the station Ss, as shown in FIG. 41, the pin gripper unit 890 is moved to a position above the fixing means 870 on the back of the magazine 854, after which the air cylinder 894 is actuated to lower the arm 888. Then, the first chuck 896 is actuated to cause the chuck arms 801*a*, 801*b* to grip the tubular member 872 of the fixing means 870. The displacing cylinder 805 of the second chuck 898 is actuated to displace the chuck arms 803*a*, 803*b* to grip the first flange 878 of the pin 876. Thereafter, the displacing cylinder 807 is actuated to lift the chuck arms 803*a*, 803*b* to remove the pin 876 from the hole 868*b* defined in the bottom plate 856 of the magazine 854. Then, the displacing cylinder 809 is actuated to move the pin gripper unit 890 along the arm 888 for thereby moving the second side wall 860 together with the fixing means 870. As a result, a magazine 854 for storing large-size film packages W is constructed. Thereafter, the first chuck 896 and the second chuck 898 release the fixing means 870 to allow the pin 876 to engage in the hole 868*a*.

The process of changing the size of a magazine 854 with the magazine size changing robot 882 is now completed.

Figure 99:
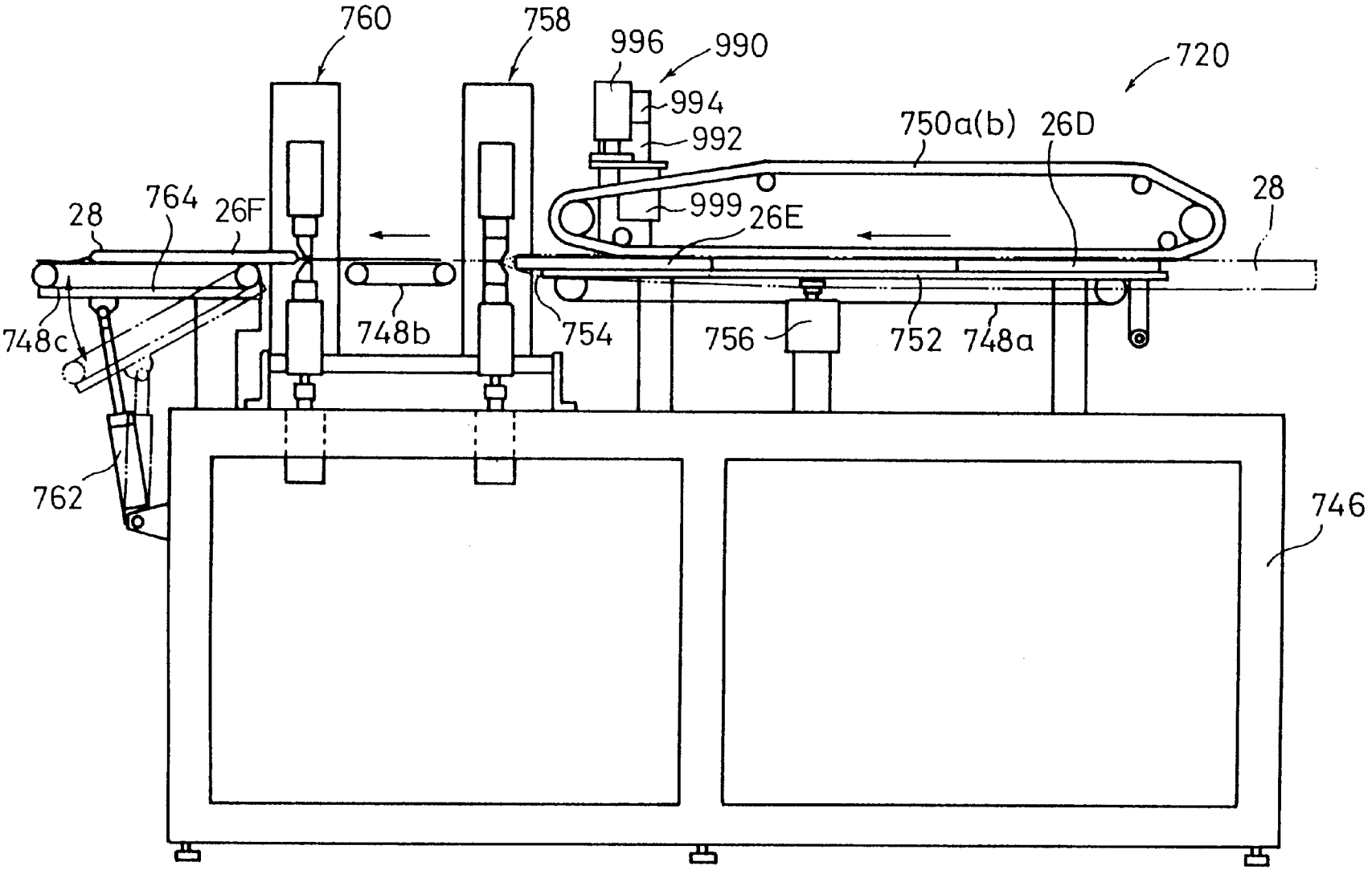
FIG. 99 is a side elevational view of a pack inserter according to another embodiment of the present invention.
Figure 100:
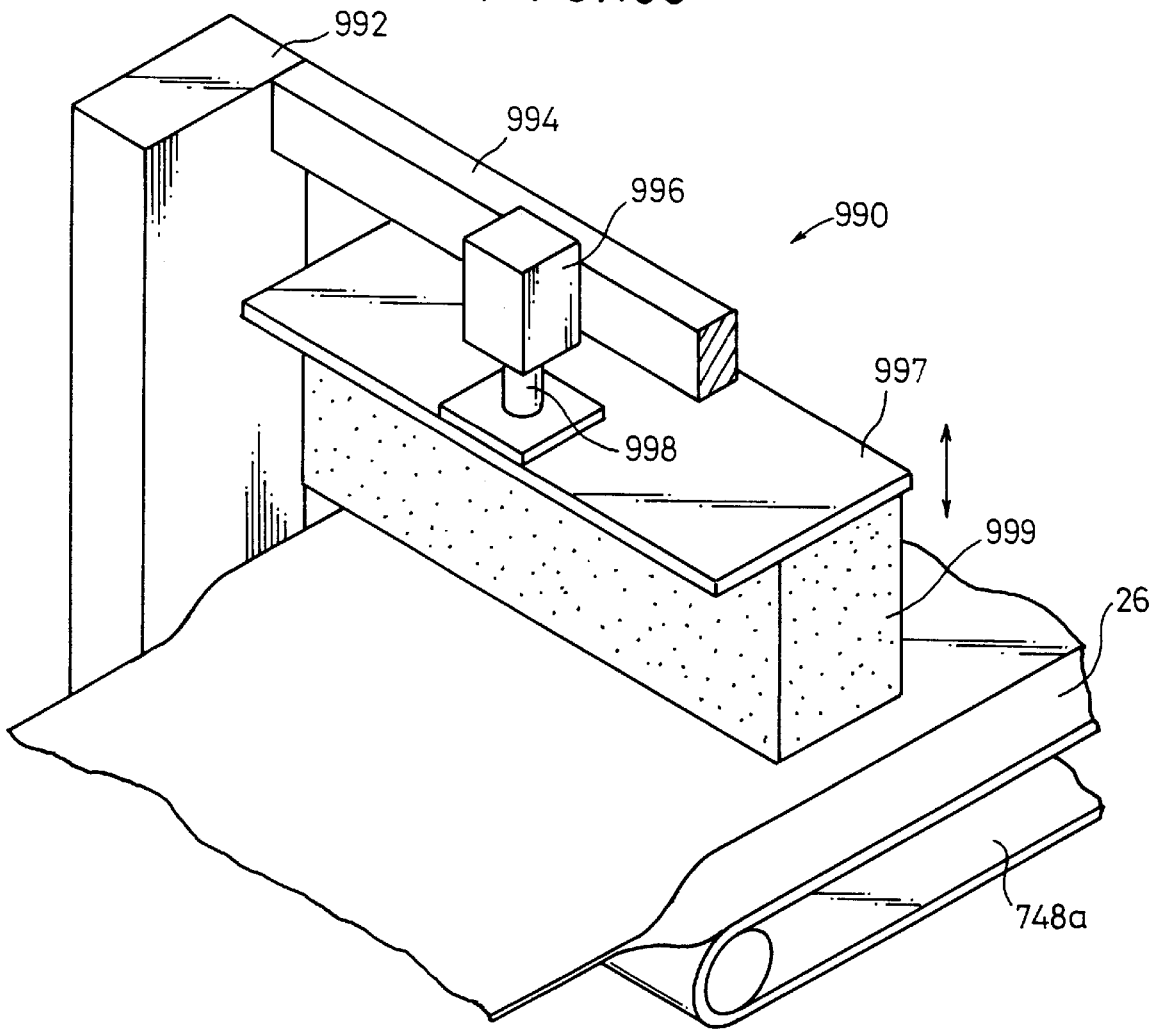
FIG. 100 is a perspective view of a press means of the pack inserter shown in FIG. 99.

FIG. 99 shows a pack inserter 720 according to another embodiment of the present invention. Those parts shown in FIG. 99 which are identical to those shown in FIG. 31 are denoted by identical reference characters, and will not be described in detail below. In FIG. 99, a press means 990 for pressing a light-shielding bag 28 in coaction with the feed belt 748*a* is disposed upstream of the opening 754 of the air removal pipe 752 with respect to the direction in which the pack 26 is fed, and above the gap between the rubber belts 750*a*, 750*b*. As shown in FIG. 100, the press means 990 comprises a press cylinder 996 fixed by a guide bar 994 to columns 992 vertically disposed on opposite sides of the feed belt 748*a*. In FIG. 100, the rubber belts 750*a*, 750*b* are omitted from illustration. The press cylinder 996 includes a movable rod 998 having a lower end on which a cushion member 999 is mounted by a bracket 997. The cushion member 999 is of a prismatic shape that is elongate in a direction perpendicular to the direction in which the pack 26 is fed. The cushion member 999 may be replaced with a roller 984 (see FIG. 101) that is elongate in a direction perpendicular to the direction in which the pack 26 is fed.

Figure 102:
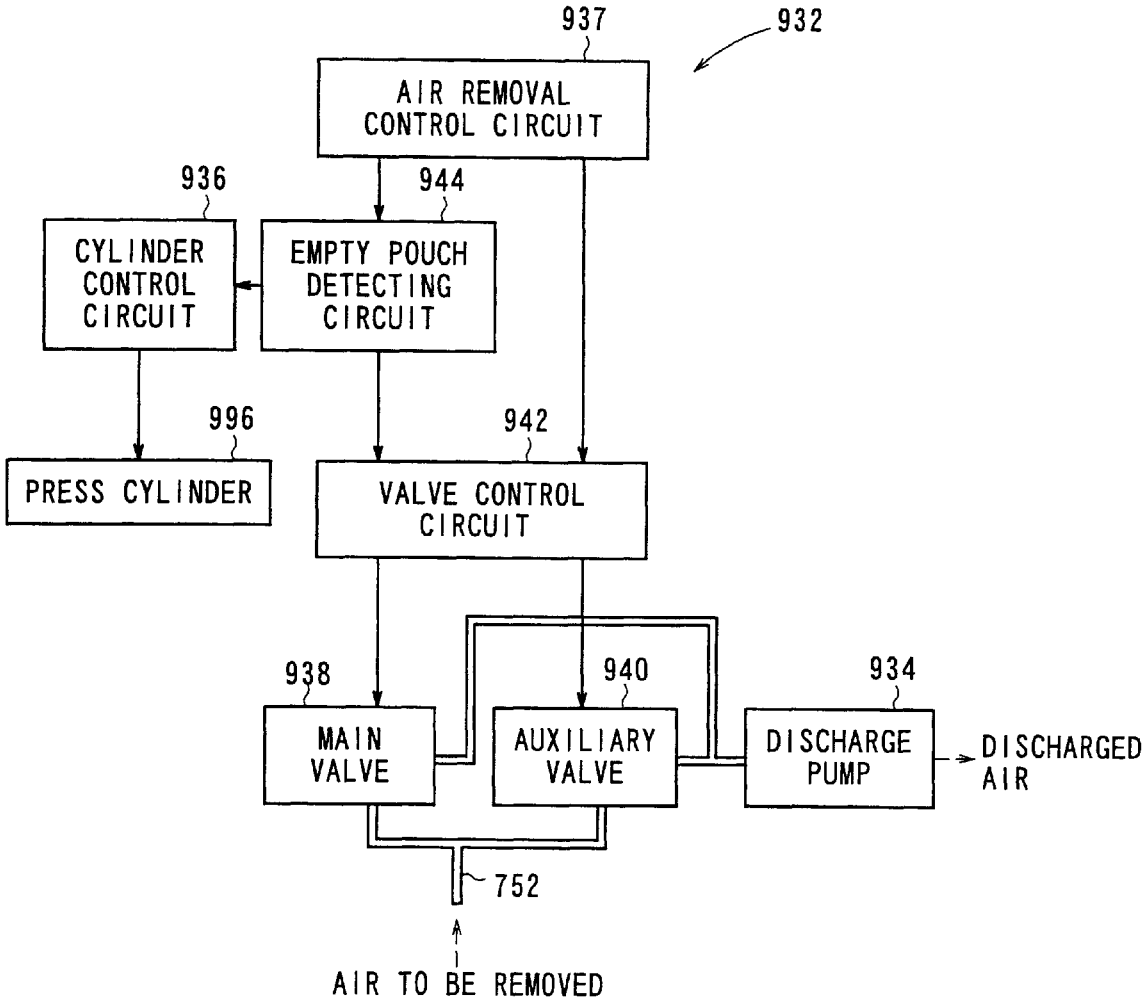
FIG. 102 is a block diagram of an air removal circuit.

FIG. 102 is a block diagram of an air removal circuit 932 for removing air from a light-shielding bag 28 with the air removal pipe 752 and the press means 990 in the pack inserter 720.

The air removal circuit 932 has an air discharge pump 934 for discharging air via the air removal pipe 752, and the press cylinder 996 for causing the cushion member 999 or the roller 984 to press a light-shielding bag 28 against the feed belt 748*a*. The press cylinder 996 is controlled by a cylinder control circuit 936. The air removal pipe 752 is connected to the air discharge pump 934 by a main valve 938 and an auxiliary valve 940, which are controlled by a valve control circuit 942.

An empty bag detecting circuit 944 for detecting whether a pack 26 is placed in a light-shielding bag 28 or not is connected to the cylinder control circuit 936 and the valve control circuit 942. The empty bag detecting circuit 944 and the valve control circuit 942 are controlled by an air removal control circuit 937.

A process of removing air in the pack inserter 720 will be described below.

Figure 103:
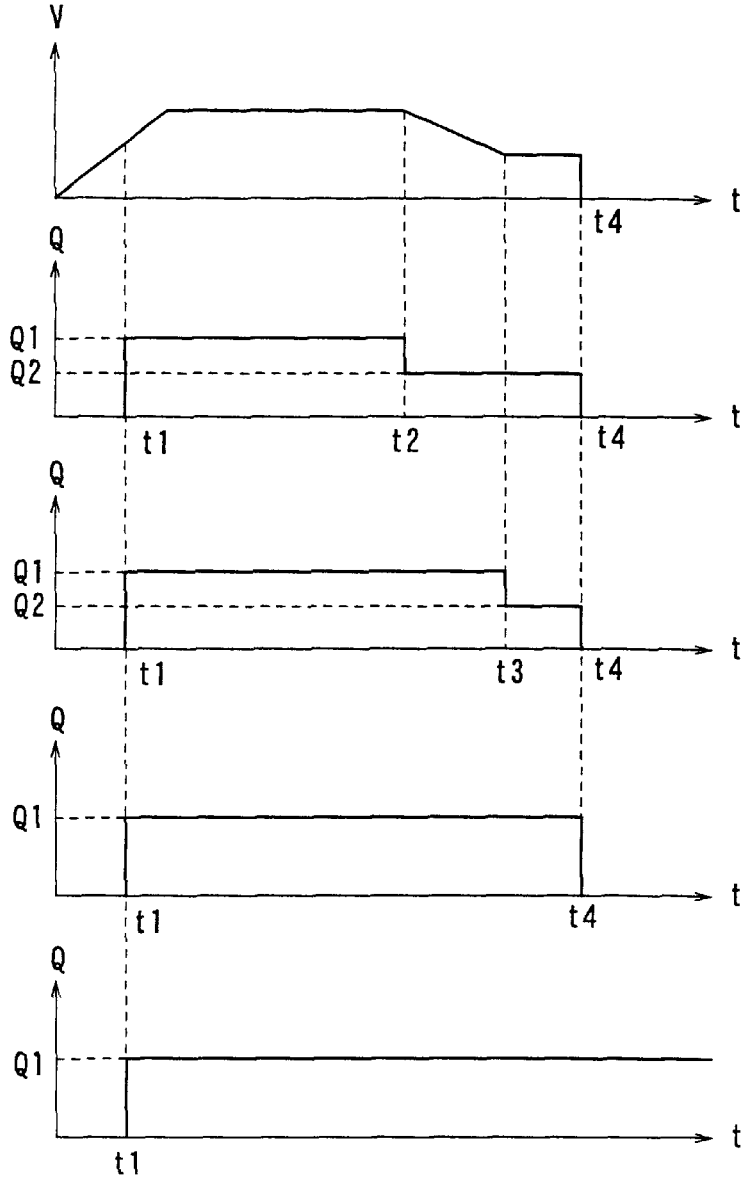
FIGS. 103(1) through 103(5) are timing charts showing air removing processes.

The pack 26 is fed to the pack inserter 720 at a speed V shown in FIG. 103(1). In the pack inserter 720, the air removal control circuit 937 of the air removal circuit 932 controls the valve control circuit 942 to control the main valve 938 and the auxiliary valve 940.

Figure 77:
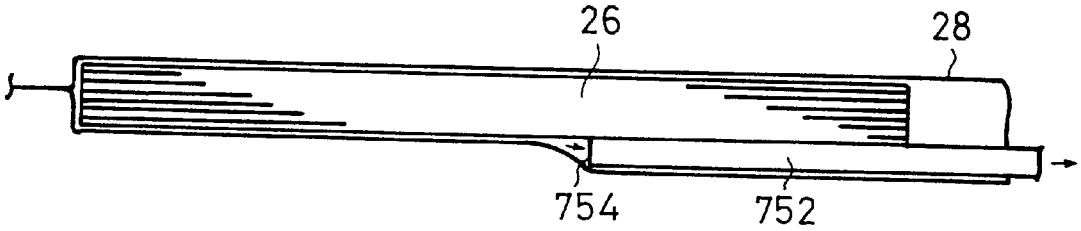
FIG. 77 is a cross-sectional view showing the manner in which the pack inserter of the package producing apparatus operates.
Figure 78:
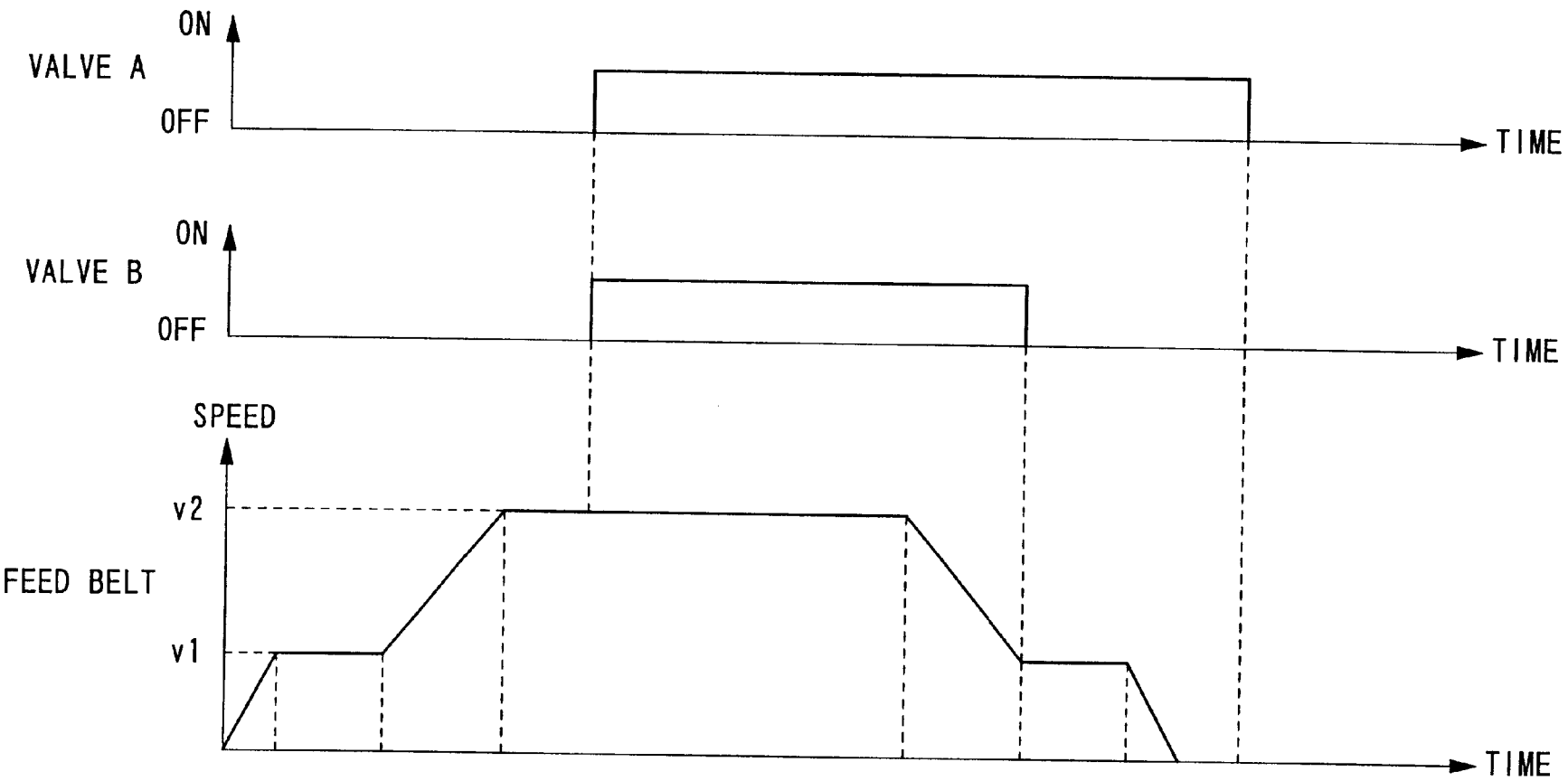
FIG. 78 is a timing chart of operation of the pack inserter of the package producing apparatus.
Figure 79:
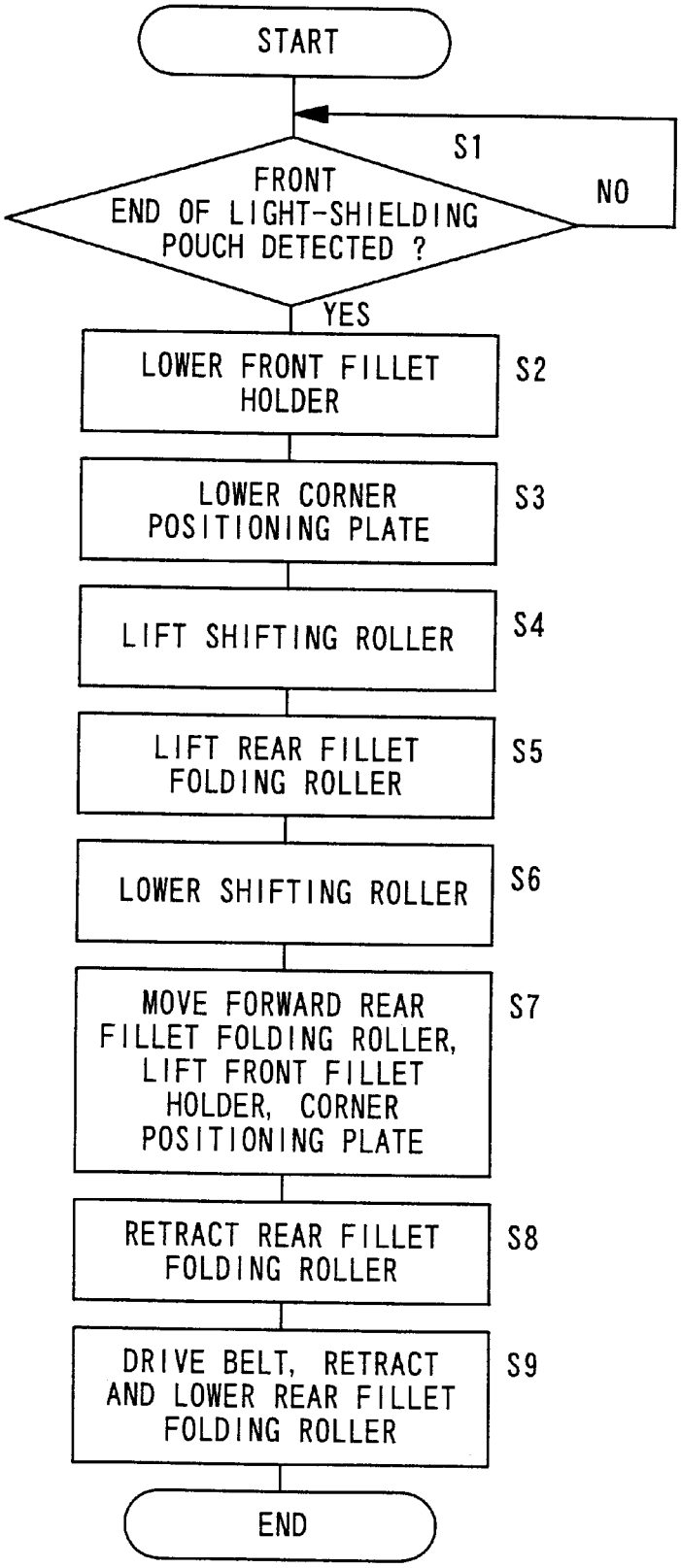
FIG. 79 is a flowchart of a rear flap folding process carried out by a film package producer of the package producing apparatus.

After the front flap 30 of the light-shielding bag 28 is sealed by the front flap cutter sealer 758, as shown in FIG. 102(2), only the main valve 938, which has an air discharge capacity Q=Q1, connected to the air removal pipe 752 is turned on to remove air at a high rate, from a time t1 when the air discharge pump 934 starts drawing air to a time t2 when air is removed from the light-shielding bag 28 as shown in FIG. 77. Then, the main valve 938 is turned off and the auxiliary valve 940, which has an air discharge capacity Q=Q2 (<Q1), is turned on to remove air at a low rate, from the time t2 when the pack 26 has been fed a predetermined distance to a time t4 when the rear flap 32 of the light-shielding bag 28 reaches the front flap cutting sealer 758 and the feeding of the pack 26 is temporarily stopped. In this manner, air is removed from the light-shielding bag 28 to cause the light-shielding bag 28 shrink tightly around the pack 26, thus securing the films F in position. Therefore, the films F are prevented from collapsing in a finally produced film package W while the film package W is being shipped. Furthermore, because air can be prevented from being excessively removed from within the light-shielding bag 28, the label 34 applied at a later time is prevented from being positionally displaced due to excessive shrinkage of the light-shielding bag 28.

If packs 26 are successively supplied to the pack inserter 720, then the light-shielding bags 28 containing those packs 26 from which air has been removed can be supplied to the film package producer 730 by performing the above air removing process. If the supply of packs 26 is interrupted for some reason, then it is necessary to adjust the air discharge capacity Q for removing air from the packs 26. For example, the light-shielding bag 28 supplied by the light-shielding bag supply mechanism 702 has regions joined by tapes. Since a film package W including such a region cannot be shipped as a product, it needs to be removed. Therefore, when a joined region of the light-shielding bag 28 is supplied to the pack feeder 710, no pack is supplied. No pack is supplied either when a pack 26 is defective even when the light-shielding bag 28 is normal. Under such a condition, the light-shielding bag 28 is supplied in an empty state to the pack inserter 720. If the empty light-shielding bag 28 is supplied to the pack inserter 720, air cannot sufficiently be removed from the light-shielding bag 28 downstream of the empty light-shielding bag 28.

A process carried out by the air removal circuit 932 when there is no pack 26 and an empty space is present instead in the pack feeder 710 where packs 26 start being inserted into the light-shielding bag 28 will be described below. The empty bag detecting circuit 944 detects an empty space based on a signal from a sensor or the like, and sends a control signal to the valve control circuit 942. In response to the control signal, the valve control circuit 942 controls the main valve 938 and the auxiliary valve 940. Specifically, the valve control circuit 942 continuously turns on the main valve 938 until a time t3 (>t2) in FIG. 103(3), and then keeps the auxiliary valve 940 turned on until the time t4, for thereby removing air from a pack 26 that is positioned at the opening 754 in the air removal pipe 752.

When the empty space reaches the pack inserter 720, the valve control circuit 942 turns on only the main valve 938 from the time t1 to the time t4 to remove air from the pack 26 that is positioned at the opening 754 in the air removal pipe 752.

When the empty space reaches the pack inserter 720, the press means 990 is actuated, and thereafter air is removed by the main valve 938. Specifically, if no pack is present at the opening 754 in the air removal pipe 752, the empty bag detecting circuit 944 supplies a control signal to the cylinder control circuit 936, which actuates the press cylinder 996. The press cylinder 996 lowers the rod 998 to press the cushion member 999 against the light-shielding bag 28. Thereafter, the valve control circuit 942 turns on the main valve 938 to start removing air from the light-shielding bag 28, as shown in FIG. 103(5). Since the light-shielding bag 28 with no pack present therein is pressed by the cushion member 999, its opening is small, and air is sufficiently removed from the light-shielding bag 28 by the air removal pipe 752. Air is simultaneously removed from the preceding pack 26 whose rear flap 32 has not been sealed, by the air removal pipe 752. Air is removed by the main valve 938 continuously until the sealing of the pack 26 with the rear flap sealer 760 is completed.

Figure 101:
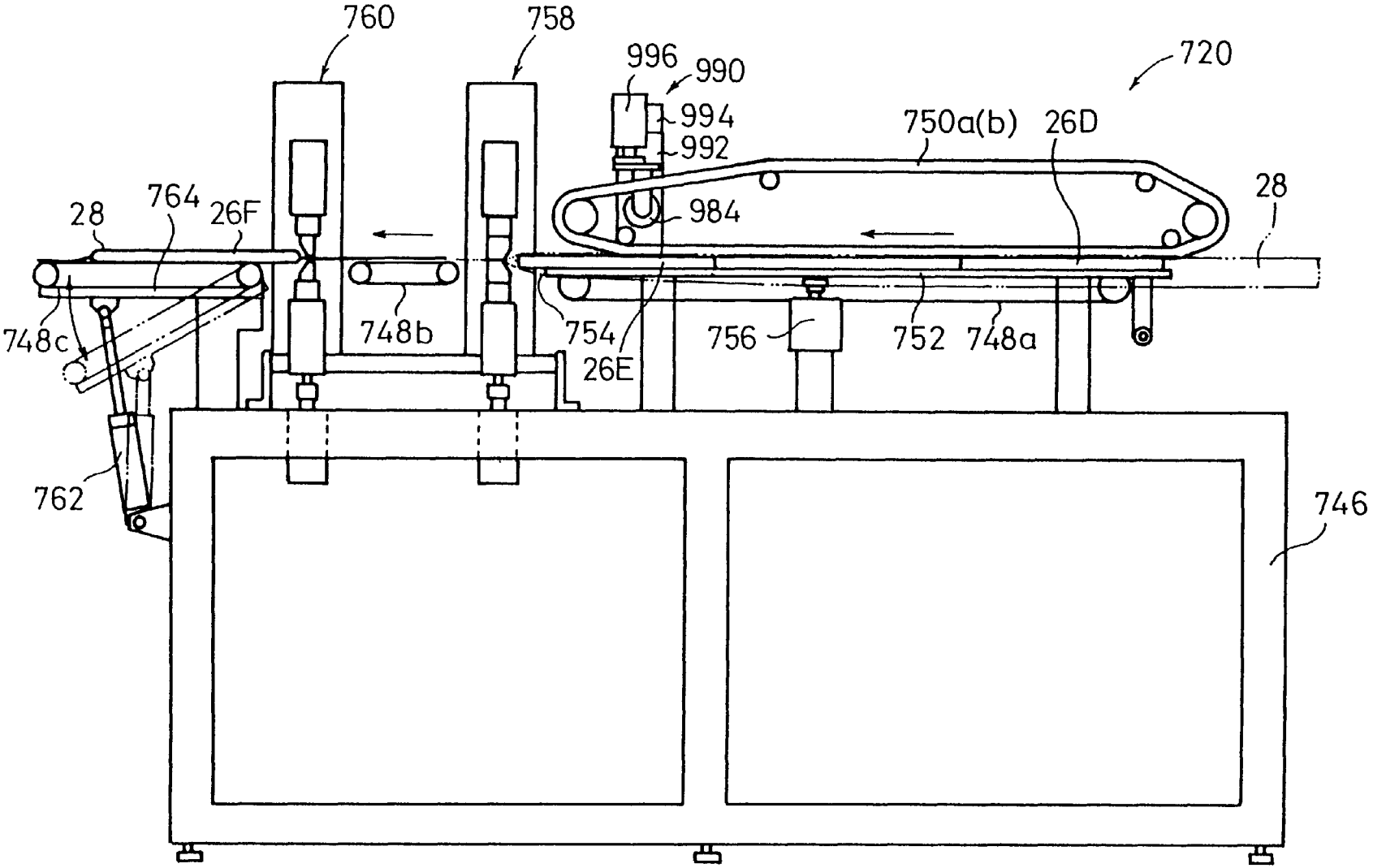
FIG. 101 is a side elevational view of a pack inserter according to still another embodiment of the present invention.

If the roller 984 shown in FIG. 101 is used in place of the cushion member 999, then the roller 984 may be controlled in the same manner as with the cushion member 999. However, if the roller 984 is vertically movable by the pack 26, then any interference caused with the pack 26 by the roller 984 does not need to be taken into account, and the roller 984 may be pressed against the light-shielding bag 28 at all times.

Figure 104:
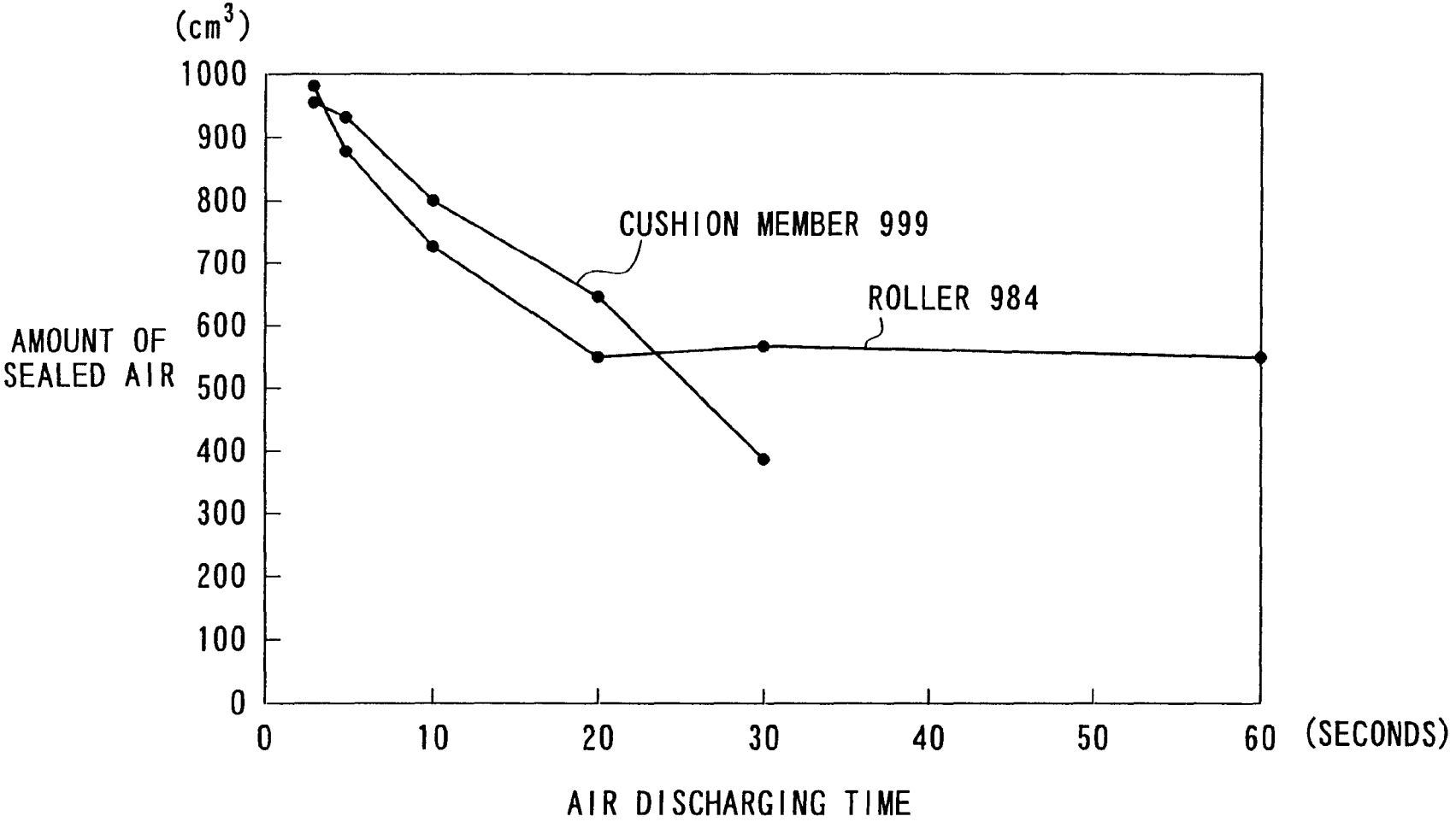
FIG. 104 is a diagram showing the relationship between the air discharging time and the amount of air sealed in a light-shielding bag with respect to a cushion member and a roller.

FIG. 104 shows the relationship between the air discharging time for discharging air with the air discharge pump 934 and the amount of air sealed in the light-shielding bag 28 with respect to the cushion member 999 and the roller 984. The cushion member 999 is effective to increase the hermetic sealing of the light-shielding bag 28, whereas the roller 984 is effective to keep constant the amount of air sealed in the light-shielding bag 28. Therefore, the cushion member 999 is suitable for achieving an increased amount of air to be removed from the light-shielding bag 28, and the roller 984 is suitable for stabilizing the amount of air sealed in the light-shielding bag 28.

Figure 105:
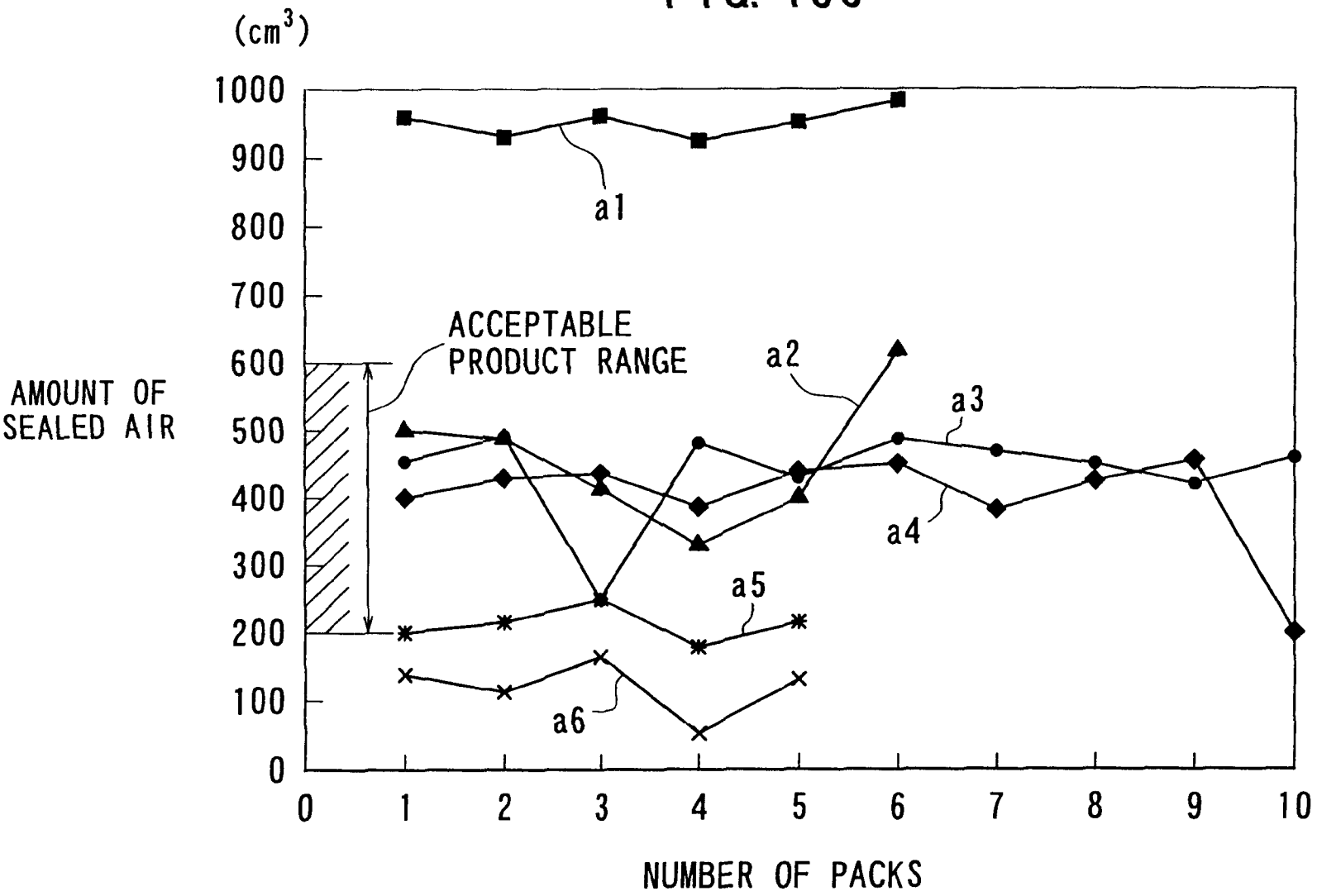
FIG. 105 is a diagram showing, as a comparative example, the relationship between the number of packs that are fed and the amount of air sealed in a light-shielding bag at the time air is constantly removed regardless of whether there is a pack or not.

FIG. 105 shows, as a comparative example, the relationship between the number of packs 26 that are fed and the amount of air sealed in the light-shielding bag 28 at the time air is constantly removed regardless of whether there is a pack 26 or not. The curve al represents sealed amounts of air at the time there is an empty space at the opening 754 in the air removal pipe 752, and these sealed amounts of air fall out of an acceptable product range. The curve a2 represents sealed amounts of air at the time there is an empty space near the inlet of the pack inserter 720, and some of these sealed amounts of air fall out of the acceptable product range. The curves a3, a4 represent sealed amounts of air at the time there is no empty space up to the inlet of the pack inserter 720, and these sealed amounts of air fall in the acceptable product range. The curves a5, a6 represent sealed amounts of air at the time air is excessively discharged.

Figure 106:
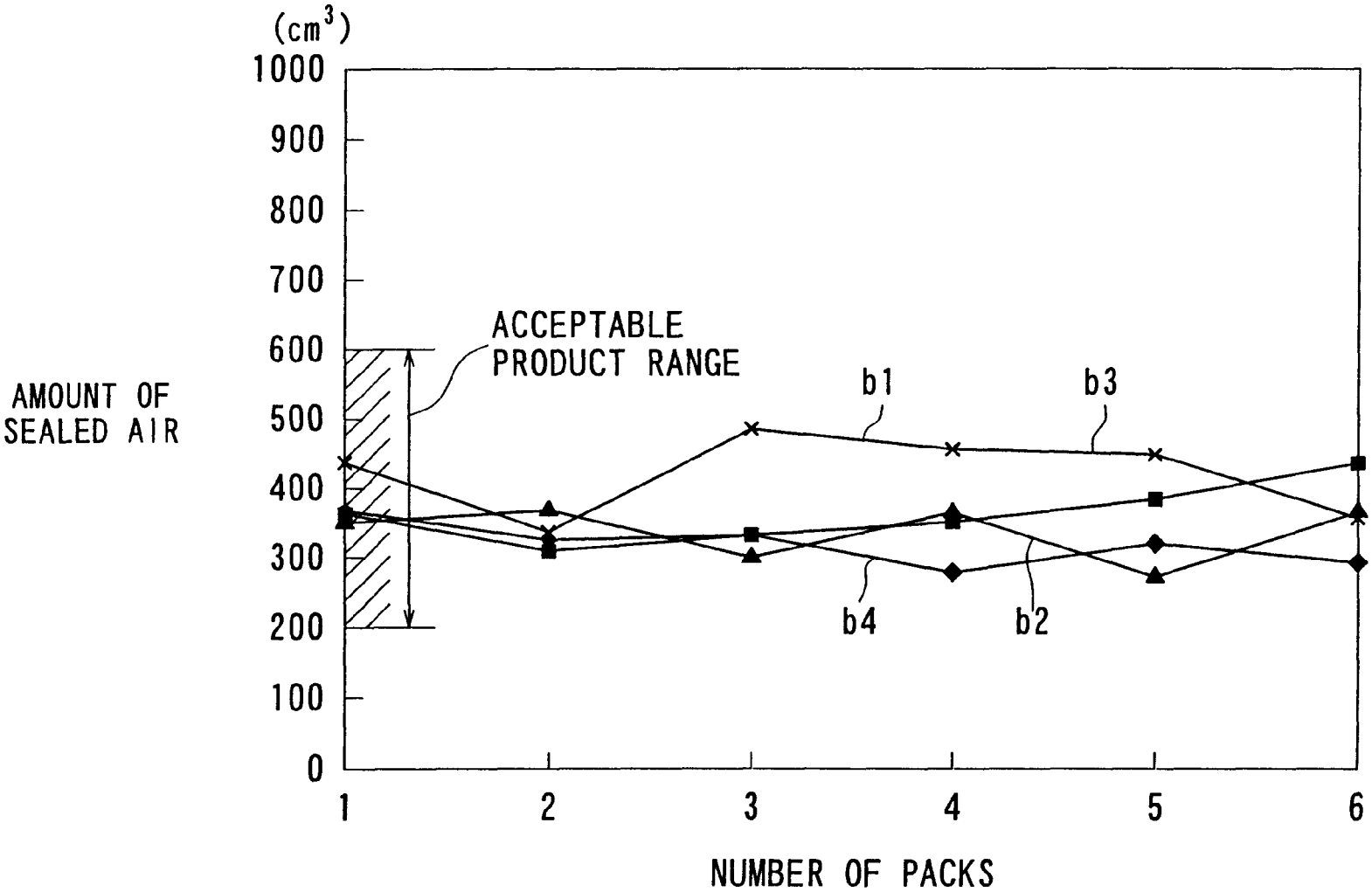
FIG. 106 is a diagram showing, as an inventive example, the relationship between the number of packs that are fed and the amount of air sealed in a light-shielding bag at the time air is constantly removed regardless of whether there is a pack or not.

FIG. 106 shows, as an inventive example, the relationship between the number of packs 26 that are fed and the amount of air sealed in the light-shielding bag 28 at the time air is constantly removed regardless of whether there is a pack 26 or not. The curve b1 represents sealed amounts of air at the time there is an empty space at the opening 754 in the air removal pipe 752. The curve b2 represents sealed amounts of air at the time there is an empty space near the inlet of the pack inserter 720. The curve b3 represents sealed amounts of air at the time there is an empty space at the pack feeder 710, and the curve b4 represents sealed amounts of air at the time there is no empty space at the pack feeder 710. It can be seen from FIG. 106 that all these sealed amounts of air fall in the acceptable product range.

Although certain preferred embodiments of the present invention have been shown and described in detail, it should be understood that various changes and modifications may be made therein without departing from the scope of the appended claims.

What is claimed is:

1. A sheet package production system for producing a package of a plurality of stacked sheets, comprising:

a pack producing apparatus for stacking sheets on a protective cover and folding the protective cover onto the stacked sheets thereby to produce a pack;

a package producing apparatus for producing a package which stores the pack; and a package stacking apparatus for stacking a plurality of packages, wherein said package producing apparatus includes (1) a bag supply for supplying a bag for packaging said pack;

(2) air drawing means disposed in said package producing apparatus, for drawing air from within said bag;

(3) feed means for feeding said pack and said bag in said bag supply and;

the arrangement being such that said air drawing means draws a greater amount of air and a less amount of air during a second period of feeding said pack and said bag said pack and said bag are fed by said feed means than in a latter period of said process.

2. A sheet package production system according to claim 1, wherein said air drawing means comprises an air removal pipe having an opening which is open downstream with respect to a direction in which said pack is fed.

3. A sheet package production system according to claim 1, wherein said feed means comprises means for feeding said pack at a lower speed in said second period than in said first period.

4. A sheet package production system according to claim 1, wherein said package producing apparatus comprises:

press means for reducing the volume of a space in said bag by a predetermined amount;

said air drawing means comprising means for drawing air from said bag from between a region downstream of said press means in a direction in which said pack is fed, and said press means.

5. A sheet package production system according to claim 4, wherein said press means comprises a cushion member extending substantially perpendicular to said direction in which said pack is fed, and pressable by said bag.

6. A sheet package production system according to claim 4, wherein said press means comprises a roller extending substantially perpendicular to said direction in which said pack is fed, and pressable by said bag.

7. A sheet package production system according to claim 4, wherein said press means comprises means controllable for pressing said bag that is empty when the empty bag is fed to a position immediately before a bag which stores said pack therein.

8. A sheet package production system according to claim 4, wherein said air drawing means comprises means for drawing air in a greater amount as the empty bag approaches a bag which stores said pack therein.

* * * * *